US008684088B2

(12) United States Patent
Zediker et al.

(10) Patent No.: US 8,684,088 B2
(45) Date of Patent: Apr. 1, 2014

(54) SHEAR LASER MODULE AND METHOD OF RETROFITTING AND USE

(75) Inventors: Mark S. Zediker, Castle Rock, CO (US); Henry A. Bergeron, Houston, TX (US); Philip V. Clark, Sugar Land, TX (US); Joel F. Moxley, Denver, CO (US); Paul D. Deutch, Houston, TX (US); Charles C. Rinzler, Denver, CO (US)

(73) Assignees: Foro Energy, Inc., Littleton, CO (US); Chevron U.S.A. Inc., Houston, TX (US)

( * ) Notice: Subject to any disclaimer, the term of this patent is extended or adjusted under 35 U.S.C. 154(b) by 39 days.

(21) Appl. No.: 13/034,183

(22) Filed: Feb. 24, 2011

(65) Prior Publication Data

US 2012/0217019 A1 Aug. 30, 2012

(51) Int. Cl.
*E21B 7/12* (2006.01)

(52) U.S. Cl.
USPC ..... 166/338; 166/361; 166/363; 166/364

(58) Field of Classification Search
USPC ..... 166/338, 361, 363, 364, 297, 298, 55, 166/55.6, 85.4; 137/315.02; 251/1.1–1.3; 219/121.67, 121.72
See application file for complete search history.

(56) References Cited

U.S. PATENT DOCUMENTS

| | | | |
|---|---|---|---|
| 914,636 | A | 3/1909 | Case |
| 2,548,463 | A | 4/1951 | Blood |
| 2,742,555 | A | 4/1956 | Murray |
| 3,122,212 | A | 2/1964 | Karlovitz |
| 3,168,334 | A | 2/1965 | Johnson |
| 3,461,964 | A | 8/1969 | Venghiattis |
| 3,493,060 | A | 2/1970 | Van Dyk |
| 3,539,221 | A | 11/1970 | Gladstone |
| 3,544,165 | A | 12/1970 | Snedden |
| 3,556,600 | A | 1/1971 | Shoupp et al. |
| 3,574,357 | A | 4/1971 | Alexandru et al. |
| 3,652,447 | A | 3/1972 | Yant |
| 3,693,718 | A | 9/1972 | Stout |
| 3,820,605 | A | 6/1974 | Barber et al. |
| 3,821,510 | A | 6/1974 | Muncheryan |
| 3,871,485 | A | 3/1975 | Keenan, Jr. |
| 3,882,945 | A | 5/1975 | Keenan, Jr. |
| 3,913,668 | A | 10/1975 | Todd et al. |
| 3,938,599 | A | 2/1976 | Horn |

(Continued)

FOREIGN PATENT DOCUMENTS

| | | |
|---|---|---|
| EP | 0 565 287 A1 | 10/1993 |
| EP | 0 950 170 B1 | 9/2002 |

(Continued)

OTHER PUBLICATIONS

U.S. Appl. No. 12/543,968, filed Aug. 19, 2009, Rinzler et al.

(Continued)

*Primary Examiner* — Matthew Buck
*Assistant Examiner* — Aaron Lembo
(74) *Attorney, Agent, or Firm* — Glen P. Belvis; Steptoe & Johnson LLP

(57) ABSTRACT

There is provided a high power shear laser module, which can be readily included in a blowout preventer stack. The shear laser module as the capability of delivering high power laser energy to a tubular within a blowout preventer cavity, cutting the tubular and thus reducing the likelihood that the tubular will inhibit the ability of the blowout preventer to seal off a well.

64 Claims, 23 Drawing Sheets

(56) References Cited

U.S. PATENT DOCUMENTS 3,960,448 A 6/1976 Schmidt et al.
3,977,478 A 8/1976 Shuck
3,981,369 A 9/1976 Bokenkamp
3,992,095 A 11/1976 Jacoby et al.
3,998,281 A 12/1976 Salisbury et al.
4,019,331 A 4/1977 Rom et al.
4,025,091 A 5/1977 Zeile, Jr.
4,026,356 A 5/1977 Shuck
4,043,575 A 8/1977 Roth
4,046,191 A * 9/1977 Neath ..... 166/352
4,061,190 A 12/1977 Bloomfield
4,066,138 A 1/1978 Salisbury et al.
4,086,971 A 5/1978 Hall et al.
4,090,572 A 5/1978 Welch
4,113,036 A 9/1978 Stout
4,189,705 A 2/1980 Pitts, Jr.
4,194,536 A 3/1980 Stine et al.
4,199,034 A 4/1980 Salisbury et al.
4,227,582 A 10/1980 Price
4,228,856 A 10/1980 Reale
4,252,015 A 2/1981 Harbon et al.
4,256,146 A 3/1981 Genini et al.
4,266,609 A 5/1981 Rom et al.
4,280,535 A 7/1981 Willis
4,282,940 A 8/1981 Salisbury et al.
4,332,401 A 6/1982 Stephenson et al.
4,336,415 A 6/1982 Walling
4,340,245 A 7/1982 Stalder
4,370,886 A 2/1983 Smith, Jr. et al.
4,374,530 A 2/1983 Walling
4,375,164 A 3/1983 Dodge et al.
4,415,184 A 11/1983 Stephenson et al.
4,417,603 A 11/1983 Argy
4,444,420 A 4/1984 McStravick et al.
4,453,570 A 6/1984 Hutchison
4,459,731 A 7/1984 Hutchison
4,477,106 A 10/1984 Hutchison
4,531,552 A 7/1985 Kim
4,533,814 A * 8/1985 Ward ..... 219/121.64
4,565,351 A 1/1986 Conti et al.
4,662,437 A 5/1987 Renfro
4,694,865 A 9/1987 Tauschmann
4,741,405 A 5/1988 Moeny et al.
4,744,420 A 5/1988 Patterson et al.
4,770,493 A 9/1988 Ara et al.
4,793,383 A 12/1988 Gyory et al.
4,830,113 A 5/1989 Geyer
4,860,654 A 8/1989 Chawla et al.
4,860,655 A 8/1989 Chawla
4,872,520 A 10/1989 Nelson
4,989,236 A 1/1991 Myllymäki
4,997,250 A 3/1991 Ortiz, Jr.
5,003,144 A 3/1991 Lindroth et al.
5,004,166 A 4/1991 Sellar
5,033,545 A 7/1991 Sudol
5,049,738 A 9/1991 Gergely et al.
5,070,904 A 12/1991 McMahon et al.
5,084,617 A 1/1992 Gergely
5,086,842 A 2/1992 Cholet
5,107,936 A 4/1992 Foppe
5,121,872 A 6/1992 Legget
5,125,061 A 6/1992 Marlier et al.
5,140,664 A 8/1992 Bosisio et al.
5,163,321 A 11/1992 Perales
5,172,112 A 12/1992 Jennings
5,212,755 A 5/1993 Holmberg
5,285,204 A 2/1994 Sas-Jaworsky
5,348,097 A 9/1994 Giannesini et al.
5,351,533 A 10/1994 Macadam et al.
5,353,875 A 10/1994 Schultz et al.
5,396,805 A 3/1995 Surjaatmadja
5,400,857 A 3/1995 Whitby et al.
5,411,081 A 5/1995 Moore et al.
5,411,085 A 5/1995 Moore et al.
5,411,105 A 5/1995 Gray
5,413,045 A 5/1995 Miszewski
5,413,170 A 5/1995 Moore
5,423,383 A 6/1995 Pringle
5,425,420 A 6/1995 Pringle
5,435,351 A 7/1995 Head
5,435,395 A 7/1995 Connell
5,463,711 A 10/1995 Chu
5,465,793 A 11/1995 Pringle
5,469,878 A 11/1995 Pringle
5,479,860 A 1/1996 Ellis
5,483,988 A 1/1996 Pringle
5,488,992 A 2/1996 Pringle
5,500,768 A 3/1996 Doggett et al.
5,503,014 A 4/1996 Griffith
5,503,370 A 4/1996 Newman et al.
5,505,259 A 4/1996 Wittrisch et al.
5,515,926 A 5/1996 Boychuk
5,561,516 A 10/1996 Noble et al.
5,566,764 A 10/1996 Elliston
5,573,225 A 11/1996 Boyle et al.
5,577,560 A 11/1996 Coronado et al.
5,599,004 A 2/1997 Newman et al.
5,638,904 A 6/1997 Misselbrook et al.
5,655,745 A 8/1997 Morrill
5,694,408 A 12/1997 Bott et al.
5,735,502 A * 4/1998 Levett et al. ..... 251/1.3
5,757,484 A 5/1998 Miles et al.
5,771,974 A 6/1998 Stewart et al.
5,771,984 A 6/1998 Potter et al.
5,847,825 A 12/1998 Alexander
5,862,273 A 1/1999 Pelletier
5,864,113 A * 1/1999 Cossi ..... 219/121.67
5,896,482 A 4/1999 Blee et al.
5,896,938 A 4/1999 Moeny et al.
5,902,499 A 5/1999 Richerzhagen
5,924,489 A 7/1999 Hatcher
5,929,986 A 7/1999 Slater et al.
5,986,236 A * 11/1999 Gainand et al. ..... 219/121.82
5,986,756 A 11/1999 Slater et al.
RE36,525 E 1/2000 Pringle
6,015,015 A 1/2000 Luft et al.
6,026,905 A 2/2000 Garcia-Soule
6,032,742 A 3/2000 Tomlin et al.
6,038,363 A 3/2000 Slater et al.
RE36,723 E 6/2000 Moore et al.
6,084,203 A * 7/2000 Bonigen ..... 219/121.63
6,104,022 A 8/2000 Young et al.
RE36,880 E 9/2000 Pringle
6,116,344 A 9/2000 Longbottom et al.
6,147,754 A 11/2000 Theriault et al.
6,166,546 A 12/2000 Scheihing et al.
6,173,770 B1 1/2001 Morrill
6,215,734 B1 4/2001 Moeny et al.
6,227,300 B1 5/2001 Cunningham et al.
6,250,391 B1 6/2001 Proudfoot
6,273,193 B1 8/2001 Hermann et al.
6,301,423 B1 10/2001 Olson
6,321,839 B1 11/2001 Vereecken et al.
6,325,159 B1 12/2001 Peterman et al.
6,328,343 B1 12/2001 Hosie et al.
6,352,114 B1 3/2002 Toalson et al.
6,355,928 B1 3/2002 Skinner et al.
6,356,683 B1 3/2002 Hu et al.
6,384,738 B1 5/2002 Carstensen et al.
6,386,300 B1 5/2002 Curlett et al.
6,401,825 B1 6/2002 Woodrow
6,426,479 B1 7/2002 Bischof
6,437,326 B1 8/2002 Yamate et al.
6,450,257 B1 9/2002 Douglas
6,497,290 B1 12/2002 Misselbrook et al.
6,561,289 B2 5/2003 Portman et al.
6,564,046 B1 5/2003 Chateau
6,591,046 B2 7/2003 Stottlemyer
6,615,922 B2 9/2003 Deul et al.
6,626,249 B2 9/2003 Rosa
6,644,848 B1 11/2003 Clayton et al.
6,710,720 B2 3/2004 Carstensen et al.
6,712,150 B1 3/2004 Misselbrook et al.
6,719,042 B2 4/2004 Johnson et al.

(56) References Cited

U.S. PATENT DOCUMENTS 6,725,924 B2 4/2004 Davidson et al.
6,737,605 B1 * 5/2004 Kern ..... 219/121.67
6,746,182 B2 6/2004 Munk et al.
6,747,743 B2 6/2004 Skinner et al.
6,755,262 B2 6/2004 Parker
6,808,023 B2 10/2004 Smith et al.
6,832,654 B2 12/2004 Ravensbergen et al.
6,847,034 B2 1/2005 Shah et al.
6,851,488 B2 2/2005 Batarseh
6,860,525 B2 3/2005 Parks
6,867,858 B2 3/2005 Owen et al.
6,870,128 B2 3/2005 Kobayashi et al.
6,874,361 B1 4/2005 Meltz et al.
6,880,646 B2 4/2005 Batarseh
6,885,784 B2 4/2005 Bohnert
6,888,097 B2 5/2005 Batarseh
6,888,127 B2 5/2005 Jones et al.
6,912,898 B2 7/2005 Jones et al.
6,913,079 B2 7/2005 Tubel
6,920,395 B2 7/2005 Brown
6,920,946 B2 7/2005 Oglesby
6,957,576 B2 10/2005 Skinner et al.
6,967,322 B2 11/2005 Jones et al.
6,978,832 B2 12/2005 Gardner et al.
6,994,162 B2 2/2006 Robison
7,040,746 B2 5/2006 McCain et al.
7,055,604 B2 6/2006 Jee et al.
7,055,629 B2 6/2006 Oglesby
7,072,044 B2 7/2006 Kringlebotn et al.
7,072,588 B2 7/2006 Skinner
7,086,467 B2 8/2006 Schlegelmilch et al.
7,086,484 B2 8/2006 Smith, Jr.
7,087,865 B2 8/2006 Lerner
7,126,332 B2 10/2006 Blanz et al.
7,134,488 B2 11/2006 Tudor et al.
7,147,064 B2 12/2006 Batarseh et al.
7,172,026 B2 2/2007 Misselbrook
7,195,731 B2 3/2007 Jones
7,199,869 B2 4/2007 MacDougall
7,210,343 B2 5/2007 Shammai et al.
7,212,283 B2 5/2007 Hother et
7,249,633 B2 7/2007 Ravensbergen et al.
7,264,057 B2 9/2007 Rytlewski et al.
7,270,195 B2 9/2007 MacGregor et al.
7,273,108 B2 9/2007 Misselbrook
7,334,637 B2 2/2008 Smith, Jr.
7,337,660 B2 3/2008 Ibrahim et al.
7,362,422 B2 4/2008 DiFoggio et al.
7,367,396 B2 5/2008 Springett et al.
7,395,696 B2 7/2008 Bissonnette et al.
7,395,866 B2 * 7/2008 Milberger et al. ..... 166/345
7,416,032 B2 8/2008 Moeny et al.
7,416,258 B2 8/2008 Reed et al.
7,471,831 B2 12/2008 Bearman et al.
7,487,834 B2 2/2009 Reed et al.
7,490,664 B2 2/2009 Skinner et al.
7,503,404 B2 3/2009 McDaniel et al.
7,516,802 B2 4/2009 Smith, Jr.
7,518,722 B2 4/2009 Julian et al.
7,527,108 B2 5/2009 Moeny
7,530,406 B2 5/2009 Moeny et al.
7,559,378 B2 7/2009 Moeny
7,587,111 B2 9/2009 De Monmorillon et al.
7,591,315 B2 9/2009 Dore et al.
7,600,564 B2 10/2009 Shampine et al.
7,671,983 B2 3/2010 Shammai et al.
7,779,917 B2 8/2010 Kotrla et al.
7,802,384 B2 9/2010 Kobayashi et al.
7,938,175 B2 5/2011 Skinner et al.
8,322,441 B2 * 12/2012 Fenton ..... 166/368
2002/0039465 A1 4/2002 Skinner
2002/0189806 A1 12/2002 Davidson et al.
2003/0000741 A1 1/2003 Rosa
2003/0021634 A1 1/2003 Munk et al.
2003/0053783 A1 3/2003 Shirasaki
2003/0085040 A1 5/2003 Hemphill et al.
2003/0094281 A1 5/2003 Tubel
2003/0132029 A1 7/2003 Parker
2003/0136927 A1 7/2003 Baugh
2003/0145991 A1 8/2003 Olsen
2004/0006429 A1 1/2004 Brown
2004/0016295 A1 1/2004 Skinner et al.
2004/0020643 A1 2/2004 Thomeer et al.
2004/0033017 A1 2/2004 Kringlebotn et al.
2004/0074979 A1 4/2004 McGuire
2004/0093950 A1 5/2004 Bohnert
2004/0119471 A1 6/2004 Blanz et al.
2004/0129418 A1 7/2004 Jee et al.
2004/0195003 A1 10/2004 Batarseh
2004/0206505 A1 10/2004 Batarseh
2004/0207731 A1 10/2004 Bearman et al.
2004/0211894 A1 10/2004 Hother et al.
2004/0218176 A1 11/2004 Shammal et al.
2004/0244970 A1 12/2004 Smith, Jr.
2004/0252748 A1 12/2004 Gleitman
2004/0256103 A1 12/2004 Batarseh
2005/0012244 A1 1/2005 Jones
2005/0094129 A1 5/2005 MacDougall
2005/0099618 A1 5/2005 DiFoggio et al.
2005/0201652 A1 9/2005 Ellwood, Jr.
2005/0212284 A1 9/2005 Dole
2005/0230107 A1 10/2005 McDaniel et al.
2005/0252286 A1 11/2005 Ibrahim et al.
2005/0268704 A1 12/2005 Bissonnette et al.
2005/0269132 A1 12/2005 Batarseh et al.
2005/0272512 A1 12/2005 Bissonnette et al.
2005/0272513 A1 12/2005 Bissonnette et al.
2005/0272514 A1 12/2005 Bissonnette et al.
2005/0282645 A1 12/2005 Bissonnette et al.
2006/0038997 A1 2/2006 Julian et al.
2006/0065815 A1 3/2006 Jurca
2006/0102343 A1 5/2006 Skinner et al.
2006/0118303 A1 6/2006 Schultz et al.
2006/0185843 A1 8/2006 Smith, Jr.
2006/0191684 A1 8/2006 Smith, Jr.
2006/0201682 A1 9/2006 Reynolds
2006/0204188 A1 9/2006 Clarkson et al.
2006/0231257 A1 10/2006 Reed et al.
2006/0237233 A1 10/2006 Reed et al.
2007/0125163 A1 6/2007 Dria et al.
2007/0227741 A1 10/2007 Lovell et al.
2007/0247701 A1 10/2007 Akasaka et al.
2007/0267220 A1 11/2007 Magiawala et al.
2007/0280615 A1 12/2007 de Montmorillon et al.
2008/0078081 A1 4/2008 Huff et al.
2008/0093125 A1 4/2008 Potter et al.
2008/0099701 A1 5/2008 Whitby et al.
2008/0138022 A1 6/2008 Tassone
2008/0180787 A1 7/2008 DiGiovanni et al.
2008/0245568 A1 10/2008 Jeffryes
2008/0273852 A1 11/2008 Parker et al.
2009/0050371 A1 2/2009 Moeny
2009/0133929 A1 5/2009 Rodland
2009/0205675 A1 * 8/2009 Sarkar et al. ..... 134/1
2009/0260829 A1 10/2009 Mathis
2009/0272424 A1 11/2009 Ortabasi
2009/0279835 A1 11/2009 de Montmorillon et al.
2009/0294050 A1 12/2009 Traggis et al.
2010/0000790 A1 1/2010 Moeny
2010/0001179 A1 1/2010 Kobayashi et al.
2010/0032207 A1 2/2010 Potter et al.
2010/0044102 A1 2/2010 Rinzler et al.
2010/0044103 A1 2/2010 Moxley et al.
2010/0044104 A1 2/2010 Zediker et al.
2010/0044105 A1 2/2010 Faircloth et al.
2010/0044106 A1 2/2010 Zediker et al.
2010/0051847 A1 3/2010 Mailand et al.
2010/0071794 A1 3/2010 Homan
2010/0078414 A1 4/2010 Perry et al.
2010/0089574 A1 4/2010 Wideman et al.
2010/0089576 A1 4/2010 Wideman et al.
2010/0089577 A1 4/2010 Wideman et al.
2010/0147528 A1 6/2010 Baugh
2010/0164223 A1 7/2010 Curtiss, III et al.

(56) References Cited

U.S. PATENT DOCUMENTS

| | | | | |
|---|---|---|---|---|
| 2010/0197116 | A1 | 8/2010 | Shah et al. | |
| 2010/0215326 | A1 | 8/2010 | Zediker et al. | |
| 2010/0218955 | A1 | 9/2010 | Hart | |
| 2010/0326659 | A1 | 12/2010 | Schultz et al. | |
| 2010/0326665 | A1 | 12/2010 | Redlinger et al. | |
| 2011/0030367 | A1 * | 2/2011 | Dadd | 60/526 |
| 2012/0000646 | A1 | 1/2012 | Liotta et al. | |
| 2012/0020631 | A1 | 1/2012 | Rinzler et al. | |
| 2012/0061091 | A1 | 3/2012 | Radi | |
| 2012/0067643 | A1 | 3/2012 | DeWitt et al. | |
| 2012/0068086 | A1 | 3/2012 | Dewitt et al. | |
| 2012/0074110 | A1 | 3/2012 | Zediker et al. | |
| 2012/0217015 | A1 | 8/2012 | Zediker et al. | |
| 2012/0217017 | A1 | 8/2012 | Zediker et al. | |
| 2012/0217018 | A1 | 8/2012 | Zediker et al. | |
| 2012/0248078 | A1 | 10/2012 | Zediker et al. | |
| 2012/0255774 | A1 | 10/2012 | Grubb et al. | |
| 2012/0255933 | A1 | 10/2012 | McKay et al. | |
| 2012/0261188 | A1 | 10/2012 | Zediker et al. | |
| 2012/0266803 | A1 | 10/2012 | Zediker et al. | |
| 2012/0267168 | A1 | 10/2012 | Grubb et al. | |
| 2012/0273269 | A1 | 11/2012 | Rinzler et al. | |
| 2012/0273470 | A1 | 11/2012 | Zediker et al. | |
| 2012/0275159 | A1 | 11/2012 | Fraze et al. | |
| 2013/0011102 | A1 | 1/2013 | Rinzler et al. | |

FOREIGN PATENT DOCUMENTS

| | | | |
|---|---|---|---|
| FR | 2 716 924 | A1 | 9/1995 |
| JP | 09072738 | A | 3/1997 |
| WO | WO 97/49893 | A1 | 12/1997 |
| WO | WO 98/50673 | A1 | 11/1998 |
| WO | WO 02/057805 | A2 | 7/2002 |
| WO | WO 2004/009958 | A1 | 1/2004 |
| WO | WO 2006/008155 | A1 | 1/2006 |
| WO | WO 2006/054079 | A1 | 5/2006 |
| WO | WO 2010/060177 | A1 | 6/2010 |

OTHER PUBLICATIONS

U.S. Appl. No. 12/543,986, filed Aug. 19, 2009, Moxley et al.
U.S. Appl. No. 12/544,038, filed Aug. 19, 2009, Zediker et al.
U.S. Appl. No. 12/544,094, filed Aug. 19, 2009, Faircloth et al.
U.S. Appl. No. 12/544,136, filed Aug. 19, 2009, Zediker et al.
U.S. Appl. No. 12/706,576, filed Feb. 16, 2010, Zediker et al.
U.S. Appl. No. 12/840,978, filed Jul. 21, 2010, Rinzler et al.
U.S. Appl. No. 12/896,021, Oct. 1, 2010, Underwood et al.
U.S. Appl. No. 13/034,017, filed Feb. 24, 2011, Zediker et al.
U.S. Appl. No. 13/034,037, filed Feb. 24, 2011, Zediker et al.
U.S. Appl. No. 13/034,175, filed Feb. 24, 2011, Zediker et al.
U.S. Appl. No. 13/210,581, filed Aug. 16, 2011, DeWitt et al.
U.S. Appl. No. 13/211,729, filed Aug. 17, 2011, DeWitt et al.
U.S. Appl. No. 13/222,931, filed Aug. 31, 2011, Zediker et al.
U.S. Appl. No. 13/347,445, filed Jan. 10, 2012, Zediker et al.
U.S. Appl. No. 13/366,882, filed Feb. 6, 2012, McKay et al.
U.S. Appl. No. 13/403,132, filed Feb. 23, 2012, Zediker et al.
U.S. Appl. No. 13/403,287, filed Feb. 23, 2012, Grubb et al.
U.S. Appl. No. 13/403,509, filed Feb. 23, 2012, Fraze et al.
U.S. Appl. No. 13/403,615, filed Feb. 23, 2012, Grubb et al.
U.S. Appl. No. 13/403,692, filed Feb. 23, 2012, Zediker et al.
U.S. Appl. No. 13/403,723, filed Feb. 23, 2012, Rinzler et al.
U.S. Appl. No. 13/403,741, filed Feb. 23, 2012, Zediker et al.
U.S. Appl. No. 13/486,795, filed Jun. 1, 2012, Rinzler et al.
U.S. Appl. No. 13/565,345, filed Aug. 2, 2012, Zediker et al.
Related utility application assigned U.S. Appl. No. 13/565,345, filed Aug. 2, 2012, 112 pages.
International Search Report for PCT Application No. PCT/US09/54295, dated Apr. 26, 2010, 16 pgs.
International Search Report and Written Opinion for PCT App. No. PCT/US10/24368, dated Nov. 2, 2010, 16 pgs.
International Search Report for PCT Application No. PCT/US2012/026471, dated May 30, 2012, 13 pgs.
International Search Report for PCT Application No. PCT/US2012/026494, dated May 31, 2012, 12 pgs.
International Search Report for PCT Application No. PCT/US2012/026525, dated May 31, 2012, 8 pgs.
International Search Report for PCT Application No. PCT/US2012/026526, dated May 31, 2012, 10 pgs.
Agrawal Dinesh et al., Report on "Development of Advanced Drill Components for BHA Using Mircowave Technology Incorporating Carbide Diamond Composites and Functionally Graded Materials", believed to be published by Microwave Processing and Engineering Center, Material Research Institute, The Pennsylvania State University, 2003, 10 pgs.
Agrawal Dinesh et al., Report on "Graded Steel-Tungsten Cardide/Cobalt-Diamond Systems Using Microwave Heating", *Proceedings of the 2002 International Conference on Functionally Graded Materials*, 2002, pp. 50-58.
Agrawal Dinesh et al., "Microstructure Examination by TEM of WC/Co composites Prepared by Conventional and Microwave Processes", *15th International Plansee Seminar*, vol. 2, , 2001, pp. 677-684.
Agrawal, Govind P., "Nonlinear Fiber Optics", Chap. 9, Fourth Edition, believed to be published by Academic Press copyright 2007, pp. 334-337.
Ai, H.A. et al., "Simulation of dynamic response of granite: A numerical approach of shock-induced damage beneath impact craters", *International Journal of Impact Engineering*, vol. 33, 2006, pp. 1-10.
Anton, Richard J. et al., "Dynamic Vickers indentation of brittle materials", *Wear*, vol. 239, 2000, pp. 27-35.
Ashby, M. F. et al., "The Failure of Brittle Solids Containing Small Cracks Under Compressive Stress States", *Acta Metall.*, vol. 34, No. 3,1986, pp. 497-510.
Aydin, A. et al., "The Schmidt hammer in rock material characterization", *Engineering Geology*, vol. 81, 2005, pp. 1-14.
Baflon, Jean-Paul et al., "On the Relationship Between the Parameters of Paris' Law for Fatigue Crack Growth in Aluminium Alloys", *Scripta Metallurgica*, vol. 11, No. 12, 1977, pp. 1101-1106.
Bailo, El Tahir et al., "Spectral signatures and optic coefficients of surface and reservoir shales and limestones at COIL, $CO_2$ and Nd:YAG laser wavelengths", believed to be published by *Petroleum Engineering Department, Colorado School of Mines*, 2004, 13 pgs.
Baird, J. A. "GEODYN: A Geological Formation/Drillstring Dynamics Computer Program", *Society of Petroleum Engineers of AIME*, 1964, 9 pgs.
Baird, Jerold et al., Phase 1 Theoretical Description, A Geological Formation Drill String Dynamic Interaction Finite Element Program (GEODYN), *Sandia National Laboratories*, Report No. Sand-84-7101, 1984, 196 pgs.
Batarseh, S. et al. "Well Perforation Using High-Power Lasers", *Society of Petroleum Engineers*, SPE 84418, 2003, pp. 1-10.
Author Unknown, "Geothermal Completion Technology Life-Cycle Cost Model (GEOCOM)", believed to be published by BDM Corporation, *Sandia National Laboratories*, for the U.S. Dept. of Energy, vols. 1 and 2, 1982, 222 pgs.
Beste, U. et al., "Micro-scratch evaluation of rock types-a means to comprehend rock drill wear", *Tribology International*, vol. 37, 2004, pp. 203-210.
Blackwell, B. F., "Temperature Profile in Semi-infinite Body With Exponential Source and Convective Boundary Condition", *Journal of Heat Transfer, Transactions of the ASME*, vol. 112, 1990, pp. 567-571.
Britz, Dieter, "Digital Simulation in Electrochemistry", *Lect. Notes Phys.*, vol. 666, 2005, pp. 103-117.
Browning, J. A. et al., "Recent Advances in Flame Jet Working of Minerals", *7th Symposium on Rock Mechanics*, 1965, pp. 281-313.
Cardenas, R., "Protected Polycrystalline Diamond Compact Bits for Hard Rock Drilling", Report No. DOE-99049-1381, believed to be published by U.S. Department of Energy, 2000, pp. 1-79.
Carstens, Jeffrey et al., "Heat-Assisted Tunnel Boring Machines", *Federal Railroad Administration and Urban Mass Transportation Administration*, believed to be published by U.S. Dept. of Transportation, Report No. FRA-RT-71-63, 1970, 340 pgs.

(56) References Cited

OTHER PUBLICATIONS

Clegg, John et al., "Improved Optimisation of Bit Selection Using Mathematically Modelled Bit-Performance Indices", *IADC/SPE International 102287*, 2006, pp. 1-10.
Close, F. et al., "Successful Drilling of Basalt in a West of Shetland Deepwater Discovery", *SPE International 96575*, Society of Petroleum Engineers, 2006, pp. 1-10.
Cobern, Martin E., "Downhole Vibration Monitoring & Control System Quarterly Technical Report #1", *APS Technology, Inc.*, Quarterly Technical Report #1, DVMCS, 2003, pp. 1-15.
Cogotsi, G. A. et al., "Use of Nondestructive Testing Methods in Evaluation of Thermal Damage for Ceramics Under Conditions of Nonstationary Thermal Effects", *Institute of Strength Problems, Academy of Sciences of the Ukrainian SSR*, 1985, pp. 52-56.
Cook, Troy, "Chapter 23, Calculation of Estimated Ultimate Recovery (EUR) for Wells in Continuous-Type Oil and Gas Accumulations", *U.S. Geological Survey Digital Data Series DDS-69-D*, Denver, Colorado: Version 1, 2005, pp. 1-9.
Dahl, Filip et al., "Development of a new direct test method for estimating cutter life, based on the Sievers J miniature drill test", *Tunnelling and Underground Space Technology*, vol. 22, 2007, pp. 106-116.
Damzen, M. J. et al., "Stimulated Brillion Scattering", Chapter 8—SBS in Optical Fibres, OP Publishing Ltd, Published by Institute of Physics, London, England, 2003, pp. 137-153.
Das, A. C. et al., "Acousto-ultrasonic study of thermal shock damage in castable refractory", *Journal of Materials Science Letters*, vol. 10, 1991, pp. 173-175.
De Guire, Mark R., "Thermal Expansion Coefficient (start)", *EMSE 201—Introduction to Materials Science & Engineering*, 2003, pp. 15.1-15.15.
Dinçer, Ismail et al., "Correlation between Schmidt hardness, uniaxial compressive strength and Young's modulus for andesites, basalts and tuffs", *Bull Eng Geol Env*, vol. 63, 2004, pp. 141-148.
Dunn, James C., "Geothermal Technology Development at Sandia", believed to be published by *Geothermal Research Division, Sandia National Laboratories*, 1987, pp. 1-6.
Eichler, H.J. et al., "Stimulated Brillouin Scattering in Multimode Fibers for Optical Phase Conjugation", *Optics Communications*, vol. 208, 2002, pp. 427-431.
Eighmy, T. T. et al., "Microfracture Surface Charaterizations: Implications for in Situ Remedial Methods in Fractured Rock", believed to be published by *U.S. Environmental Protection Agency*, EPA/600/R-05/121, 2006, pp. 1-99.
Elsayed, M.A. et al., "Measurement and analysis of Chatter in a Compliant Model of a Drillstring Equipped With a PDC Bit", *Mechanical Engineering Dept.*, believed to be published by *University of Southwestern Louisiana and Sandia National Laboratories*, 2000, pp. 1-10.
Ferro, D. et al., "Vickers and Knoop hardness of electron beam deposited ZrC and HfC thin films on titanium", *Surface & Coatings Technology*, vol. 200, 2006, pp. 4701-4707.
Figueroa, H. et al., "Rock removal using high power lasers for petroleum exploitation purposes", believed to be published by *Gas Technology Institute, Colorado School of Mines, Halliburton Energy Services, Argonne National Laboratory*, 2002, pp. 1-13.
Finger, John T. et al., "PDC Bit Research at Sandia National Laboratories", believed to be published by *Sandia National Laboratories*, SAND89-0079-UC-253, 1989, pp. 1-88.
Gahan, Brian C. et al. "Analysis of Efficient High-Power Fiber Lasers for Well Perforation", *Society of Petroleum Engineers*, SPE 90661, 2004, pp. 1-9.
Gahan, Brian C. et al. "Effect of Downhole Pressure Conditions on High-Power Laser Perforation", *Society of Petroleum Engineers*, SPE 97093, 2005, pp. 1-7.
Gahan, B. C. et al., "Laser Drilling: Determination of Energy Required to Remove Rock", *Society of Petroleum Engineers* International, SPE 71466, 2001, pp. 1-11.
Gahan, Brian C. et al., "Laser Drilling: Drilling with the Power of Light, Phase 1: Feasibility Study", *Topical Report*, Cooperative Agreement No. DE-FC26-00NT40917, 2000-2001, pp. 1-148.
Glowka, David A., "Design Considerations for a Hard-Rock PDC Drill Bit", believed to be published by *Sandia National Laboratories*, SAND-85-0666C, DE85 008313, 1985, pp. 1-23.
Glowka, David A., "Development of a Method for Predicting the Performance and Wear of PDC Drill Bits", believed to be published by *Sandia National Laboratories*, SAND86-1745-UC-66c, 1987, pp. 1-206.
Glowka, David A. et al., "Program Plan for the Development of Advanced Synthetic-Diamond Drill Bits for Hard-Rock Drilling", believed to be published by *Sandia National Laboratories*, SAND 93-1953, 1993, pp. 1-50.
Glowka, David A. et al., "Progress in the Advanced Synthetic-Diamond Drill Bit Program", believed to be publised by *Sandia National Laboratories*. SAND95-2617C, 1994, pp. 1-9.
Glowka, David A., "The Use of Single-Cutter Data in the Analysis of PDC Bit Designs", *61st Annual Technical Conference and Exhibition of Society of Petroleum Engineers*, 1986, pp. 1-37.
Graves, Ramona M. et al., "Application of High Power Laser Technology to Laser/Rock Destruction: Where Have We Been? Where Are We Now?", *SW AAPG Convention*, 2002, pp. 213-224.
Graves, Ramona M. et al., "Laser Parameters That Effect Laser-Rock Interaction: Determining the Benefits of Applying Star Wars Laser Technology for Drilling and Completing Oil and Natural Gas Wells", Topical Report, believed to be published by *Petroleum Engineering Department, Colorado School of Mines*, 2001, pp. 1-157.
Gurarie, V. N., "Stress resistance parameters of brittle solids under laser/plasma pulse heating", *Materials Science and Engineering*, vol. A288, 2000, pp. 168-172.
Habib, P. et al., "The Influence of Residual Stresses on Rock Hardness", *Rock Mechanics*, vol. 6, 1974, pp. 15-24.
Hall, Kevin, "The role of thermal stress fatigue in the breakdown of rock in cold regions", *Geomorphology*, vol. 31, 1999, pp. 47-63.
Han, Wei, "Computational and experimental investigations of laser drilling and welding for microelectronic packaging", *Dorchester Polytechnic Institute*, A Dissertation submitted in May 2004, pp. 1-242.
Hareland, G. et al., "Cutting Efficiency of a Single PDC Cutter on Hard Rock", *Journal of Canadian Petroleum Technology*, vol. 48, No. 6, 2009, pp. 1-6.
Hashida, T. et al., "Numerical simulation with experimental verification of the fracture behavior in granite under confining pressures based on the tension-softening model", *International Journal of Fracture*, vol. 59, 1993, pp. 227-244.
Healy, Thomas E., "Fatigue Crack Growth in Lithium Hydride", believed to be published by *Lawrence Livermore National Laboratory*, 1993, pp. 1-32.
Hettema, M. H. H. et al., "The Influence of Steam Pressure on Thermal Spelling of Sedimentary Rock: Theory and Experiments", *Int. J. Rock Mech. Min. Sci.*, vol. 35, No. 1, 1998, pp. 3-15.
Hibbs, Louis E. et al., "Wear Mechanisms for Polycrystalline-Diamond Compacts as Utilized for Drilling in Geothermal Environments", believed to be published by *Sandia National Laboratories*, for the United States Government, Report No. SAND-82-7213, 1983, 287 pgs.
Hoek, E., "Fracture of Anisotropic Rock", *Journal of the South African Institute of Mining and Metallurgy*, vol. 64, No. 10, 1964, pp. 501-523.
Hoover, Ed R. et al., "Failure Mechanisms of Polycrystalline-Diamond Compact Drill Bits in Geothermal Environments", Sandia Report, believed to be published by *Sandia National Laboratories*, SAND81-1404, 1981, pp. 1-35.
Huff, C. F. et al., "Recent Developments in Polycrystalline Diamond-Drill-Bit Design", believed to be published by *Sandia National Laboratories*, 1980, pp. 1-29.
Jimeno, Carlos Lopez et al., Drilling and Blasting of Rocks, *a. a. Balkema* Publishers, 1995, 30 pgs.
Kahraman, S. et al., "Dominant rock properties affecting the penetration rate of percussive drills", *International Journal of Rock Mechanics and Mining Sciences*, 2003, vol. 40, pp. 711-723.

(56) References Cited

OTHER PUBLICATIONS

Kelsey, James R., "Drilling Technology/GDO", believed to be published by *Sandia National Laboratories*, SAND-85-1866c, DE85 017231, 1985, pp. 1-7.
Kerr, Callin Joe, "PDC Drill Bit Design and Field Application Evolution", *Journal of Petroleum Technology*, 1988, pp. 327-332.
Ketata, C. et al., "Knowledge Selection for Laser Drilling in the Oil and Gas Industry",*Computer Society*, 2005, pp. 1-6.
Khan, Ovais U. et al., "Laser heating of sheet metal and thermal stress development", *Journal of Materials Processing Technology*, vol. 155-156, 2004, pp. 2045-2050.
Kim, K. R. et al., "$CO_2$ laser-plume interaction in materials processing", *Journal of Applied Physics*, vol. 89, No. 1, 2001, pp. 681-688.
Klotz, K. et al., "Coatings with intrinsic stress profile: Refined creep analysis of (Ti,A1)N and cracking due to cyclic laser heating", *Thin Solid Films*, vol. 496, 2006, pp. 469-474.
Kobayashi, Toshio et al., "Drilling a 2-inch in Diameter Hole in Granites Submerged in Water by $CO_2$ Lasers", *SPE International, IADC 119914 Drilling Conference and Exhibition*, 2009, pp. 1-11.
Kubacki, Emily et al., "Optics for Fiber Laser Applications", believed to be published by *CVI Laser, LLC*, Technical Reference Document #20050415, 2005, 5 pgs.
Kujawski, Daniel, "A fatigue crack driving force parameter with load ratio effects", *International Journal of Fatigue*, vol. 23, 2001, pp. S239-S246.
Labuz, J. F. et al., "Microrack-dependent fracture of damaged rock", *International Journal of Fracture*, vol. 51, 1991, pp. 231-240.
Lacy, Lewis L., "Dynamic Rock Mechanics Testing for Optimized Fracture Designs", *Society of Petroleum Engineers International, Annual Technical Conference and Exhibition*, 1997, pp. 23-36.
Lally, Evan M., "A Narrow-Linewidth Laser at 1550 nm Using the Pound-Drever-Hall Stabilization Technique", *Thesis*, submitted to Virginia Polytechnic Institute and State University, Blacksburg, Virginia, 2006, 92 pgs.
Lau, John H., "Thermal Fatigue Life Prediction of Flip Chip Solder Joints by Fracture Mechanics Method", *Engineering Fracture Mechanics*, vol. 45, No. 5, 1993, pp. 643-654.
Leong, K. H. et al., "Lasers and Beam Delivery for Rock Drilling", believed to be published by *Argonne National Laboratory*, ANL/TD/TM03-01, 2003, pp. 1-35.
Leung, M. et al., "Theoretical study of heat transfer with moving phase-change interface in thawing of frozen food", *Journal of Physics D: Applied Physics*, vol. 38, 2005, pp. 477-482.
Lima, R. S. et al., "Elastic Modulus Measurements via Laser-Ultrasonic and Knoop Indentation Techniques in Thermally Sprayed Coatings", *Journal of Thermal Spray Technology*, vol. 14(1), 2005, pp. 52-60.
Lin, Y. T., "The Impact of Bit Performance on Geothermal-Well Cost", believed to be published by *Sandia National Laboratories*, SAND-81-1470C, 1981, pp. 1-6.
Lomov, I. N. et al., "Explosion in the Granite Field: Hardening and Softening Behavior in Rocks", believed to be published by *Lawrence Livermore National Laboratory*, 2001, pp. 1-7.
Long, S. G. et al., "Thermal fatigue of particle reinforced metal-matrix composite induced by laser heating and mechanical load", *Composites Science and Technology*, vol. 65, 2005, pp. 1391-1400.
Lyons, K. David et al., "NETL Extreme Drilling Laboratory Studies High Pressure High Temperature Drilling Phenomena", believed to be published by *National Energy Technology Laboratory*, 2007, pp. 1-6.
McElhenny, John E. et al., "Unique Characteristic Features of Stimulated Brillouin Scattering in Small-Core Photonic Crystal Fibers", *J. Opt. Soc. Am. B*, vol. 25, No. 4, 2008, pp. 582-593.
Marshall, David B. et al., "Indentation of Brittle Materials", *Microindentation Techniques in Materials Science and Engineering, ASTM STP 889; American Society for Testing and Materials*, 1986, pp. 26-46.
Maurer, William C., "Advanced Drilling Techniques", published by Petroleum Publishing Co., copyright 1980, 26 pgs.
Maurer, William C., "Novel Drilling Techniques", published by Pergamon Press, UK, copyright 1968, pp. 1-64.
Mazerov, Katie, "Bigger coil sizes, hybrid rigs, rotary steerable advances push coiled tubing drilling to next level", *Drilling Contractor*, 2008, pp. 54-60.
Medvedev, I. F. et al., "Optimum Force Characteristics of Rotary-Percussive Machines for Drilling Blast Holes", Moscow, Translated from *Fiziko-Tekhnicheskie Problemy Razrabotki Poleznykh Iskopaemykh*, No. 1, 1967, pp. 77-80.
Mensa-Wilmot, Graham et al., "Advanced Cutting Structure Improves PDC Bit Performance in Hard and Abrasive Drilling Environments", *Society of Petroleum Engineers International*, 2003, pp. 1-13.
Messaoud, Louafi, "Influence of Fluids on the Essential Parameters of Rotary Percussive Drilling", *Laboratoire d'Environnement (Tébessa)*, vol. 14, 2009, pp. 1-8.
Mocofanescu, A. et al., "SBS threshold for single mode and multimode GRIN fibers in an all fiber configuration", *Optics Express*, vol. 13, No. 6, 2005, pp. 2019-2024.
Moradian, Z. A. et al., "Predicting the Uniaxial Compressive Strength and Static Young's Modulus of Intact Sedimentary Rocks Using the Ultrasonic Test", *International Journal of Geomechanics*, vol. 9, No. 1, 2009, pp. 14-19.
Muto, Shigeki et al., "Laser cutting for thick concrete by multi-pass technique", *Chinese Optics Letters*, vol. 5 Supplement, 2007, pp. S39-S41.
Naqavi, I. Z. et al., "Laser heating of multilayer assembly and stress levels: elasto-plastic consideration", *Heat and Mass Transfer*, vol. 40, 2003, pp. 25-32.
Nara, Y. et al., "Sub-critical crack growth in anisotropic rock", *International Journal of Rock Mechanics and Mining Sciences*, vol. 43, 2006, pp. 437-453.
Nemat-Nasser, S. et al., "Compression-Induced Nonplanar Crack Extension With Application to Splitting, Exfoliation, and Rockburst", *Journal of Geophysical Research*, vol. 87, No. B8, 1982, pp. 6805-6821.
O'Hare, Jim et al., "Design Index: A Systematic Method of PDC Drill-Bit Selection", *Society of Petroleum Engineers International*, IADC/SPE Drilling Conference, 2000, pp. 1-15.
Okon, P. et al., "Laser Welding of Aluminium Alloy 5083", *21st International Congress on Applications of Lasers and Electro-Optics*, 2002, pp. 1-9.
Ortega, Alfonso et al., "Frictional Heating and Convective Cooling of Polycrystalline Diamond Drag Tools During Rock Cutting", Report No. SAND 82-0675c, believed to be published by *Sandia National Laboratories*, 1982, 23 pgs.
Ortega, Alfonso et al., "Studies of the Frictional Heating of Polycrystalline Diamond Compact Drag Tools During Rock Cutting", believed to be published by *Sandia National Laboratories*, SAND-80-2677, 1982, pp. 1-151.
Ortiz, Blas et al., Improved Bit Stability Reduces Downhole Harmonics (Vibrations), *International Association of Drilling Contractors/Society of Petroleum Engineers Inc.*, 1996, pp. 379-389.
Palashchenko, Yuri A., "Pure Rolling of Bit Cones Doubles Performance", *I & Gas Journal*, vol. 106, 2008, 8 pgs.
Pardoen, T. et al., "An extended model for void growth and Coalescence", *Journal of the Mechanics and Physics of Solids*, vol. 48, 2000, pp. 2467-2512.
Park, Un-Chul et al., "Thermal Analysis of Laser Drilling Processes", *IEEE Journal of Quantum Electronics*, 1972, vol. QK-8, No. 2, 1972, pp. 112-119.
Parker, Richard A. et al., "Laser Drilling Effects of Beam Application Methods on Improving Rock Removal", *Society of Petroleum Engineers*, SPE 84353, 2003, pp. 1-7.
Pavlina, E. J. et al., "Correlation of Yield Strength and Tensile Strength with Hardness for Steels", *Journals of Materials Engineering and Performance*, vol. 17, No. 6, 2008, pp. 888-893.
Ping, CAO et al., "Testing study of subcritical crack growth rate and fracture toughness in different rocks", *Transactions of Nonferrous Metals Society of China*, vol. 16, 2006, pp. 709-714.
Plinninger, Ralf J. et al., "Predicting Tool Wear in Drill and Blast", *Tunnels & Tunneling International Magazine*, 2002, pp. 1-5.

(56) References Cited

OTHER PUBLICATIONS

Plinninger, Dr. Ralf J. et al., "Wear Prediction in Hardrock Excavation Using the CERCHAR Abrasiveness Index (CAI)", *Eurock 2004 & 53rd Geomechanics Colloquium. Schubert (ed.)*, VGE, 2004, pp. 1-6.
Polsky, Yarom et al., "Enhanced Geothermal Systems (EGS) Well Construction Technology Evaluation Report", believed to be published by *Sandia National Laboratories*, Sandia Report, SAND2008-7866, 2008, pp. 1-108.
Pooniwala, Shahvir, "Lasers: The Next Bit", *Society of Petroleum Engineers*, No. SPE 104223, 2006, pp. 1-10.
Potyondy, D. O. et al., "A Bonded-particle model for rock", *International Journal of Rock Mechanics and Mining Sciences*, vol. 41, 2004, pp. 1329-1364.
Qixian, Luo et al., "Using compression wave ultrasonic transducers to measure the velocity of surface waves and hence determine dynamic modulus of elasticity for concrete", *Construction and Building Materials*, vol. 10, No. 4, 1996, pp. 237-242.
Radkte, Robert, "New High Strength and faster Drilling TSP Diamond Cutters", Report by *Technology International, Inc.*, DOE Award No. DE-FC26-97FT34368, 2006, 97 pgs.
Rauenzahn, R. M., "Analysis of Rock Mechanics and Gas Dynamics of Flame-Jet Thermal Spallation Drilling", believed to be published by *Massachusetts Institute of Technology*, submitted in partial fulfillment of doctorate degree, 1986, pp. 1-583.
Rauenzahn, R. M. et al., "Rock Failure Mechanisms of Flame-Jet Thermal Spallation Drilling—Theory and Experimental Testing", *Int. J. Rock Merch. Min. Sci. & Geomech. Abstr.*, vol. 26, No. 5, 1989, pp. 381-399.
Raymond, David W., "PDC Bit Testing at Sandia Reveals Influence of Chatter in Hard-Rock Drilling", *Geothermal Resources Council Monthly Bulletin*, SAND99-2655J, 1999, 7 pgs.
Rossmanith, H. P. et al., "Wave Propagation, Damage Evolution, and Dynamic Fracture Extension. Part I. Percussion Drilling", *Materials Science*, vol. 32, No. 3, 1996, pp. 350-358.
Sachpazis, C. I, M. Sc., Ph. D., "Correlating Schmidt Hardness With Compressive Strength and Young's Modulus of Carbonate Rocks", *International Association of Engineering Geology*, Bulletin, No. 42, 1990, pp. 75-83.
Sano, Osam et al., "Acoustic Emission During Slow Crack Growth", believed to be published by *Department Mining and Mineral Engineering, NII-Electronic Library Service*, 1980, pp. 381-388.
Schormair, Nik et al., "The influence of anisotropy on hard rock drilling and cutting", *The Geological Society of London, IAEG*, Paper No. 491, 2006, pp. 1-11.
Shannon, G. J. et al., "High power laser welding in hyperbaric gas and water environments", *Journal of Laser Applications*, vol. 9, 1997, pp. 129-136.
Shuja, S. Z. et al., "Laser heating of semi-infinite solid with consecutive pulses: Influence of materaial properties on temperature field", *Optics & Laser Technology*, vol. 40, 2008, pp. 472-480.
Smith, E., "Crack Propagation at a Constant Crack Tip Stress Intensity Factor", *Int. Journal of Fracture*, vol. 16, 1980, pp. R215-R218.
Solomon, A. D. et al., "Moving Boundary Problems in Phase Change Models Current Research Questions", *Engineering Physics and Mathematics Division*, ACM Signum Newsletter, vol. 20, Issue 2, 1985, pp. 8-12.
Sousa, Luis M. O. et al., "Influence of microfractures and porosity on the physico-mechanical properties and weathering of ornamental granites", *Engineering Geology*, vol. 77, 2005, pp. 153-168.
Stone, Charles M. et al., "Qualification of a Computer Program for Drill String Dynamics", believed to be published by *Sandia National Laboratories*, SAND-85-0633C, 1985, pp. 1-20.
Takarli, Mokhfi et al., "Damage in granite under heating/cooling cycles and water freeze-thaw condition", *International Journal of Rock Mechanics and Mining Sciences*, vol. 45, 2008, pp. 1164-1175.
Tanaka, K. et al., "The Generalized Relationship Between the Parameters C and *m* of Paris' Law for Fatigue Crack Growth", *Scripta Metallurgica*, vol. 15, No. 3, 1981, pp. 259-264.
Tang, C. A. et al., "Coupled analysis of flow, stress and damage (FSD) in rock failure", *International Journal of Rock Mechanics and Mining Sciences*, vol. 39, 2002, pp. 477-489.
Thorsteinsson, Hildigunnur et al., "The Impacts of Drilling and Reservoir Technology Advances on EGS Exploitation", *Proceedings, Thirty-Third Workshop on Geothermal Reservoir Engineering, Institute for Sustainable Energy, Environment, and Economy (ISEEE)*, 2008, pp. 1-14.
Author unknown, "Chapter 6—Drilling Technology and Costs, from Report for The Future of Geothermal Energy", believed to be published by the U.S. Dept. of Energy, 2005, 53 pgs.
Varnado, S. G. et al., "The Design and Use of Polycrystalline Diamond Compact Drag Bits in the Geothermal Environment", *Society of Petroleum Engineers of AIME*, SPE 8378, 1979, pp. 1-11.
Wen-gui, Cao et al., "Damage constituitive model for strain-softening rock based on normal distribution and its parameter determination", *J. Cent. South Univ. Technol.*, vol. 14, No. 5, 2007, pp. 719-724.
Wiercigroch, M., "Dynamics of ultrasonic percussive drilling of hard rocks", *Journal of Sound and Vibration*, vol. 280, 2005, pp. 739-757.
Williams, R. E. et al., "Experiments in Thermal Spallation of Various Rocks", *Transactions of the ASME*, vol. 118, 1996, pp. 2-8.
Willis, David A. et al., "Heat transfer and phase change during picosecond laser ablation of nickel", *International Journal of Heat and Mass Transfer*, vol. 45, 2002, pp. 3911-3918.
Wong, Teng-fong et al., "Microcrack statistics, Weibull distribution and micromechanical modeling of compressive failure in rock", *Mechanics of Materials*, vol. 38, 2006, pp. 664-681.
Wood, Tom, "Dual Purpose COTD™ Rigs Establish New Operational Records", believed to be published by *Treme Coil Drilling Corp., Drilling Technology Without Borders*, 2009, pp. 1-18.
Xia, K. et al., "Effects of microstructures on dynamic compression of Barre granite", *International Journal of Rock Mechanics and Mining Sciences*, vol. 45, 2008. pp. 879-887, available at: www.sciencedirect.com.
Xu, Zhiyue et al., "Laser Spallation of Rocks for Oil Well Drilling",*Proceedings of the 23rd International Congress on Applications of Lasers and Electro-Optics*, 2004, pp. 1-6.
Xu, Z et al. "Modeling of Laser Spallation Drilling of Rocks fro gas- and Oilwell Drilling", *Society of Petroleum Engineers*, SPE 95746, 2005, pp. 1-6.
Xu, Z. et al., "Specific Energy for Laser Removal of Rocks", *Proceedings of the 20th International Congress on Applications of Lasers & Electro-Optics*, 2001, pp. 1-8.
Xu, Z. et al., "Specific energy for pulsed laser rock drilling", *Journal of Laser Applications*, vol. 15, No. 1, 2003, pp. 25-30.
Yamshchikov, V. S. et al., "An Evaluation of the Microcrack Density of Rocks by Ultrasonic Velocimetric Method", believed to be published by *Moscow Mining Institute*. (*Translated from Fiziko-Tekhnicheskie Problemy Razrabotki Poleznykh Iskopaemykh*), 1985, pp. 363-366.
Yilbas, B. S. et al., "Laser short pulse heating: Influence of pulse intensity on temperature and stress fields", *Applied Surface Science*, vol. 252, 2006, pp. 8428-8437.
Yilbas, B. S. et al., "Laser treatment of aluminum surface: Analysis of thermal stress field in the irradiated región", *Journal of Materials Processing Technology*, vol. 209, 2009, pp. 77-88.
Yilbas, B. S. et al., "Nano-second laser pulse heating and assisting gas jet considerations", *International Journal of Machine Tools & Manufacture*, vol. 40, 2000, pp. 1023-1038.
Yilbas, B. S. et al., "Repetitive laser pulse heating with a convective boundary condition at the surface", *Journal of Physics D: Applied Physics*, vol. 34, 2001, pp. 222-231.
Yun, Yingwei et al., "Thermal Stress Distribution in Thick Wall Cylinder Under Thermal Shock", *Journal of Pressure Vessel Technology, Transactions of the ASME*, 2009, vol. 131, pp. 1-6.
Zeuch, D.H. et al., "Rock Breakage Mechanism Wirt A PDC Cutter", *Society of Petroleum Engineers, 60th Annual Technical Conference*, Las Vegas, Sep. 22-25, 1985, 11 pgs.
Zhai, Yue et al., "Dynamic failure analysis on granite under uniaxial impact compressive load", *Front. Archit. Civ. Eng. China*, vol. 2, No. 3, 2008, pp. 253-260.

(56) References Cited

OTHER PUBLICATIONS

Zhou, X.P., "Microcrack Interaction Brittle Rock Subjected to Uniaxial Tensile Loads", *Theoretical and Applied Fracture Mechanics* , vol. 47, 2007, pp. 68-76.
Zhou, Zehua et al., "A New Thermal-Shock-Resistance Model for Ceramics: Establishment and validation", *Materials Science and Engineering*, A 405, 2005, pp. 272-276.
Zhu, Dongming et al., "Influence of High Cycle Thermal Loads on Thermal Fatigue Behavior of Thick Thermal Barrier Coatings", believed to be published by *National Aeronautics and Space Administration, Army Research Laboratory*, Technical Report ARL-TR-1341, NASA TP-3676, 1997, pp. 1-50.
Zhu, Dongming et al., "Investigation of thermal fatigue behavior of thermal barrier coating systems", *Surface and Coatings Technology*, vol. 94-95, 1997, pp. 94-101.
Zhu, Dongming et al., "Investigation of Thermal High Cycle and Low Cycle Fatigue Mechanisms of Thick Thermal Barrier Coatings", believed to be published by *National Aeronautics and Space Administration, Lewis Research Center*, NASA/TM-1998-206633, 1998, pp. 1-31 .
Zhu, Dongming et al., "Thermophysical and Thermomechanical Properties of Thermal Barrier Coating Systems", believed to be published by *National Aeronautics and Space Administration, Glenn Research Center*, NASA/TM-2000-210237, 2000, pp. 1-22.
Author unknown, "A Built-for-Purpose Coiled Tubing Rig", believed to be published by Schulumberger Wells,No. DE-PS26-03NT15474, 2006, p. 18.
Author unknown, "Diamond-Cutter Drill Bits", believed to be published by Geothermal Energy Program, Office of Geothermal and Wind Technologies, 2000, 2 pages.
Author unknown, "Introducing the XTC200DTR Plus", believed to be published by Extreme Drilling Corporation, 2009, 10 pages.
Author unknown, "IADC Dull Grading System for Fixed Cutter Bits", believed to be published by Hughes Christensen, 1996, 14 pages.
Author unknown, "Percussion Drilling Manual Impax™ Hammer Bit", by Smith Tool, 2002, 67 pages.
Author unknown, "Simple Drilling Methods", believed to be published by WEDC Loughborough University, United Kingdom, 1995, pp. 41-44.
Author unknown, "Capital Drilling Equipment Brochure", believed to be published by GE Oil & Gas Business, 2008, 15 pages.
Chastain, T. et al., "Deep Water Drilling System", *SPE Drilling Engineering*, Aug. 1986, pp. 325-328.
Author unknown, "Drilling Systems: Reliable to the Extremes", believed to be published by GE Oil & Gas (Drilling & Production) Brochure, 2009, 15 pages.
Author unknown, "Forensic Examination of Deepwater Horizon Blowout Preventer", a DNV (Det Norske Veritas) report for US Department of the Interior, Bureau of Ocean Energy Management, Regulation, and Enforcement, Mar. 20, 2011, 200 pages.
Author unknown, "Mini Shear Study", a West Engineering Services, Inc. Case Study for U.S. Minerals Management Services, Dec. 2002, pp. 1-16.
Author unknown, "Shear Ram Blowout Preventer Forces Required", believed to be published by Barringer and Associates, Inc., 2010, 17 pages.
Author unknown, "Shear Ram Capabilities Study", a West Engineering Services Study for US Minerals Management Services, Sep. 2004, 61 pages.

* cited by examiner

SHEAR LASER MODULE AND METHOD OF RETROFITTING AND USE

BACKGROUND OF THE INVENTION

1. Field of the Invention

The present inventions relate to blowout preventers and, in particular, subsea blowout preventers used for the offshore exploration and production of hydrocarbons, such as oil and natural gas. Thus, and in particular, the present inventions relate to novel shear laser modules for subsea blowout preventer stacks and methods of retrofitting existing blowout preventer stacks with these shear laser modules and using such devices to manage and control offshore drilling activities.

As used herein, unless specified otherwise the terms "blowout preventer," "BOP," and "BOP stack" are to be given their broadest possible meaning, and include: (i) devices positioned at or near the borehole surface, e.g., the seafloor, which are used to contain or manage pressures or flows associated with a borehole; (ii) devices for containing or managing pressures or flows in a borehole that are associated with a subsea riser; (iii) devices having any number and combination of gates, valves or elastomeric packers for controlling or managing borehole pressures or flows; (iv) a subsea BOP stack, which stack could contain, for example, ram shears, pipe rams, blind rams and annular preventers; and, (v) other such similar combinations and assemblies of flow and pressure management devices to control borehole pressures, flows or both and, in particular, to control or manage emergency flow or pressure situations.

As used herein, unless specified otherwise "offshore" and "offshore drilling activities" and similar such terms are used in their broadest sense and would include drilling activities on, or in, any body of water, whether fresh or salt water, whether manmade or naturally occurring, such as for example rivers, lakes, canals, inland seas, oceans, seas, bays and gulfs, such as the Gulf of Mexico. As used herein, unless specified otherwise the term "offshore drilling rig" is to be given its broadest possible meaning and would include fixed towers, tenders, platforms, barges, jack-ups, floating platforms, drill ships, dynamically positioned drill ships, semi-submersibles and dynamically positioned semi-submersibles. As used herein, unless specified otherwise the term "seafloor" is to be given its broadest possible meaning and would include any surface of the earth that lies under, or is at the bottom of, any body of water, whether fresh or salt water, whether manmade or naturally occurring. As used herein, unless specified otherwise the terms "well" and "borehole" are to be given their broadest possible meaning and include any hole that is bored or otherwise made into the earths surface, e.g., the seafloor or sea bed, and would further include exploratory, production, abandoned, reentered, reworked, and injection wells. As used herein the term "riser" is to be given its broadest possible meaning and would include any tubular that connects a platform at, on or above the surface of a body of water, including an offshore drilling rig, a floating production storage and offloading ("FPSO") vessel, and a floating gas storage and offloading ("FGSO") vessel, to a structure at, on, or near the seafloor for the purposes of activities such as drilling, production, workover, service, well service, intervention and completion.

As used herein the term "drill pipe" is to be given its broadest possible meaning and includes all forms of pipe used for drilling activities; and refers to a single section or piece of pipe. As used herein the terms "stand of drill pipe," "drill pipe stand," "stand of pipe," "stand" and similar type terms are to be given their broadest possible meaning and include two, three or four sections of drill pipe that have been connected, e.g., joined together, typically by joints having threaded connections. As used herein the terms "drill string," "string," "string of drill pipe," string of pipe" and similar type terms are to be given their broadest definition and would include a stand or stands joined together for the purpose of being employed in a borehole. Thus, a drill string could include many stands and many hundreds of sections of drill pipe.

As used herein the term "tubular" is to be given its broadest possible meaning and includes drill pipe, casing, riser, coiled tube, composite tube, production tubing, vacuum insulated tubing (VIT) and any similar structures having at least one channel therein that are, or could be used, in the drilling industry. As used herein the term "joint" is to be given its broadest possible meaning and includes all types of devices, systems, methods, structures and components used to connect tubulars together, such as for example, threaded pipe joints and bolted flanges. For drill pipe joints, the joint section typically has a thicker wall than the rest of the drill pipe. As used herein the thickness of the wall of a tubular is the thickness of the material between the internal diameter of the tubular and the external diameter of the tubular.

As used herein, unless specified otherwise "high power laser energy" means a laser beam having at least about 1 kW (kilowatt) of power. As used herein, unless specified otherwise "great distances" means at least about 500 m (meter). As used herein the term "substantial loss of power," "substantial power loss" and similar such phrases, mean a loss of power of more than about 3.0 dB/km (decibel/kilometer) for a selected wavelength. As used herein the term "substantial power transmission" means at least about 50% transmittance.

2. Discussion of Related Art

Deep Water Drilling

Offshore hydrocarbon exploration and production has been moving to deeper and deeper waters. Today drilling activities at depths of 5000 ft, 10,000 ft and even greater depths are contemplated and carried out. For example, its has been reported by RIGZONE, www.rigzone.com, that there are over 300 rigs rated for drilling in water depths greater than 1,000 ft (feet), and of those rigs there are over 190 rigs rated for drilling in water depths greater than 5,000 ft, and of those rigs over 90 of them are rated for drilling in water depths of 10,000 ft. When drilling at these deep, very-deep and ultra-deep depths the drilling equipment is subject to the extreme conditions found in the depths of the ocean, including great pressures and low temperatures at the seafloor.

Further, these deep water drilling rigs are capable of advancing boreholes that can be 10,000 ft, 20,000 ft, 30,000 ft and even deeper below the sea floor. As such, the drilling equipment, such as drill pipe, casing, risers, and the BOP are subject to substantial forces and extreme conditions. To address these forces and conditions drilling equipment, for example, drill pipe and drill strings, are designed to be stronger, more rugged, and in may cases heavier. Additionally, the metals that are used to make drill pipe and casing have become more ductile.

Typically, and by way of general illustration, in drilling a subsea well an initial borehole is made into the seabed and then subsequent and smaller diameter boreholes are drilled to extend the overall depth of the borehole. Thus, as the overall borehole gets deeper its diameter becomes smaller; resulting in what can be envisioned as a telescoping assembly of holes with the largest diameter hole being at the top of the borehole closest to the surface of the earth.

Thus, by way of example, the starting phases of a subsea drill process may be explained in general as follows. Once the drilling rig is positioned on the surface of the water over the area where drilling is to take place, an initial borehole is made by drilling a 36" hole in the earth to a depth of about 200-300 ft. below the seafloor. A 30" casing is inserted into this initial borehole. This 30" casing may also be called a conductor. The 30" conductor may or may not be cemented into place. During this drilling operation a riser is generally not used and the cuttings from the borehole, e.g., the earth and other material removed from the borehole by the drilling activity, are returned to the seafloor. Next, a 26" diameter borehole is drilled within the 30" casing, extending the depth of the borehole to about 1,000-1,500 ft. This drilling operation may also be conducted without using a riser. A 20" casing is then inserted into the 30" conductor and 26" borehole. This 20" casing is cemented into place. The 20" casing has a wellhead secured to it. (In other operations an additional smaller diameter borehole may be drilled, and a smaller diameter casing inserted into that borehole with the wellhead being secured to that smaller diameter casing.) A BOP is then secured to a riser and lowered by the riser to the sea floor; where the BOP is secured to the wellhead. From this point forward all drilling activity in the borehole takes place through the riser and the BOP.

The BOP, along with other equipment and procedures, is used to control and manage pressures and flows in a well. In general, a BOP is a stack of several mechanical devices that have a connected inner cavity extending through these devices. Tubulars are advanced from the offshore drilling rig down the riser, through the BOP cavity and into the borehole. Returns, e.g., drilling mud and cuttings, are removed from the borehole and transmitted through the BOP cavity, up the riser, and to the offshore drilling rig. The BOP stack typically has an annular preventer, which is an expandable packer that functions like a giant sphincter muscle around a tubular. Some annular preventers may also be used or capable of sealing off the cavity when a tubular is not present. When activated, this packer seals against a tubular that is in the BOP cavity, preventing material from flowing through the annulus formed between the outside diameter of the tubular and the wall of the BOP cavity. The BOP stack typically also has a pipe ram preventer and my have more than one of these. Pipe ram preventers typically are two half-circle like clamping devices that are driven against the outside diameter of a tubular that is in the BOP cavity. Pipe ram preventers can be viewed as two giant hands that clamp against the tubular and seal-off the annulus between the tubular and the BOP cavity wall. Blind ram preventers may also be contained in the BOP stack, these rams can seal the cavity when no tubulars are present.

Pipe ram preventers and annular preventers typically can only seal the annulus between a tubular in the BOP and the BOP cavity; they cannot seal-off the tubular. Thus, in emergency situations, e.g., when a "kick" (a sudden influx of gas, fluid, or pressure into the borehole) occurs, or if a potential blowout situation arises, flows from high downhole pressures can come back up through the inside of the tubular, the annulus between the tubular and the riser, and up the riser to the drilling rig. Additionally, in emergency situations, the ram and annular preventers may not be able to form a strong enough seal around the tubular to prevent flow through the annulus between the tubular and the BOP cavity. Thus, BOP stacks include a mechanical shear ram assembly. (As used herein, unless specified otherwise, the term "shear ram" would include blind shear rams, shear sealing rams, shear seal rams, shear rams, and any ram that is intended to, or capable of, cutting or shearing a tubular.) Mechanical shear rams are typically the last line of defense for emergency situations, e.g., kicks or potential blowouts. Mechanical shear rams function like giant gate valves that are supposed to quickly close across the BOP cavity to seal it. They are intended to cut through any tubular is in the BOP cavity that would potentially block the shear ram from completely sealing the BOP cavity.

BOP stacks can have many varied configurations and components, which are dependent upon the conditions and hazards that are expected during deployment and use. These components could include, for example, an annular type preventer, a rotating head, a single ram preventer with one set of rams (blind or pipe), a double ram preventer having two sets of rams, a triple ram type preventer having three sets of rams, and a spool with side outlet connections for choke and kill lines. Examples of existing configurations of these components could be: a BOP stack having a bore of 7 1/16" and from bottom to top a single ram, a spool, a single ram, a single ram and an annular preventer and having a rated working pressure of 5,000 psi; a BOP stack having a bore of 13 5/8" and from bottom to top a spool, a single ram, a single ram, a single ram and an annular preventer and having a rated working pressure of 10,000 psi; and, a BOP stack having a bore of 18 3/4" and from bottom to top, a single ram, a single ram, a single ram, a single ram, an annular preventer and an annular preventer and having a rated working pressure of 15,000 psi.

BOPs need to contain the pressures that could be present in a well, which pressures could be as great as 15,000 psi or greater. Additionally, there is a need for shear rams that are capable of quickly and reliably cutting through any tubular, including drilling collars, pipe joints, and bottom hole assemblies that might be present in the BOP when an emergency situation arises or other situation where it is desirable to cut tubulars in the BOP and seal the well. With the increasing strength, thickness and ductility of tubulars, and in particular tubulars of deep, very-deep and ultra-deep water drilling, there has been an ever increasing need for stronger, more powerful, and better shear rams. This long standing need for such shear rams, as well as, other information about the physics and engineering principles underlying existing mechanical shear rams, is set forth in: West Engineering Services, Inc., "Mini Shear Study for U.S. Minerals Management Services" (Requisition No. 2-1011-1003, December 2002); West Engineering Services, Inc., "Shear Ram Capabilities Study for U.S. Minerals Management Services" (Requisition No. 3-4025-1001, September 2004); and, Barringer & Associates Inc., "Shear Ram Blowout Preventer Forces Required" (Jun. 6, 2010, revised Aug. 8, 2010).

In an attempt to meet these ongoing and increasingly important needs, BOPs have become larger, heavier and more complicated. Thus, BOP stacks having two annular preventers, two shear rams, and six pipe rams have been suggested. These BOPs can weigh many hundreds of tons and stand 50 feet tall, or taller. The ever-increasing size and weight of BOPs presents significant problems, however, for older drilling rigs. Many of the existing offshore rigs do not have the deck space, lifting capacity, or for other reasons, the ability to handle and use these larger more complicated BOP stacks.

High Power Laser Beam Conveyance

Prior to the recent breakthroughs of co-inventor Dr. Mark Zediker and those working with him at Foro Energy, Inc., Littleton Colo., it was believed that the transmission of high power laser energy over great distances without substantial loss of power was unobtainable. Their breakthroughs in the transmission of high power laser energy, and in particular in power levels greater than 5 kW, are set forth, in part, in the novel and innovative teachings contained in US patent application publications 2010/0044106 and 2010/0215326 and in Rinzler et. al, pending U.S. patent application Ser. No. 12/840,978 titled "Optical Fiber Configurations for Transmission of Laser Energy Over Great Distances" (filed Jul. 21, 2010). The disclosures of these three US patent applications, to the extent that they refer or relate to the transmission of high power laser energy, and lasers, fibers and cable structures for accomplishing such transmissions, are incorporated herein by reference. It is to be noted that this incorporation by reference herein does not provide any right to practice or use the inventions of these applications or any patents that may issue therefrom and does not grant, or give rise to, any licenses thereunder.

The utilization and application of high power lasers to BOP and risers is set forth in U.S. patent application Ser. Nos. 13/034,175, 13/034,017 and 13/034,037, filed concurrently herewith, the entire disclosures of which are incorporated herein by reference.

SUMMARY

In drilling operations it has long been desirable to have a BOP that has the ability to quickly, reliably, and in a controlled manner sever tubulars and seal off, or otherwise manage the pressure, flow or both of a well. As the robustness of tubulars, and in particular tubulars for deep sea drilling, has increased, the need for such a BOP has continued, grown and become more important. The present invention, among other things, solves this need by providing the articles of manufacture, devices and processes taught herein.

Thus, there is provided herein a blowout preventer stack for land based operations, sea based operations, or both having a ram preventer, an annular preventer, and a shear laser module. The blowout preventer may also be configured such that its annular preventer, ram preventer, and shear laser module have a common cavity, which has a cavity axis. The blowout preventer stack's shear laser module can also have a laser cutter having a beam path that extends from the laser cutter into the common cavity and in some instances, where the beam path intersects the cavity axis.

There is also provided a shear laser module for use in a blowout preventer stack, this module has a body, the body which has a first connector and a second connector, the connectors adapted for connection to components in a blowout preventer stack, the body having a cavity for passing tubulars, line structures or both, through the cavity; and, a laser cutter in the body which laser cutter has a beam path. In this manner, the beam path may travel from the laser cutter into the cavity and to any tubular that may be in the cavity.

Still further it is provided that the shear laser module and laser cutter may have a shield located adjacent to the cavity, which shield protects the laser cutter from damage from the conditions present in the blowout preventer cavity, such as pressure, temperature, tubular or line structures moving through or rotating within the cavity, cuttings, hydrocarbons, and drilling fluids, while not appreciably interfering with the movement of tubulars and other structures or materials through the cavity.

Yet further it is provided that the ram preventer can be a shear ram and that the blowout preventer can also have a second annular preventer, a second shear ram, a first pipe ram, a second pipe ram, and a third pipe ram.

Moreover, it is provided that the blowout preventer and laser shear module can have a plurality of laser cutters, which can include a first and a second laser cutter, wherein the first laser cutter has a first beam path that extends from the first laser cutter into the cavity, wherein the second laser cutter has a second beam path that extends from the second laser cutter into the cavity. Additionally, the first, the second or both beam paths can intersect within the cavity, can be directed toward the cavity axis and can intersect the cavity axis. Further, the first and second beam paths may not intersect within the cavity and they may be substantially parallel, they may form a normal angle with a central axis of the cavity, which angle can be an obtuse angle with the axis, an acute angle with the axis, or be a right angle.

There is further provided a blowout preventer in which a second annular preventer, a second shear ram, a first pipe ram, a second pipe ram, and a third pipe ram are present.

Still further it is provided that the blowout preventer or laser shear module may have first and second laser cutters that are configured to rotate around the blowout preventer cavity upon activation, orbit at least partially around the cavity during activation, and may be positioned outside of the cavity, or adjacent to the cavity.

Yet further there is provided a shear laser module having a support cable optically associated with the laser cutter and a feed-through assembly mechanically associated with the support cable. The modules may be rated at greater than 5,000 psi operating pressure, greater than 10,000 psi operating pressure, or greater than 15,000 psi operating pressure.

There is also provided an offshore drilling rig having a laser assisted subsea blowout drilling system, for performing activities near a seafloor, the system having a riser capable of being lowered from and operably connected to an offshore drilling rig to a depth at or near the seafloor; a blowout preventer capable of being operably connected to the riser and lowered by the riser from the offshore drilling rig to the seafloor; the blowout preventer including a shear laser module and a ram preventer; the shear laser module including a laser cutter; a high power laser in optical communication with the laser cutter; and, the laser cutter being operably associated with the blowout preventer and riser, whereby the laser cutter is capable of being lowered to at or near the seafloor and upon activation delivering a high power laser beam to a tubular that is within the blowout preventer.

Yet further there is provided a method of retrofitting a pre-existing blowout preventer ("BOP") stack with a shear laser module to make a laser assisted BOP stack, the method having the following activities: evaluating a pre-existing BOP stack; determining that the pre-existing BOP stack does not meet the requirements for an intended potential use; and retrofitting the pre-existing BOP stack by adding a shear laser module to the pre-existing BOP stack; whereby the retrofitted BOP stack meets the requirements for the intended use.

Still further there is provided a method of making a laser assisted BOP stack, wherein there is obtained an annular preventer, a ram preventer, a shear laser module and assembling a BOP stack including the annular preventer, the ram preventer and the shear laser module.

Additionally, there is provided a method of drilling subsea wells by using a laser assisted blowout preventer and riser, the method including lowering a laser assisted blowout preventer from an offshore drilling rig to a seafloor using a riser, wherein the riser has an inner cavity, and wherein the laser assisted blowout preventer includes a shear laser module having an inner cavity; securing the blowout preventer to a borehole in the seafloor, by way for example to a wellhead, whereby the borehole, the shear laser module cavity and the riser cavity are in fluid and mechanical communication; and, wherein, the shear laser module has the capability to perform laser cutting of a tubular present in the laser assisted blowout preventer cavity.

Moreover there is provided a method of drilling subsea wells by using a laser assisted blowout preventer and riser, the method including lowering a laser assisted blowout preventer, the laser assisted blowout preventer including a shear laser module having an inner cavity, from an offshore drilling rig to the seafloor using a riser having an inner cavity; securing the blowout preventer to a wellhead atop a borehole, whereby the borehole, the shear laser module cavity and the riser cavity are in fluid and mechanical communication; and, advancing the borehole by lowering tubulars from the offshore drilling rig down through the riser cavity, the shear laser module cavity and into the borehole; wherein, the shear laser module has the capability to perform laser cutting of any tubular present in the laser assisted blowout preventer cavity.

Yet additionally there is provided a subsea tree having a mechanical valve and a laser cutter, wherein the mechanical valve can be a flapper valve or a ball valve. The subsea tree may further have an outer wall, configured to be placed adjacent to a BOP cavity wall; an inner wall, defining a subsea tree inner cavity; and, the inner and outer walls defining an annular area therebetween; wherein the laser cutter is contained substantially within the annulus defined by the inner and outer walls. Still further a beam path may be defined between an area adjacent to area of operation for the mechanical valve and the laser cutter.

Further, there is provided a method of performing work on a subsea well by using high power laser assisted technology, including lowering a blowout preventer having an interior cavity, from an offshore drilling rig to a seafloor; securing the blowout preventer to a borehole in the seafloor, for example by securing to a christmas tree or by removing the christmas tree and securing to a well head, whereby the borehole and the interior cavity are in fluid and mechanical communication; positioning within the blowout preventer cavity a subsea test tree having an inner cavity and including a laser cutter; and, lowering tubulars or line structures from the offshore drilling rig down through the inner cavity of the subsea test tree; wherein, the subsea test tree has the capability to perform laser cutting of any tubular or line structure present in the inner cavity of the subsea test tree. Still further a blowout preventer having a laser shear module that may be capable of cutting the subsea tree may also be used.

DESCRIPTION OF THE PREFERRED EMBODIMENTS

Figure 1:
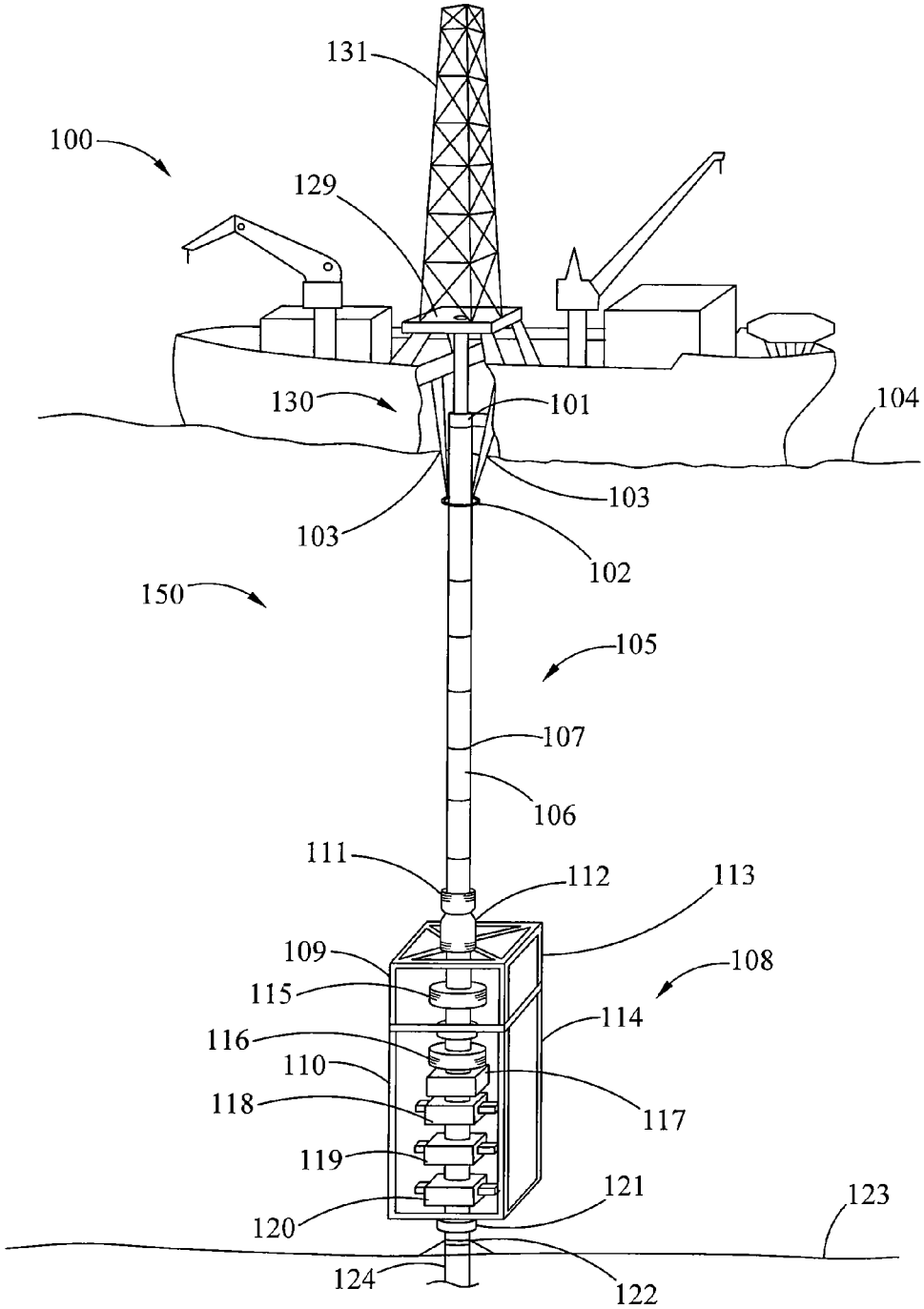
FIG. 1 is an illustration of an embodiment of a laser assisted BOP drilling system of the present invention.

In general, the present inventions relate to shear laser modules for BOP stacks and a BOP stack having high power laser beam cutters. These BOP stacks are used to manage the conditions of a well, such as pressure, flow or both. Thus, by way of example, an embodiment of a laser assisted subsea BOP drilling system is schematically shown in FIG. 1. In this embodiment of this drilling system there is provided a dynamically positioned (DP) drill ship 100 having a drill floor 129, a derrick 131, a moon pool 130 (as seen by the cutaway in the figure showing the interior of the drill ship 100) and other drilling and drilling support equipment and devices utilized for operation, which are known to the off shore drilling arts, but are not shown in the figure. This drilling system also has a laser assisted subsea riser and BOP package 150. Although a drill ship is shown in this embodiment, any other type of offshore drilling rig, vessel or platform may be utilized. The laser assisted subsea riser and BOP package 150, as shown in this figure, is deployed and connecting drill ship 100 with a borehole 124 that extends below the seafloor 123.

The laser assisted riser and BOP package 150 has a riser 105 and a laser assisted BOP stack 108. The upper portion, i.e., the portion of the riser when deployed that is closest to the surface of the water 104, of riser 105, is connected to the drillship 100 by tensioners 103 that are attached to tension ring 102. The upper section of the riser 105 may have a diverter 101 and other components (not shown in this figure) that are commonly utilized and employed with risers and are well known to those of skill in the art of offshore drilling.

The riser 105 extends from the moon pool 130 of drill ship 100 and is connected to laser assisted BOP stack 108. The riser 105 is made up of riser sections, e.g., 106, that are connected together, by riser couplings, e.g., 107, and lowered through the moon pool 130 of the drill ship 100. The lower portion, i.e., the portion of the riser that when deployed is closest to the seafloor, of the riser 105 is connected to the laser assisted BOP stack 108 by way of the riser-BOP connecter 111. The riser-BOP connecter 111 is associated with flex joint 112, which may also be referred to as a flex connection or ball joint. The flex joint 112 is intended to accommodate movements of the drill ship 100 from positions that are not directly above the laser assisted BOP stack 108; and thus accommodate the riser 105 coming into the laser assisted BOP stack 108 at an angle.

The laser assisted BOP stack may be characterized as having two component assemblies: an upper component assembly 109, which may be referred to as the lower marine riser package (LMRP), and a lower component assembly 110, which may be referred to as the lower BOP stack or the BOP proper. In this embodiment, the upper component assembly 109 has a frame 113 that houses an annular preventer 115. The lower component assembly 110 has a frame 114 that houses an annular preventer 116, a shear laser module ("SLM") 117, a first ram preventer 118, a second ram preventer 119, and a third ram preventer 120. As used herein unless specified otherwise, the term "ram preventer" is to be given its broadest definition and would include any mechanical devices that clamp, grab, hold, cut, sever, crush, or combinations thereof, a tubular within a BOP stack, such as shear rams, blind rams, blind-shear rams, pipe rams, casing shear rams, and ram blowout preventers such as Hydril's HYDRIL PRESSURE CONTROL COMPACT Ram, Hydril Pressure Control Conventional Ram, HYDRIL PRESSURE CONTROL QUICKLOG, and HYDRIL PRESSURE CONTROL SENTRY Workover, SHAFFER ram preventers, and ram preventers made by Cameron. The laser assisted BOP stack 108 has a wellhead connecter 121 that attaches to wellhead 122, which is attached to borehole 124.

The riser has an internal cavity, not shown in FIG. 1 that is in fluid and mechanical communication with an internal cavity, not shown in FIG. 1, in the laser assisted BOP stack. Thus, as deployed, the laser assisted riser and BOP package 150 provides a cavity or channel putting the drillship 100 in fluid and mechanical communication with the borehole. The laser assisted BOP stack frames 113, 114 protect the BOP, and may have lifting and handling devices, a control and connection module, and other equipment and devices utilized in subsea operation, which are known to the art, but are not shown in the figure. The internal cavity in the stack goes through the stack from its top (closest to the surface of the water 104) to its bottom (closest to the seafloor 123). This cavity, for example, could be about 18¾" in diameter and has a cavity wall.

Typically, in deep sea drilling operations a 21" riser and an 18¾" BOP are used. The term "21" riser" is generic and covers risers having an outer diameter in the general range of 21" and would include for example a riser having a 21¼" outer diameter. Wall thickness for 21" risers can range of from about ⅝" to ⅞" or greater. Risers and BOPs, however, can vary in size, type and configuration. Risers can have outer diameters ranging from about 13⅜" to about 24." BOP's can have cavities, e.g., bore diameters ranging from about 4⅙" to 26¾." Risers may be, for example, conventional pipe risers, flexible pipe risers, composite tube structures, steel cantenary risers ("SCR"), top tensioned risers, hybrid risers, and other types of risers known to those skilled in the offshore drilling arts or later developed. The use of smaller and larger diameter risers, different types and configurations of risers, BOPs having smaller and larger diameter cavities, and different types and configurations of BOPs, are contemplated; and, the teachings and inventions of this specification are not limited to, or by, the size, type or configuration of a particular riser or BOP.

During deployment the laser assisted BOP stack 108 is attached to the riser 105, lowered to the seafloor 123 and secured to a wellhead 122. The wellhead 122 is positioned and fixed to a casing (not shown), which has been cemented into a borehole 124. From this point forward, generally, all the drilling activity in the borehole takes place through the riser and the BOP. Such drilling activity would include, for example, lowering a string of drill pipe having a drill bit at its end from the drill ship 100 down the interior cavity of the riser 105, through the cavity of the laser assisted BOP stack 108 and into the borehole 124. Thus, the drill string would run from the drill ship 100 on the surface of the water 104 to the bottom of the borehole, potentially many tens of thousands of feet below the water surface 104 and seafloor 123. The drill bit would be rotated against the bottom of the borehole, while drilling mud is pumped down the interior of the drill pipe and out the drill bit. The drilling mud would carry the cuttings, e.g., borehole material removed by the rotating bit, up the annulus between the borehole wall and the outer diameter of the drill string, continuing up through the annulus between BOP cavity wall and the outer diameter of the drill string, and continuing up through the annulus between the inner diameter of the riser cavity and the outer diameter of the drill string, until the drilling mud and cuttings are directed, generally by a bell housing (not shown), or in extreme situations a diverter 101, to the drill ship 100 for handling or processing. Thus, the drilling mud is pumped from the drill ship 100 through a drill string in the riser to the bottom of the borehole and returned to the drill ship, in part, by the laser assisted riser and BOP package 150.

Figure 8:
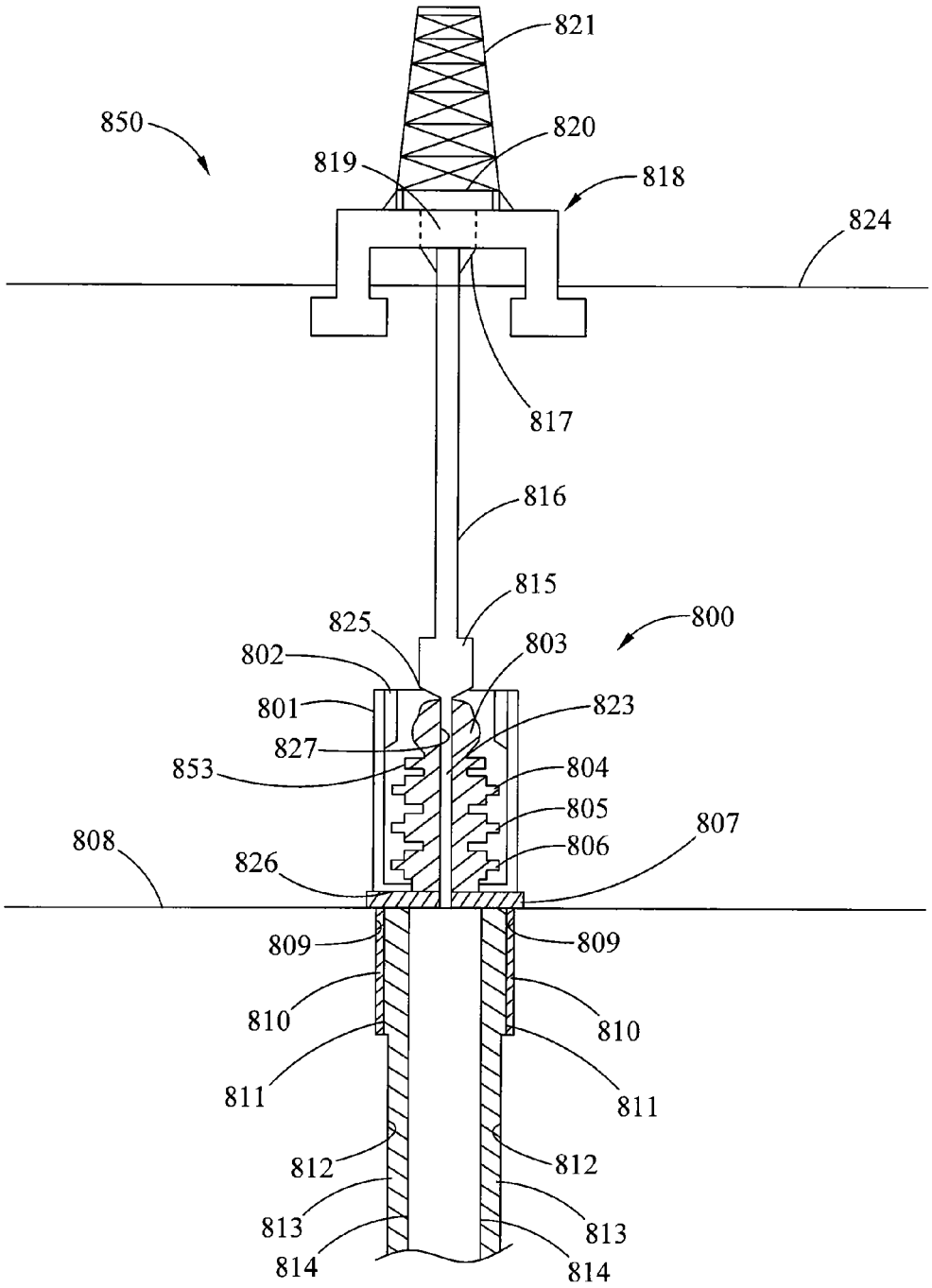
FIG. 8 is an illustration of a second embodiment of a laser assisted BOP drilling system of the present invention.

Turning now to FIG. 8 there is shown, by way of example, an embodiment of a laser assisted subsea BOP drilling system 850. In this embodiment there is provided a laser assisted BOP 800. The laser assisted BOP 800 has a frame 801, which protects the BOP, has lifting and handling devices (not shown), a control and connection module 802, and other equipment and devices utilized in subsea operation, which are known to the offshore drilling arts, but are not shown in the figure. The laser assisted BOP 800 of this example has an annular preventer 803, an SLM 853, a laser shear ram assembly 804, a first pipe ram 805 and a second pipe ram 806. This assembly of preventers and rams could also be referred to as a laser assisted BOP stack. The stack has a cavity or passage 823 going through it from its top 825 (closest to the surface of the water 824) to its bottom 826 (closest to the sea floor 808). This passage 823, for example, could be about 18¾" in diameter. The passage 823 would have a passage or cavity wall 827.

The top 825 of the laser assisted BOP 800 is secured to a riser 816 by a flex joint 815. The flex joint 815, which may also be referred to as a flex connecter or ball joint, allows the riser 816 to be at an angle with respect to the laser assisted BOP 800, and thus, accommodates some movement of the riser 816 and the drilling rig 818 on the surface of the water 824. The riser 816 is connected to the drilling rig 818 by riser tensioners 817, and other equipment known to those of skill in the offshore drilling arts, but not shown in this figure. The drilling rig 818, which in this example is shown as a semi-submersible, but could be any type of platform or device for drilling in or above water, has a moon pool 819, a drill floor 820, a derrick 821, and other drilling and drilling sport equipment and devices utilized for operation, which are known to the offshore drilling arts, but are not shown in the figure.

When deployed, as shown in FIG. 8, the laser assisted BOP 800 is attached to the riser 816, lowered to the seafloor 808 and secured to a wellhead 807. The wellhead 807 is position and fixed to a casing 814, which has been cemented, into a borehole 812 and into a larger diameter casing 811 by cement 812. The larger diameter casing 811 is cemented into a larger diameter borehole 809 by cement 810.

Thus, by way of example, casing 814 can be 20" casing and borehole 812 can be a 26" diameter borehole, casing 811 can be 30" casing and borehole 809 can be a 36" diameter borehole. From this point forward, generally, all the drilling activity in the borehole takes place through the riser and the BOP.

In FIGS. 1 and 8, the riser and BOP are configured along the lines of a drilling riser BOP package with the BOP positioned at or near the seafloor, typically attached to a wellhead, as seen in drilling activities. The present laser modules, laser cutters, laser assemblies and laser-BOP assemblies of the present inventions have applications to other types of risers, riser-BOP packages and activities, both on land and offshore. Thus, they have applications in relation to drilling, workover, servicing, testing, intervention and completing activities. They also have applications to surface BOPs, e.g., where BOP is positioned above the surface of the water and the riser extends from the BOP to the seafloor, were drilling is done in the riser, where the riser is a production riser, and other configurations known to, or later developed by the art.

Figure 2:
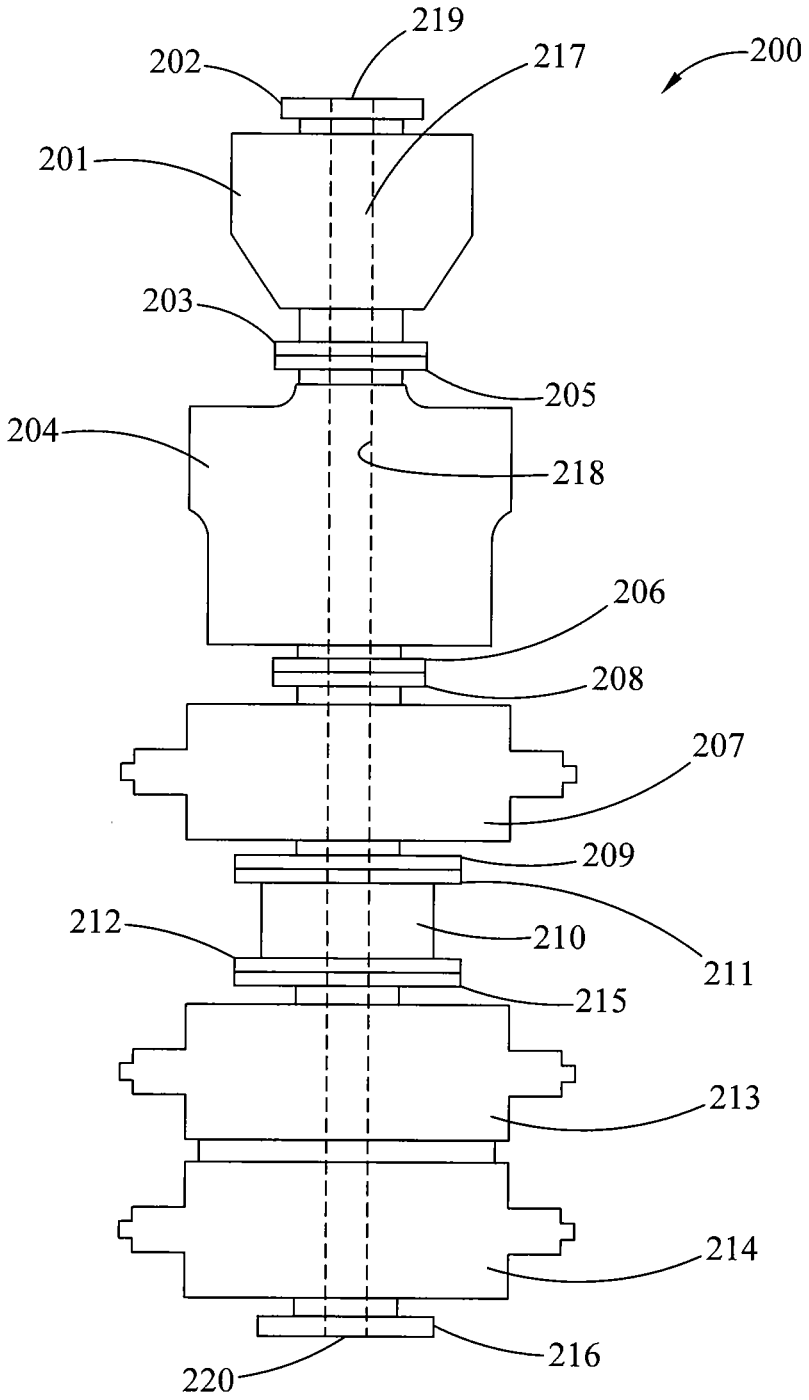
Fig. 2 (Prior Art)
FIG. 2 is a schematic view of a pre-existing BOP stack known to the art.

In FIG. 2 there is shown an example of a pre-existing BOP stack. Thus, there is shown a BOP stack 200 having, from top 219 to bottom 220, a flex joint 201 with connecters 202, 203, an annular preventer 204 with connecters 205, 206, a shear ram 207 with connecters 208, 209, a spacer 210 with connecters 211, 212, and pipe ram 213 and pipe ram 214 with connecters 215, 216. The connecters, e.g., 202, can be any type of connecter known or used by those of skill in the offshore drilling arts, such as for example a flange with bolts, that meet the pressure requirements for the BOP. Each of the components, e.g., shear ram 207, in the BOP stack 200 have an internal cavity, or bore, having a wall, which when assembled into the BOP stack forms an inner cavity 217 having a wall 218 (shown as phantom lines in the drawing).

As noted above in this specification, older BOPs, such as the pre-existing BOP stack shown in FIG. 2, have increasingly difficult times in cutting the newer and heavier tubulars that are being used for offshore drilling and, in particular, the tubulars that are used for deep, very deep and ultra deep water drilling. These shortcomings can be overcome by retrofitting these BOPs with the shear laser modules of the present invention. The shear laser modules can be inserted into a preexisting BOP stack. These modules have the capability of delivering high power laser energy to a tubular that is the BOP stack, quickly severing that tubular. The shear laser modules may be constructed so that they have a shorter, and preferably a substantially shorter, height (distance from top to bottom) than a pipe ram or a shear ram. Thus, by adding the laser shear module to the BOP stack, the stack's over all height (distance from top to bottom) will not be substantially increased. The stack height for a BOP stack with the laser shear module will also be substantially shorter than if an additional shear ram had been added to the stack. The shear laser module may also be constructed to be lighter than, and preferably substantially lighter than, a shear ram. Thus, adding the shear laser module to the stack should have a minimal effect on the overall weight of the stack; and, will have a substantially smaller effect on the overall weight of the stack than if an additional shear ram was added to the stack. The high power laser energy delivered from the shear laser module will have the ability to cut, and sever, tubulars found in the BOP at an equal to or better reliability and rate than shear rams.

Figure 3:
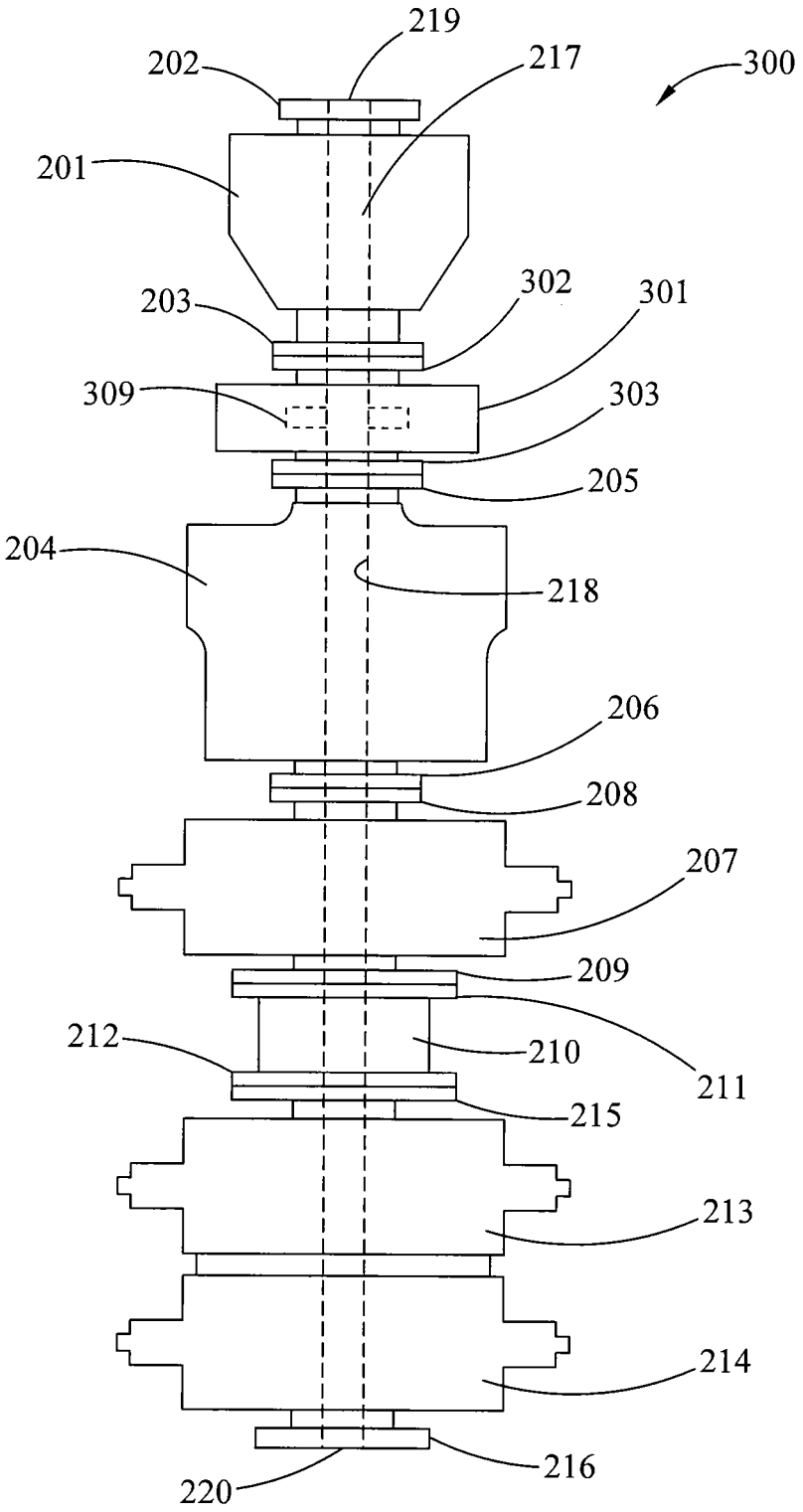
FIG. 3 is a schematic of a first embodiment of a retrofitted laser assisted BOP stack of the present invention to be used with the BOP drilling systems of FIGS. 1 and 8.

Turning to FIG. 3 there is provided an example of a retrofitted BOP stack. In FIG. 3 the pre-existing BOP stack of FIG. 2 has been retrofitted by adding a shear laser module between two of the stack's pre-existing components (the pre-existing components from FIG. 2 have the same numbers in FIG. 3). Thus, in FIG. 3 there is provided a retrofitted laser assisted BOP stack 300 having a shear laser module 301 with connecters 302, 303 and having a laser delivery assembly 309 (which is contained within the module and thus shown in phantom lines). The shear laser module having been inserted between and connected to the pre-existing flex joint 201 and the pre-existing annular preventer 204. The shear laser module connecter 302 being configured to mate with, and secure to, or be secured to, flex joint connecter 203 and the shear laser module connecter 303 being configured to mate with, and secure to, or be secured to, annular preventer connecter 205.

Figure 4:
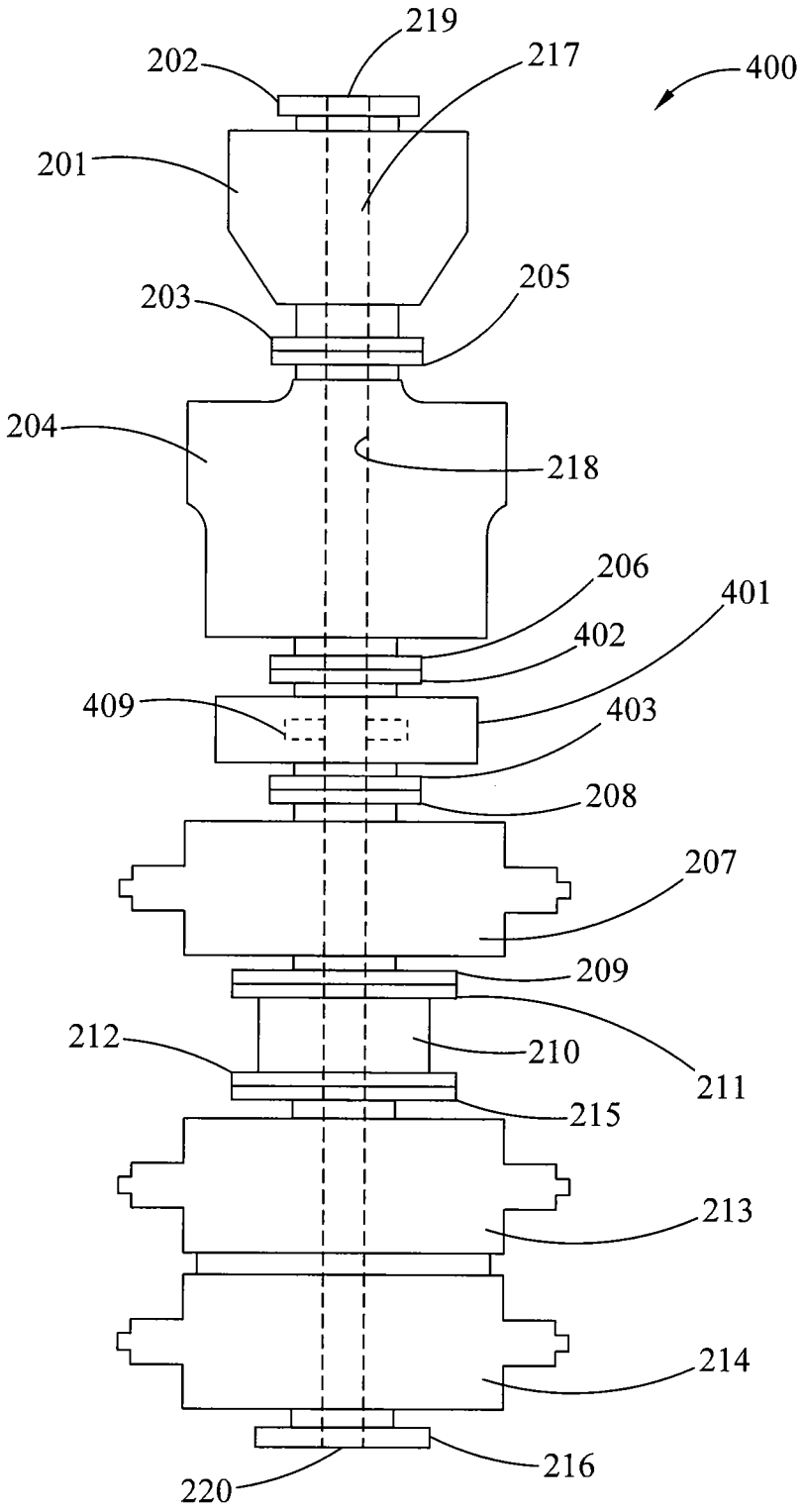
FIG. 4 is a schematic of a second embodiment of a retrofitted laser assisted BOP stack of the present invention to be used with the BOP drilling systems of FIGS. 1 and 8.

Turning to FIG. 4 there is provided an example of a retrofitted BOP stack. In FIG. 4 the pre-existing BOP stack of FIG. 2 has been retrofitted by adding a shear laser module between two of the stack's pre-existing components (the pre-existing components from FIG. 2 have the same numbers in FIG. 4). Thus, in FIG. 4 there is provided a retrofitted laser assisted BOP stack 400 having a shear laser module 401 with connecters 402, 403 and having a laser delivery assembly 409 (which is contained within the module and thus shown in phantom lines). The shear laser module having been inserted between and connected to the pre-existing annular preventer 204 and the pre-existing shear ram 207. The shear laser module connecter 402 being configured to mate with, and secure to, annular preventer connecter 206 and the shear laser module connecter 403 being configured to mate with, and secure to, or be secured to, shear ram connecter 208.

Figure 5:
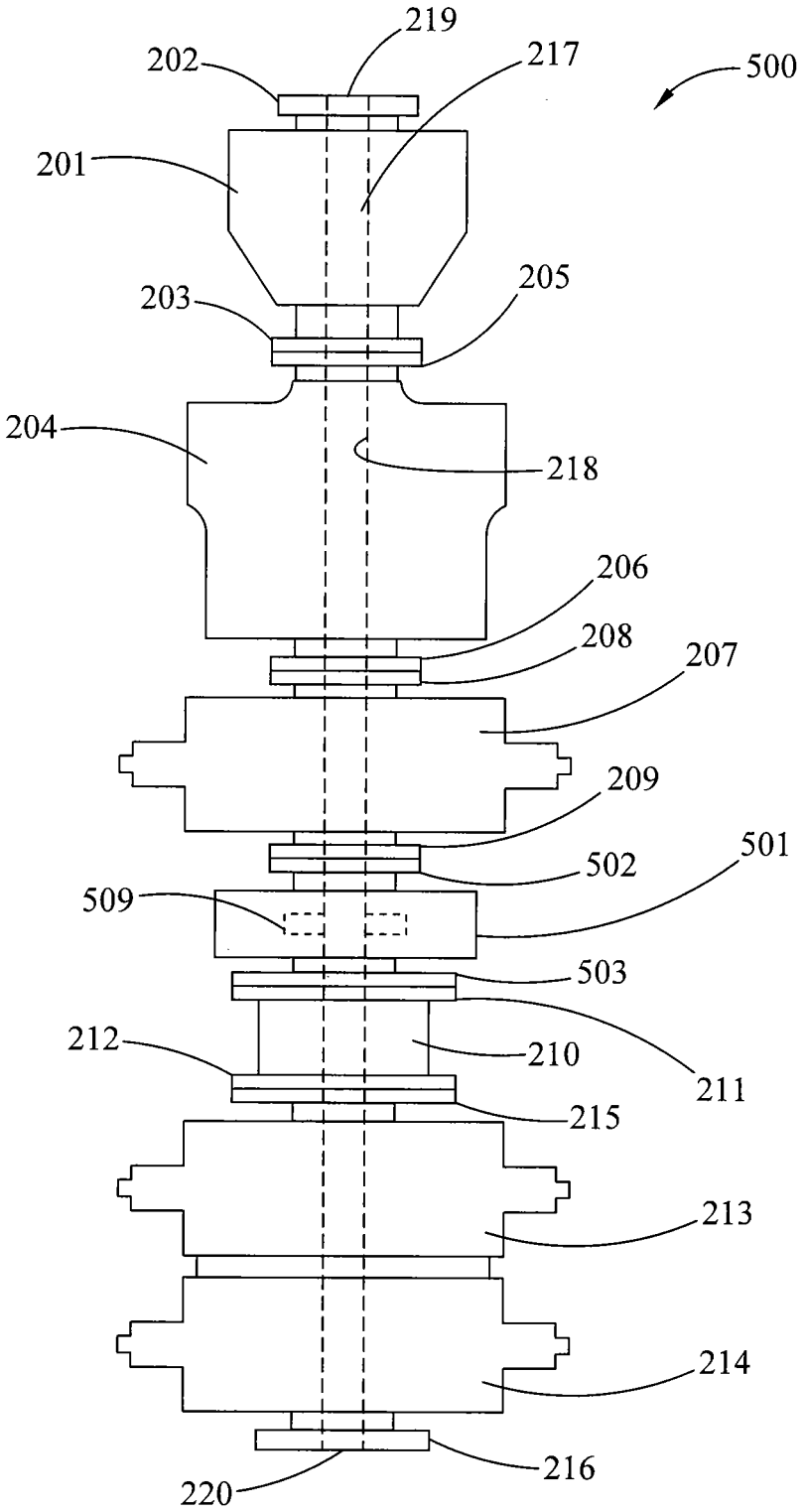
FIG. 5 is a schematic of a third embodiment of a retrofitted laser assisted BOP stack of the present invention to be used with the BOP drilling systems of FIGS. 1 and 8.

Turning to FIG. 5 there is provided an example of a retrofitted BOP stack. In FIG. 5 the pre-existing BOP stack of FIG. 2 has been retrofitted by adding a shear laser module between two of the stack's pre-existing components (the pre-existing components from FIG. 2 have the same numbers in FIG. 4). Thus, in FIG. 5 there is provided a retrofitted laser assisted BOP stack 500 having a shear laser module 501 with connecters 502, 503 and having a laser delivery assembly 509 (which is contained within the module and thus shown in phantom lines). The shear laser module having been inserted between and connected to the pre-existing shear ram 207 and the pre-existing spacer 210 and pipe ram 213 (the spacer 210 was left in the retrofitted stack 500. It could be removed if height is a limitation and its removal with the addition of the shear laser module would not otherwise adversely effect operation.) The shear laser module connecter 502 being configured to mate with, and secure to, shear ram connecter 209 and the shear laser module connecter 503 being configured to mate with, and secure to, the spacer connecter 211.

In addition to the forging examples of retrofit BOP stacks other configurations and arrangements are contemplated. For example, pre-existing ram shears may be replaced with a shear laser module or multiple shear laser modules, a combination of shear rams and shear laser modules may be added, a shear laser ram assembly may be added, multiple laser modules may be added and combinations of the forgoing may be done as part of a retrofitting process to obtain a retrofitted laser assisted BOP stack. Additionally, larger and newer BOP stacks may also obtain benefits by having a shear laser module added to the stacks components.

The present specification, however, is not limited to retrofitting of pre-existing BOPs. The specification also contemplates laser assisted BOP stacks, whether made form new, refurbished or pre-existing components or materials.

Figure 6:
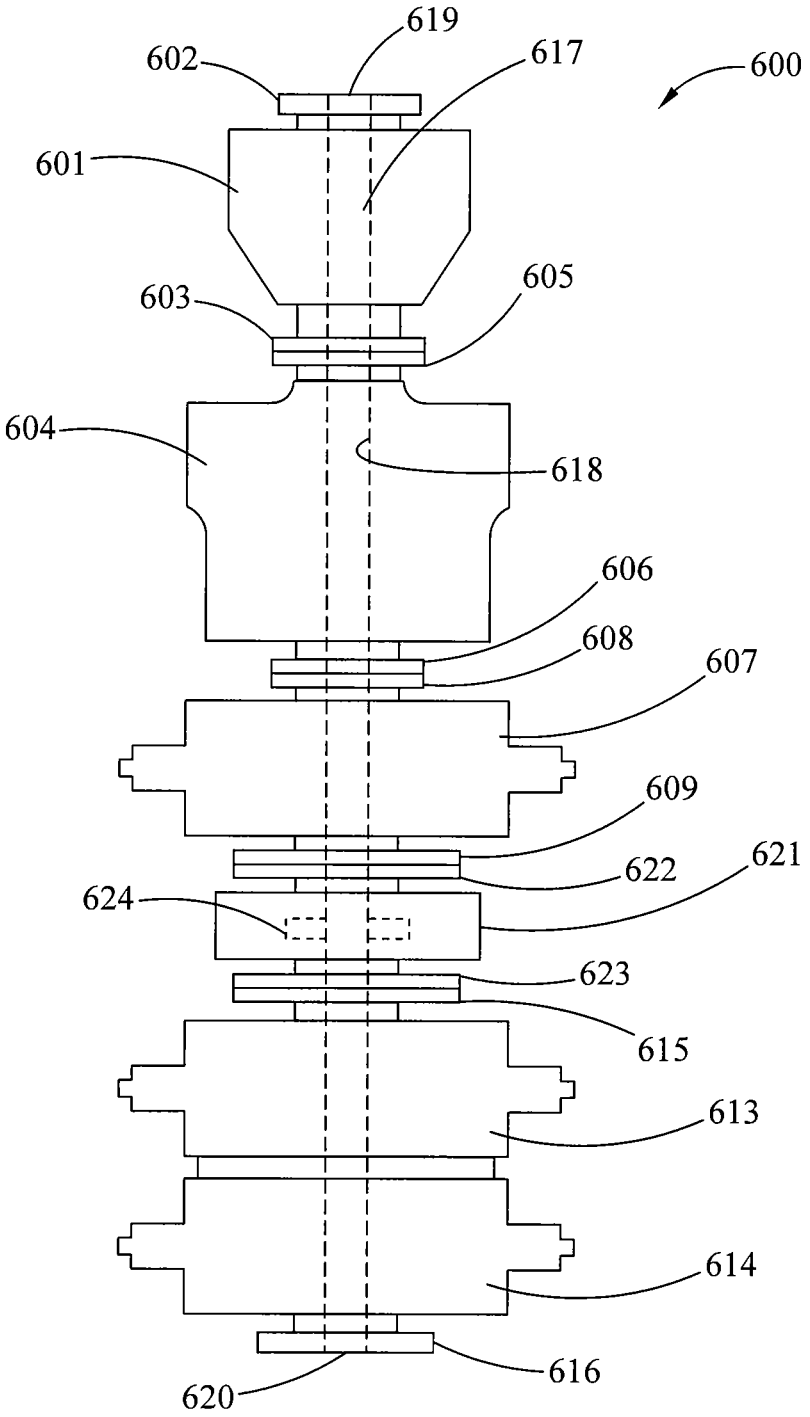
FIG. 6 is a schematic of a first embodiment of a laser assisted BOP stack of the present invention to be used with the BOP drilling systems of FIGS. 1 and 8.

Turning to FIG. 6 there is shown an example of an embodiment of a laser assisted BOP stack. Thus, there is shown a laser assisted BOP stack 600 having, from top 619 to bottom 620, a flex joint 601 with connecters 602, 603, an annular preventer 604 with connecters 605, 606, a shear ram 607 with connecters 608, 609, a shear laser assembly 621 with connecters 622, 623 (having a laser delivery assembly 624 shown in phantom lines), and pipe ram 613 and pipe ram 614 with connecters 615, 616. The connecters, e.g., 602 can be any type of connecter known or used by those of skill in the offshore drilling arts, such as for example a flange with bolts, that meet the pressure requirements for the BOP. Each of the components, e.g., shear ram 607, in the BOP stack 600 have an internal cavity, or bore, having a wall, which when assembled into the BOP stack forms an inner cavity 617 having a wall 618 (shown as in phantom lines in the drawing).

Figure 7:
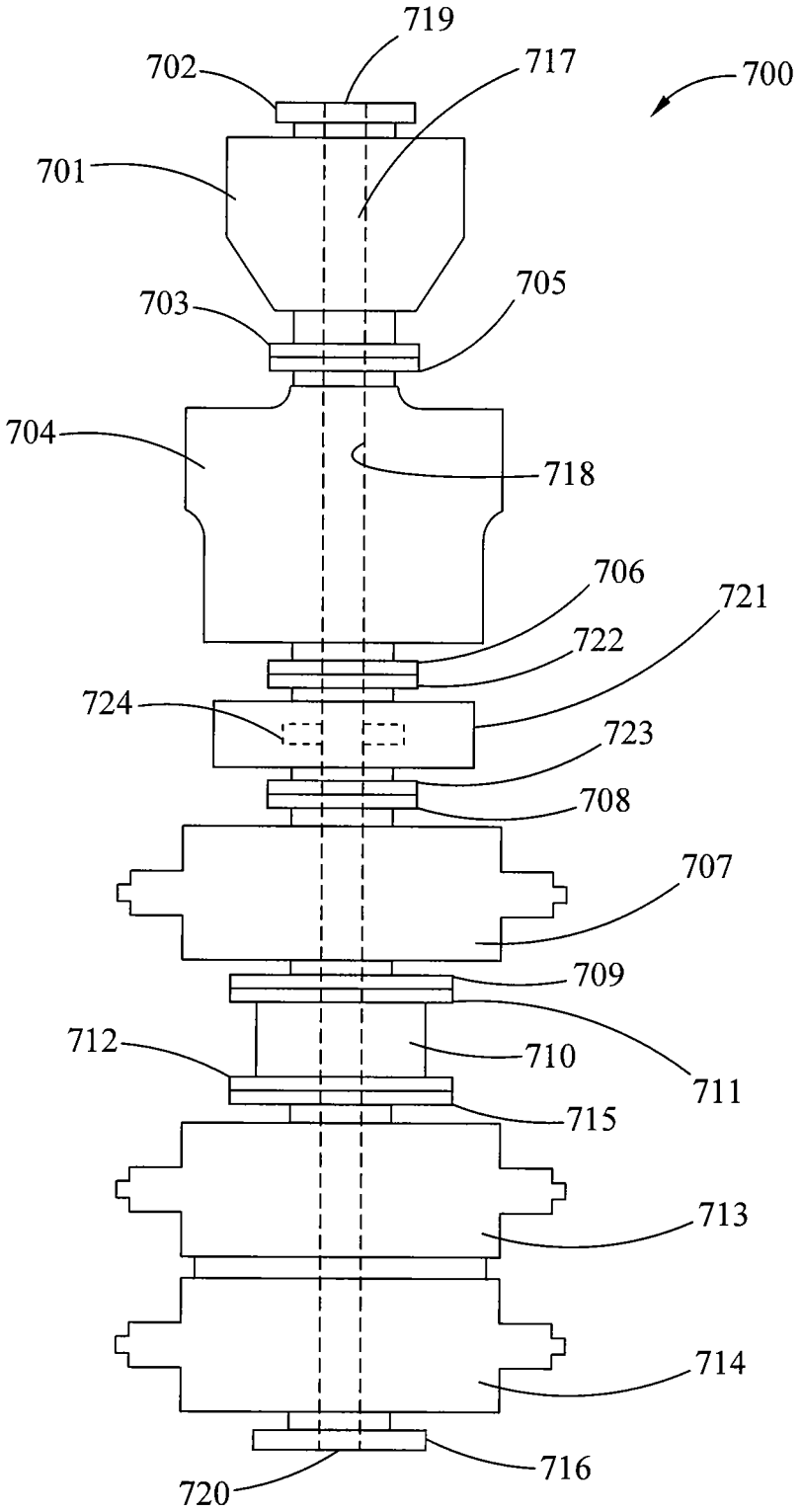
FIG. 7 is a schematic of a second embodiment of a laser assisted BOP stack of the present invention to be used with the BOP drilling systems of FIGS. 1 and 8.

In FIG. 7 there is shown an example of a laser assisted BOP stack. Thus, there is shown a laser assisted BOP stack 700 having, from top 719 to bottom 720, a flex joint 701 with connecters 702, 703, an annular preventer 704 with connecters 705, 706, a shear laser assembly 721 with connecters 722, 723 (having a laser delivery assembly 724 shown in phantom lines), a shear ram 707 with connecters 708, 709, a spacer 710 with connecters 711, 712, and pipe rams 713, 714 with connecters 715, 716. The connecters, e.g., 702 can be any type of connecter known or used by those of skill in the offshore drilling arts, such as for example a flange with bolts, that meet the pressure requirements for the BOP. Each of the components, e.g., shear ram 707, in the BOP stack 700 have an internal cavity, or bore, having a wall, which when assembled into the BOP stack forms an inner cavity 717 having a wall 718 (shown as in phantom lines in the drawing).

Figure 9:
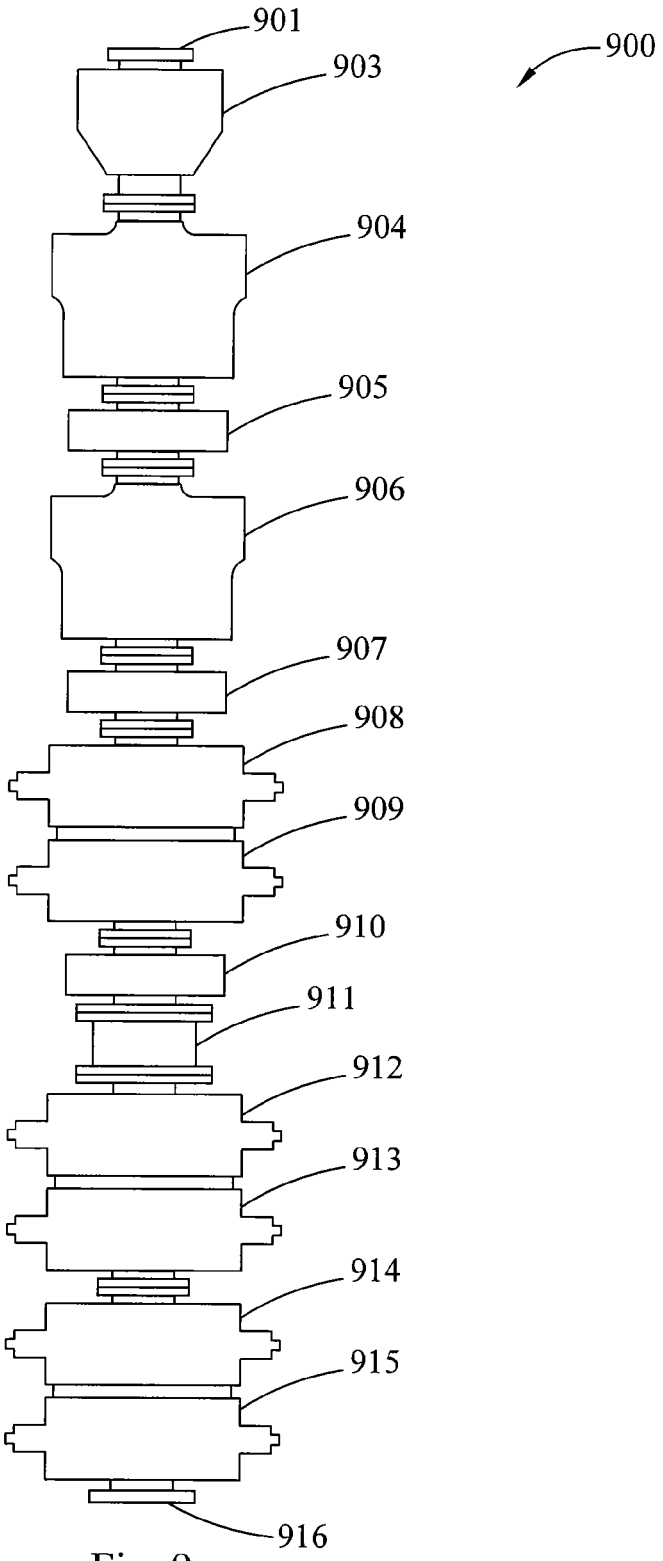
FIG. 9 is a schematic of a first embodiment of a laser assisted BOP stack of the present invention to be used with the BOP drilling systems of FIGS. 1 and 8.

In FIG. 9 there is shown an example of a laser assisted BOP stack for ultra deep-water operations of 10,000 feet and greater, although this stack would also operate and be useful at shallower depths. Listing the components from the top of the stack 901 to the bottom of the stack 916, the laser assisted BOP stack 900, has a flex joint 903, an annular preventer 904, a shear laser module 905, an annular preventer 906, a shear laser module 907, a shear ram 908, a shear ram 909, a shear laser module 910, a spacer 911, pipe rams 912, 913 and pipe rams 914, 915. These components each have bores and when assembled in the stack the bores form a cavity (not shown in this figure) extending from the top 901 to the bottom 916 of the stack. The shear laser modules have laser delivery assemblies (not shown in this figure) The components are connected together with connecters of any type suitable for, and that would meet the requirements of, offshore drilling and for this example in particular that would meet the requirements of ultra-deep water offshore drilling.

The laser assisted BOP stacks of the present inventions may be used to control and manage both pressures and flows in a well; and may be used to manage and control emergency situations, such as a potential blowout. In addition to the shear laser module, the laser assisted BOP stacks may have an annular preventer. The annular preventers may have an expandable packer that seals against a tubular that is in the BOP cavity preventing material from flowing through the annulus formed between the outside diameter of the tubular and the inner cavity wall of the laser assisted BOP. In addition to the shear laser module, the laser assisted BOP stacks may have ram preventers. The ram preventers may be, for example: pipe rams, which may have two half-circle like clamping devices that are driven against the outside diameter of a tubular that is in the BOP cavity; blind rams that can seal the cavity when no tubulars are present, or they may be a shear rams that can cut tubulars and seal off the BOP cavity; or they may be a laser shear ram assembly. In general, laser shear rams assemblies use a laser beam to cut or weaken a tubular, including drilling collars, pipe joints, and bottom hole assemblies that might be present in the BOP cavity, which are disclosed in co-filed application Ser. No. 13/047,175.

Laser assisted subsea BOP drilling systems, and in particular the shear laser modules, may utilize a single high power laser, and preferably may have two or three high power lasers, and may have several high power lasers, for example, six or more. High power solid-state lasers, specifically semiconductor lasers and fiber lasers are preferred, because of their short start up time and essentially instant-on capabilities. The high power lasers for example may be fiber lasers or semiconductor lasers having 10 kW, 20 kW, 50 kW or more power and, which emit laser beams with wavelengths preferably in about the 1550 nm (nanometer), or 1083 nm ranges. Examples of preferred lasers, and in particular solid-state lasers, such as fiber lasers, are set forth in US patent application publications 2010/0044106 and 2010/0215326 and in pending U.S. patent application Ser. No. 12/840,978. The laser, or lasers, may be located on the offshore drilling rig, above the surface of the water, and optically connected to the BOP on the seafloor by way of a high power long distance laser transmission cable, preferred examples of which are set forth in US patent application publications 2010/0044106 and 2010/0215326 and in pending U.S. patent application Ser. No. 12/840,978. The laser transmission cable may be contained in a spool and unwound and attached to the BOP and riser as they are lowered to the seafloor. The lasers may also be contained in, or associated with, the BOP frame, eliminating the need for a long distance of high power optical cable to transmit the laser beam from the surface of the water down to the seafloor. In view of the extreme conditions in which the shear laser modules and laser shear rams are required to operate and the need for high reliability in their operation, one such configuration of a laser assisted subsea BOP drilling systems is to have at least one high power laser located on the offshore drilling rig and connect to the BOP by a high power transmission cable and to have at least one laser in, or associated with, the BOP frame on the seafloor.

Figure 11:
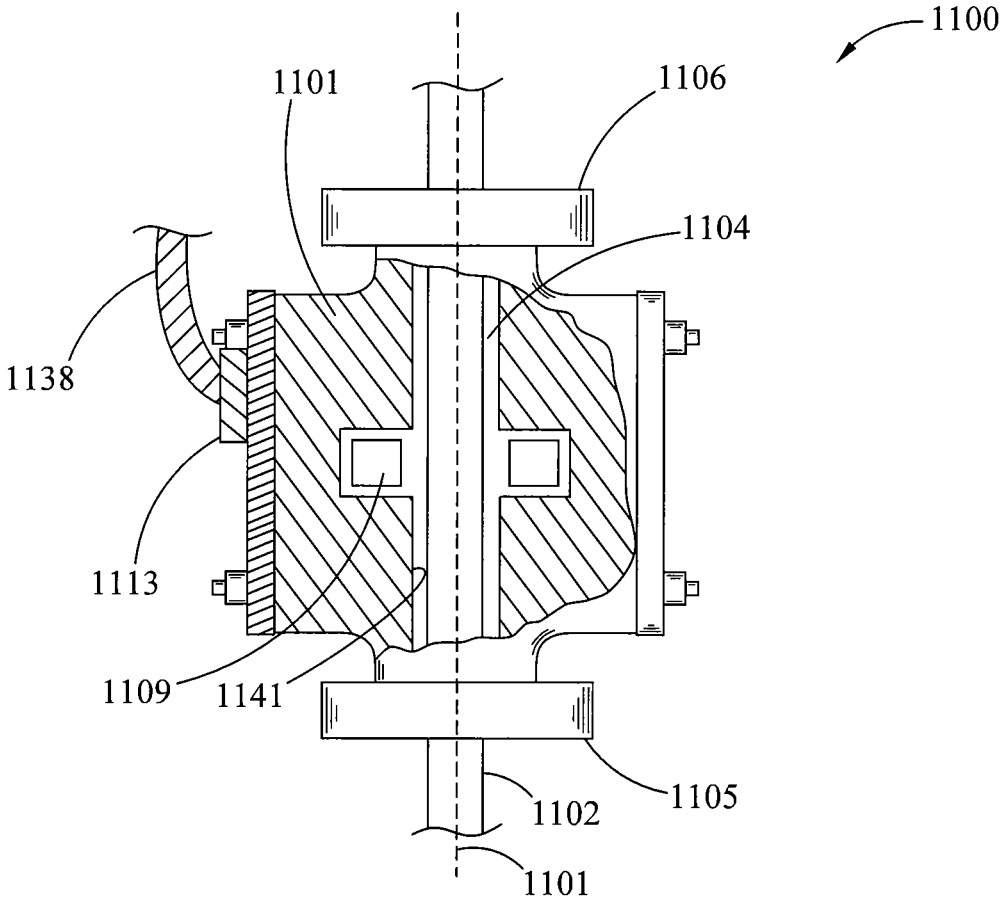
FIG. 11 is a partial cut away cross-sectional view of a section of a second embodiment of an SLM of the present invention to be used with the BOP drilling systems of FIGS. 1 and 8.

Turning to FIG. 11 there is shown an example of an embodiment of a shear laser module ("SLM") that could be used in a laser assisted BOP stack. The SLM 1100 has a body 1101. The body 1101 has a first connecter 1105 and a second connecter 1106. The inner cavity 1104 has an inner cavity wall 1141. There is also provided a laser delivery assembly 1109. The laser delivery assembly 1109 is located in body 1101. The laser delivery assembly 1109 may be, for example, an annular assembly that surrounds, or partially surround, the inner cavity 1104. This assembly 1109 is optically associated with at least one high power laser source.

Figure 12:
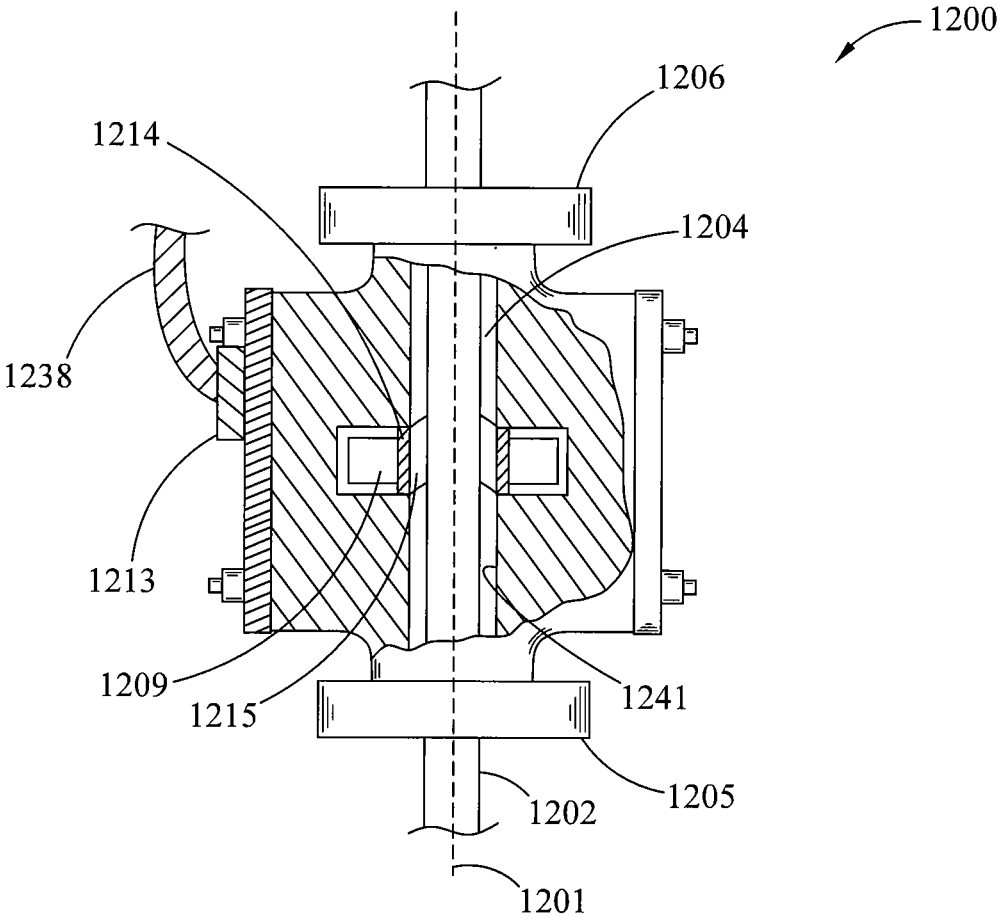
FIG. 12 is a partial cut away cross-sectional view of a section of a third embodiment of an SLM of the present invention to be used with the BOP drilling systems of FIGS. 1 and 8.

Turning to FIG. 12 there is shown an example of an embodiment of a shear laser module ("SLM") that could be used in a laser assisted BOP stack. The SLM 1200 has a body 1201. The body 1201 has a first connecter 1205 and a second connecter 1206. The inner cavity 1204 has an inner cavity wall 1241. There is also provided a laser delivery assembly 1209. The laser delivery assembly 1209 is located in body 1201. The laser delivery assembly 1209 may be, for example, an annular assembly that surrounds, or partially surround, the inner cavity 1204. This assembly 1209 is optically associated with at least one high power laser source. The SLM also has a feed-through assembly 1113 and a conduit 1138 for conveyance to a high power laser, or other sources of materials for the cutting operation.

The embodiment of FIG. 12 further contains a shield 1214 for the laser delivery assembly 1209. The shield 1214 is positioned within the body 1201, such that its inner surface or wall 1215 is flush with the cavity wall 1241. In this manner the shield does not form any ledge or obstruction in the cavity 1204. The shield can protect the laser delivery assembly 1209 from drilling fluids. The shield may also manage pressure, or contribute to pressure management, for the laser delivery assembly 1209. The shield may further protect the laser delivery assembly 1209 from tubulars, such as tubular 1202, as they are moved through, in or out of the cavity 1204. The shield may be made of a material, such as steel or other type of metal or other material, that is both strong enough to protect the laser delivery assembly 1209 and yet be quickly cut by the laser beam when it is fired toward the tubular 1202. The shield could also be removable from the beam path of the laser beam. In this configuration upon activation of the laser delivery assembly 1209 the shield would be moved away from the beam path. In the removable shield configuration the shield would not have to be easily cut by the laser beam. The SLM also has a feed-through assembly 1213 and a conduit 1238 for conveyance to a high power laser, or other sources of materials for the cutting operation.

During drilling and other activities, tubulars are typically positioned within the BOP inner cavity. An annulus is formed between the outer diameter of the tubular and the inner cavity wall. These tubulars have an outer diameter that can range in size from about 18" down to a few inches, and in particular, typically range from about 16⅖ (16.04)" to about 5", or smaller. When tubulars are present in the cavity, upon activation of the SLM, the laser delivery assembly delivers high power laser energy to the tubular located in the cavity. The high power laser energy cuts the tubular completely permitting the tubular to be moved or dropped away from the rams or annular preventers in the stack, permitting the BOP to quickly seal off the inner BOP cavity, and thus the well, without any interference from the tubular.

Although a single laser delivery assembly is shown in the examples of the embodiments of FIGS. 11 and 12, multiple laser delivery assemblies, assemblies of different shapes, and assemblies in different positions, may be employed. The ability to make precise and predetermined laser energy delivery patterns to tubulars and the ability to make precise and predetermined cuts in and through tubulars, provides the ability, even in an emergency situation, to sever the tubular without crushing it and to have a predetermined shape to the severed end of the tubular to assist in later attaching a fishing tool to recover the severed tubular from the borehole. Further, the ability to sever the tubular, without crushing it, provides a greater area, i.e., a bigger opening, in the lower section of the severed tubular through which drilling mud, or other fluid, can be pumped into the well, by the kill line associated with the BOP stack.

The body of the SLM may be a single piece that is machined to accommodate the laser delivery assembly, or it may be made from multiple pieces that are fixed together in a manner that provides sufficient strength for its intend use, and in particular to withstand pressures of 5,000 psi, 10,000 psi, 15,000 psi, 20,000 psi, and greater. The area of the body that contains the laser delivery assembly may be machined out, or otherwise fabricated to accommodate the laser delivery assembly, while maintaining the strength requirements for the body's intended use. The body of the SLM may also be two or more separate components or parts, e.g., one component for the upper half and one for the lower half. These components could be attached to each other by, for example, bolted flanges, or other suitable attachment means known to one of skill in the offshore drilling arts. The body, or a module making up the body, may have a passage, passages, channels, or other such structures, to convey fiber optic cables for transmission of the laser beam from the laser source into the body and to the laser delivery assembly, as well as, other cables that relate to the operation or monitoring of the laser delivery assembly and its cutting operation.

Turning to FIG. 10 and FIGS. 10A-10C there is shown an example of an embodiment of an SLM that could be used in a laser assisted BOP stack. Thus, there is shown an SLM 1000 having a body 1001. The body 1001 has two connectors 1006, 1005 for connecting to other components of a BOP stack, thus enabling the SLM 1000 to be incorporated into, or become a part of, a BOP stack. The body has a cavity 1004, which cavity has a center axis (dashed line) 1011 and a wall 1041. The BOP cavity 1004 also has a vertical axis and in this embodiment the vertical axis and the center axis 1011 are the same, which is generally the case for BOPs. (The naming of these axes are based upon the configuration of the BOP and are relative to the BOP structures themselves, not the position of the BOP with respect to the surface of the earth. Thus, the vertical axis of the BOP will not change if the BOP, for example, were laid on its side.) Typically, the center axis of cavity 1011 is on the same axis as the center axis of the wellhead cavity or opening through which tubulars are inserted into the borehole.

The body 1001 contains laser delivery assembly 1009. There is also shown a tubular 1012 in the cavity 1004. The body 1001 also has a feed-through assembly 1013 for managing pressure and permitting optical fiber cables and other cables, tubes, wires and conveyance means, which may be needed for the operation of the laser cutter, to be inserted into the body 1001. The feed-through assembly 1013 connects with conduit 1038 for conveyance to a high power laser, or other sources of materials for the cutting operation.

Figure 10:
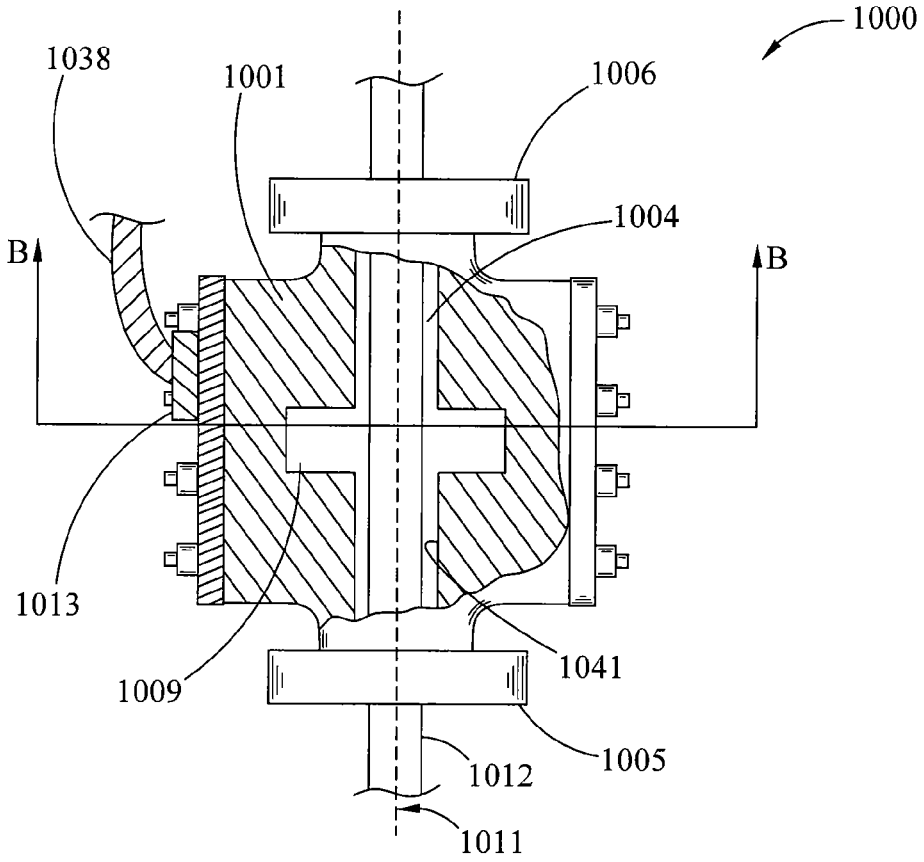
FIG. 10 is a partial cut away cross-sectional view of a section of a first embodiment of a shear laser module ("SLM") of the present invention to be used with the BOP drilling systems of FIGS. 1 and 8.
Figure 10A:
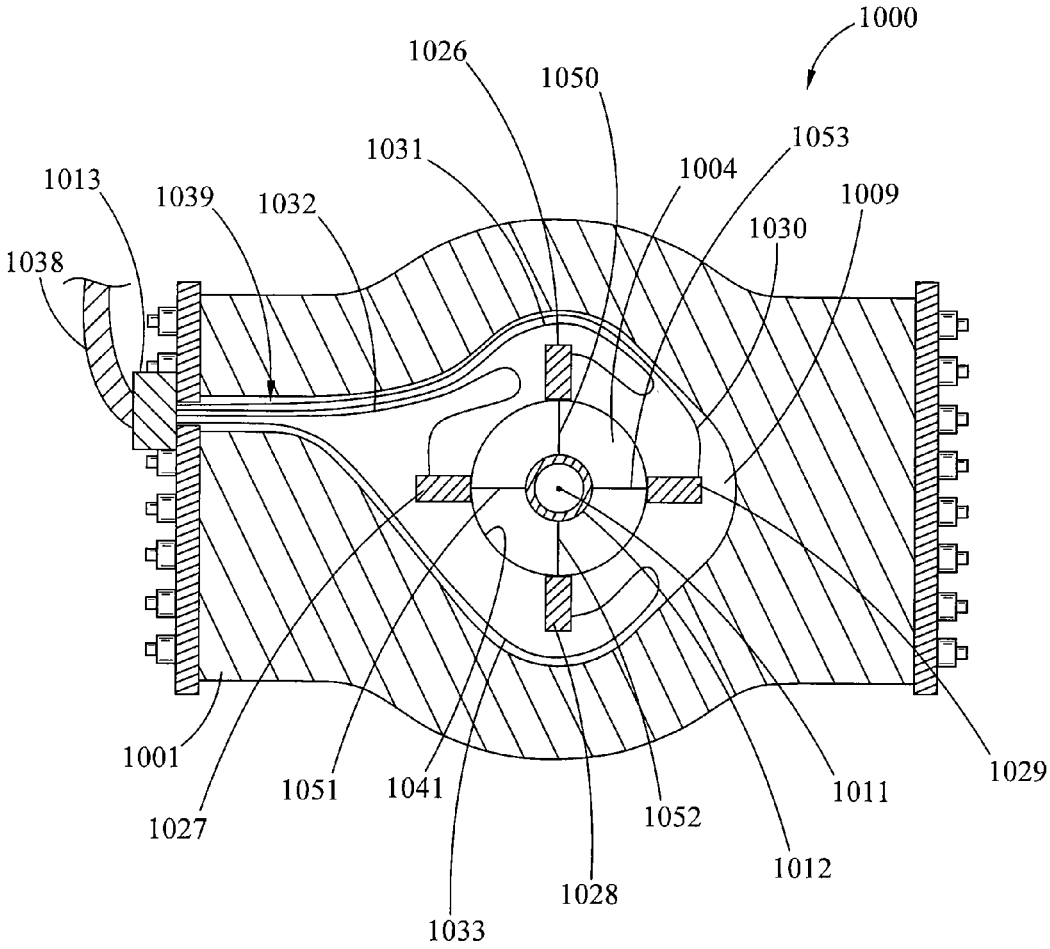
FIGS. 10A, 10B & 10C are transverse cross-sectional views of the SLM of FIG. 10 taken along line B-B of FIG. 10.
Figure 10B:
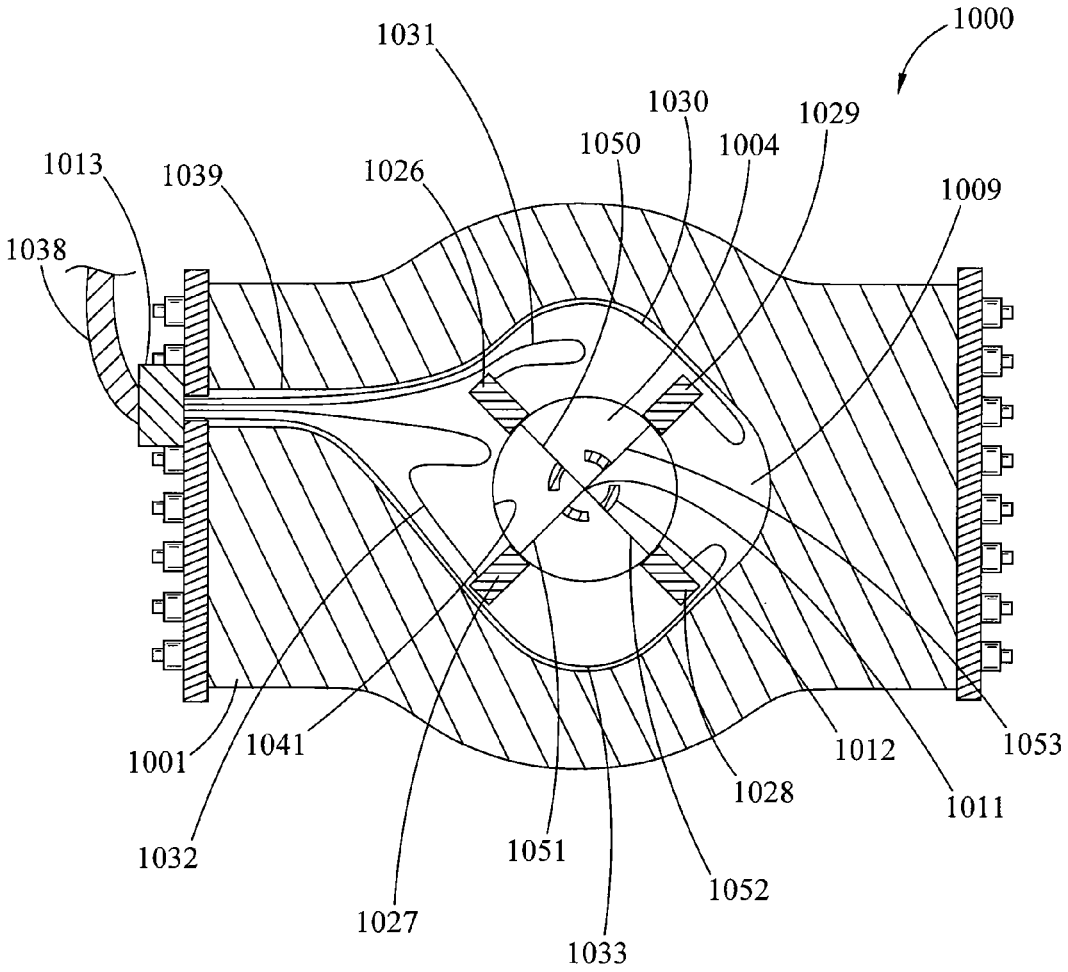
Figure 10C:
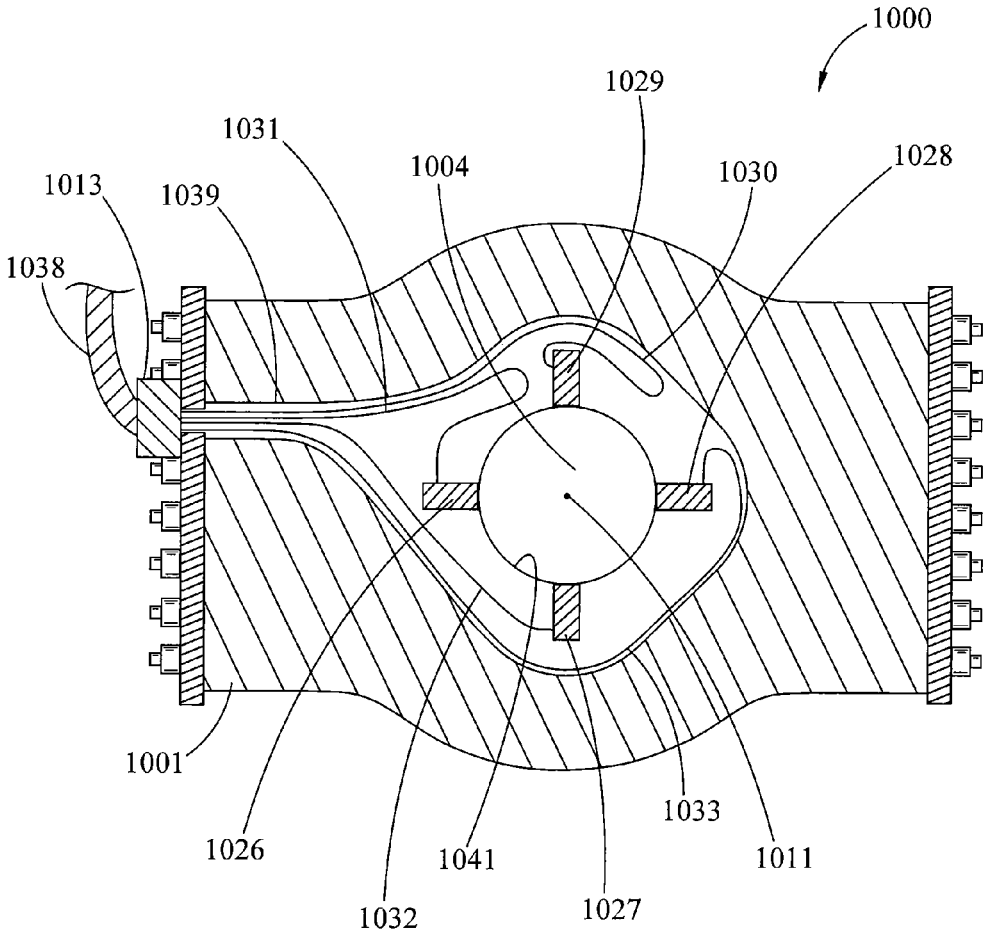

FIGS. 10A to 10C shown cross-sectional views of the embodiment shown in FIG. 10 taken along line B-B of FIG. 10. FIGS. 10A to 10C also show the sequences of operation of the SLM 1000, in cutting the tubular 1012. In this embodiment the laser delivery assembly 1009 has four laser cutters 1026, 1027, 1028, and 1029. Flexible support cables are associated with each of the laser cutters. Thus, flexible support cable 1031 is associated with laser cutter 1026, flexible support cable 1032 is associated with laser cutter 1027, flexible support cable 1033 is associated with laser cutter 1028, and flexible support cable 1030 is associated with laser cutter 1029. The flexible support cables are located in channel 1039 and enter feed-through assembly 1013. In the general area of the feed-through assembly 1013, the support cables transition from flexible to semi-flexible, and may further be included in conduit 1038 for conveyance to a high power laser, or other sources of materials for the cutting operation. The flexible support cables 1030, 1031, 1032, and 1033 have extra, or additional length, which accommodates the orbiting of the laser cutters 1026, 1027, 1028 and 1029 around the axis 1011, and around the tubular 1012.

FIGS. 10A to 10C show the sequence of activation of the SLM 1000 to sever a tubular 1012. In this example, the first view (e.g., a snap shot, since the sequence preferably is continuous rather than staggered or stepped) of the sequence is shown in FIG. 10A. As activated the four lasers cutters 1026, 1027, 1028 and 1029 propagate (which may also be referred to as shooting or firing the laser to deliver or emit a laser beam from the cutter) laser beams that travel along beam paths 1050, 1051, 1052 and 1053. The beam paths 1050, 1051, 1052 and 1053 extend from the laser cutters 1026, 1027, 1028 and 1029 toward the center axis 1011, and thus, intersect the tubular 1012. The beams are directed toward the center axis

1011. As such, the beams are shot from within the BOP, from outside of the cavity wall 1041, and travel along their respective beam paths toward the center axis of the BOP. The laser beams strike tubular 1012 and begin cutting, i.e., removing material from, the tubular 1012.

If the cavity 1004 is viewed as the face of a clock, the laser cutters 1026, 1027, 1028 and 1029 could be viewed as being initially positioned at 12 o'clock, 9 o'clock, 6 o'clock and 3 o'clock, respectively. Upon activation, the laser cutters and their respective laser beams, begin to orbit around the center axis 1011, and the tubular 1012. (In this configuration the laser cutters would also rotate about their own axis as they orbit, and thus, if they moved through one complete orbit they would also have moved through one complete rotation.) In the present example the cutters and beams orbit in a counter clockwise direction, as viewed in the figures; however, a clockwise rotation may also be used.

Thus, as seen in the next view of the sequence, FIG. 10B, the laser cutters, 1026, 1027, 1028 and 1029 have rotated 45 degrees, with laser beams that travel along beam paths 1050, 1051, 1052 and 1053 having cut through four ⅛ sections (i.e., a total of half) of the circumference of the tubular 1012. FIG. 10C then shows the cutter having moved through a quarter turn. Thus, cutter 1026 could be seen as having moved from the 12 o'clock position to 9 o'clock position, with the other cutters having similarly changed their respective clock face positions. Thus, by moving through a quarter turn the beam paths 1050, 1051, 1052 and 1053 would have crossed the entire circumference of the tubular 1012 and the laser beams traveling along those beam paths would severe the tubular.

During the cutting operation, and in particular for circular cuts that are intended to sever the tubular, it is preferable that the tubular not move in a vertical direction. Thus, at or before the laser cutters are fired, the pipe rams, the annular preventer, or a separate holding device should be activated to prevent vertical movement of the pipe during the laser cutting operation. The separate holding device could also be contained in the SLM.

The rate of the orbital movement of the laser cutters is dependent upon the number of cutters used, the power of the laser beam when it strikes the surface of the tubular to be cut, the thickness of the tubular to be cut, and the rate at which the laser cuts the tubular. The rate of the orbital motion should be slow enough to ensure that the intended cuts can be completed.

In addition to orbiting cutters, the laser beam can be scanned, e.g., moved in a fan like pattern. In this manner the beam path would be scanned along the area to be cut, e.g., an area of a tubular, while the cutter, or at least the base of the cutter, remained in a fixed position. This scanning of the laser beam can be accomplished, for example, by moving the cutter back and forth about a fixed point, e.g., like the movement of an oscillating fan. It may also be accomplished by having optics contained within the cutter that scans the beam path, e.g., a laser scanner, and thus the laser beam in the fan like pattern. For example a multi-faceted mirror or prim that is rotated may be utilized as a scanner. It should be noted, however, that scanning processes in general might be less efficient the other cutting approaches provided in this specification. Additional scanning patterns for the beam path and laser beam many also be employed to accomplished or address a specific cutting application or tubular configuration in a BOP cavity.

The orbital or other movement of the laser cutters can be accomplished by mechanical, hydraulic and electro-mechanical systems known to the art. For example, the cutters can be mounted to step motors that are powered by batteries, in the BOP, electrical cables from the surface, or both. The step motors may further have controllers associated with them, which controllers can be configured to control the step motors to perform specific movements corresponding to specific cutting steps. Cam operated systems may be employed to move the cutters through a cutting motion or cycle. The cams may be driven by electric motors, hydraulic motors, hydraulic pistons, or combinations of the forgoing, to preferably provide for back up systems to move the cutters, should one motive means fail. A gearbox, a rack gear assembly, or combinations there of may be utilized to provide cutter movement, in conjunction with an electric motor, hydraulic motor or piston assembly. The control system may be integral to the cutter motive means, such as a step motor control combination, may be part of the BOP, such as being contained with the other control system on the BOP, or it may be on the rig, or combinations of the forgoing.

The use of the term "completed" cut, and similar such terms, includes severing the tubular into two sections, i.e., a cut that is all the way through the wall and around the entire circumference of the tubular, as well as, cuts in which enough material is removed from the tubular to sufficiently weaken the tubular to ensure that the shear rams are in sealing engagement. Depending upon the particular configuration of the SLM, the laser assisted BOP stack, and the BOP's intended use, a completed cut could be, for example: severing the tubular into two separate sections; the removal of a ring of material around the outer portion of the tubular, from about 10% to about 90% of the wall thickness; a number of perforations created in the wall, but not extending through the wall of the tubular; a number of perforations going completely through the wall of the tubular; a number of slits created in the wall, but not extending through the wall of the tubular; a number of slits going completely through the wall of the tubular; the material removed by the shot patterns disclosed in this specification; or, other patterns of material removal and combinations of the foregoing. It is preferred that the complete cut is made in less than one minute, and more preferable that the complete cut be made in 30 seconds or less.

The rate of the orbital motion can be fixed at the rate needed to complete a cut for the most extreme tubular or combination of tubulars, or the rate of rotation could be variable, or predetermined, to match the particular tubular, or types of tubulars, that will be present in the BOP during a particular drilling operation.

The greater the number of laser cutters in a rotating laser delivery assembly, the slower the rate of orbital motion can be to complete a cut in the same amount of time. Further, increasing the number of laser cutters decreases the time to complete a cut of a tubular, without having to increase the orbital rate. Increasing the power of the laser beams will enable quicker cutting of tubulars, and thus allow faster rates of orbiting, fewer laser cutters, shorter time to complete a cut, or combinations thereof.

The laser cutters used in the examples and illustrations of the embodiments of the present inventions may be any suitable device for the delivery of high power laser energy. Thus, any configuration of optical elements for culminating and focusing the laser beam can be employed. A further consideration, however, is the management of the optical effects of fluids and materials that may be located within the annulus between the tubular and the BOP inner cavity wall.

Such drilling fluids could include, by way of example, water, seawater, salt water, brine, drilling mud, nitrogen, inert gas, diesel, mist, foam, or hydrocarbons. There can also likely be present in these drilling fluids borehole cuttings, e.g., debris, which are being removed from, or created by, the advancement of the borehole or other downhole operations. There can be present two-phase fluids and three-phase fluids, which would constitute mixtures of two or three different types of material. These drilling fluids can interfere with the ability of the laser beam to cut the tubular. Such fluids may not transmit, or may only partially transmit, the laser beam, and thus, interfere with, or reduce the power of, the laser beam when the laser beam is passed through them. If these fluids are flowing, such flow may further increase their non-transmissiveness. The non-transmissiveness and partial-transmissiveness of these fluids can result from several phenomena, including without limitation, absorption, refraction and scattering. Further, the non-transmissiveness and partial-transmissiveness can be, and likely will be, dependent upon the wavelength of the laser beam.

In an 18¾" BOP, i.e., the cavity has a diameter of about 18¾," depending upon the configuration of the laser cutters and the size of the tubular in the cavity, the laser beam could be required to pass through over 6" of drilling fluids. In other configurations the laser cutters may be positioned in close, or very close, proximity to the tubular to be cut and moved in a manner where this close proximity is maintained. In these configurations the distance for the laser beam to travel between the laser cutters and the tubular to be cut may be maintained within about 2", less than about 2", less than about 1" and less than about ½", and maintained within the ranges of less than about 3" to less than about ½", and less than about 2" to less than about ½".

In particular, for those configurations and embodiments where the laser has a relatively long distance to travel, e.g., greater than about 1" or 2" (although this distance could be more or less depending upon laser power, wavelength and type of drilling fluid, as well as, other factors) it is advantageous to minimize the detrimental effects of such borehole fluids and to substantially ensure, or ensure, that such fluids do not interfere with the transmission of the laser beam, or that sufficient laser power is used to overcome any losses that may occur from transmitting the laser beam through such fluids. To this end, mechanical, pressure and jet type systems may be utilized to reduce, minimize or substantially eliminate the effect of the drilling fluids on the laser beam.

For example, mechanical devices such as packers and rams, including the annular preventer, may be used to isolate the area where the laser cut is to be performed and the drilling fluid removed from this area of isolation, by way of example, through the insertion of an inert gas, or an optically transmissive fluid, such as an oil or diesel fuel. The use of a fluid in this configuration has the added advantage that it is essentially incompressible. Moreover, a mechanical snorkel like device, or tube, which is filled with an optically transmissive fluid (gas or liquid) may be extended between or otherwise placed in the area between the laser cutter and the tubular to be cut. In this manner the laser beam is transmitted through the snorkel or tube to the tubular.

A jet of high-pressure gas may be used with the laser cutter and laser beam. The high-pressure gas jet may be used to clear a path, or partial path for the laser beam. The gas may be inert, or it may be air, oxygen, or other type of gas that accelerates the laser cutting. The relatively small amount of oxygen needed, and the rapid rate at which it would be consumed by the burning of the tubular through the laser-metal-oxygen interaction, should not present a fire hazard or risk to the drilling rig, surface equipment, personnel, or subsea components.

The use of oxygen, air, or the use of very high power laser beams, e.g., greater than about 1 kW, could create and maintain a plasma bubble or a gas bubble in the cutting area, which could partially or completely displace the drilling fluid in the path of the laser beam.

A high-pressure laser liquid jet, having a single liquid stream, may be used with the laser cutter and laser beam. The liquid used for the jet should be transmissive, or at least substantially transmissive, to the laser beam. In this type of jet laser beam combination the laser beam may be coaxial with the jet. This configuration, however, has the disadvantage and problem that the fluid jet does not act as a waveguide. A further disadvantage and problem with this single jet configuration is that the jet must provide both the force to keep the drilling fluid away from the laser beam and be the medium for transmitting the beam.

A compound fluid laser jet may be used as a laser cutter. The compound fluid jet has an inner core jet that is surrounded by annular outer jets. The laser beam is directed by optics into the core jet and transmitted by the core jet, which functions as a waveguide. A single annular jet can surround the core, or a plurality of nested annular jets can be employed. As such, the compound fluid jet has a core jet. This core jet is surrounded by a first annular jet. This first annular jet can also be surrounded by a second annular jet; and the second annular jet can be surrounded by a third annular jet, which can be surrounded by additional annular jets. The outer annular jets function to protect the inner core jet from the drill fluid present in the annulus between the BOP cavity wall and the tubular. The core jet and the first annular jet should be made from fluids that have different indices of refraction. In the situation where the compound jet has only a core and an annular jet surrounding the core the index of refraction of the fluid making up the core should be greater than the index of refraction of the fluid making up the annular jet. In this way, the difference in indices of refraction enable the core of the compound fluid jet to function as a waveguide, keeping the laser beam contained within the core jet and transmitting the laser beam in the core jet. Further, in this configuration the laser beam does not appreciably, if at all, leave the core jet and enter the annular jet.

The pressure and the speed of the various jets that make up the compound fluid jet can vary depending upon the applications and use environment. Thus, by way of example the pressure can range from about 3000 psi, to about 4000 psi to about 30,000 psi, to preferably about 70,000 psi, to greater pressures. The core jet and the annular jet(s) may be the same pressure, or different pressures, the core jet may be higher pressure or the annular jets may be higher pressure. Preferably the core jet is higher pressure than the annular jet. By way of example, in a multi-jet configuration the core jet could be 70,000 psi, the second annular jet (which is positioned adjacent the core and the third annular jet) could be 60,000 psi and the third (outer, which is positioned adjacent the second annular jet and is in contact with the work environment medium) annular jet could be 50,000 psi. The speed of the jets can be the same or different. Thus, the speed of the core jet can be greater than the speed of the annular jet, the speed of the annular jet can be greater than the speed of the core jet and the speeds of multiple annular jets can be different or the same. The speeds of the core jet and the annular jet can be selected, such that the core jet does contact the drilling fluid, or such contact is minimized. The speeds of the jet can range from relatively slow to very fast and preferably range from about 1 ms (meters/second) to about 50 m/s, to about 200 m/s, to about 300 m/s and greater The order in which the jets are first formed can be the core jet first, followed by the annular rings, the annular ring jet first followed by the core, or the core jet and the annular ring being formed simultaneously. To minimize, or eliminate, the interaction of the core with the drilling fluid, the annular jet is created first followed by the core jet.

In selecting the fluids for forming the jets and in determining the amount of the difference in the indices of refraction for the fluids the wavelength of the laser beam and the power of the laser beam are factors that should be considered. Thus, for example for a high power laser beam having a wavelength in the 1080 nm (nanometer) range the core jet can be made from an oil having an index of refraction of about 1.53 and the annular jet can be made from a mixture of oil and water having an index of refraction from about 1.33 to about 1.525. Thus, the core jet for this configuration would have an NA (numerical aperture) from about 0.95 to about 0.12, respectively. Further details, descriptions, and examples of such compound fluid laser jets are contained in Zediker et. al, Provisional U.S. Patent Application Ser. No. 61/378,910, titled Waveguide Laser Jet and Methods of Use, filed Aug. 31, 2010, the entire disclosure of which is incorporated herein by reference. It is to be noted that said incorporation by reference herein does not provide any right to practice or use the inventions of said application or any patents that may issue therefrom and does not grant, or give rise to, any licenses thereunder.

The laser cutters have a discharge end from which the laser beam is propagated. The laser cutters also have a beam path. The beam path is defined by the path that the laser beam is intended to take, and extends from the discharge end of the laser cutter to the material or area to be cut. Preferably, the beam path(s) may be configured to provide a completed cut at the area where the mechanical forces for the shear rams, the tension that the tubular may be under, or both, are the greatest. In this way, the likelihood that unwanted material may be left in the ram interface to obstruct or inhibit the sealing of the rams is reduced or eliminated. As described herein, other laser cutter placements, firing sequences, shear arrangements, or combinations of thereof, also address this issue of providing greater assurances that the rams enter into sealing engagement.

Figures 13, 13A, 13B:
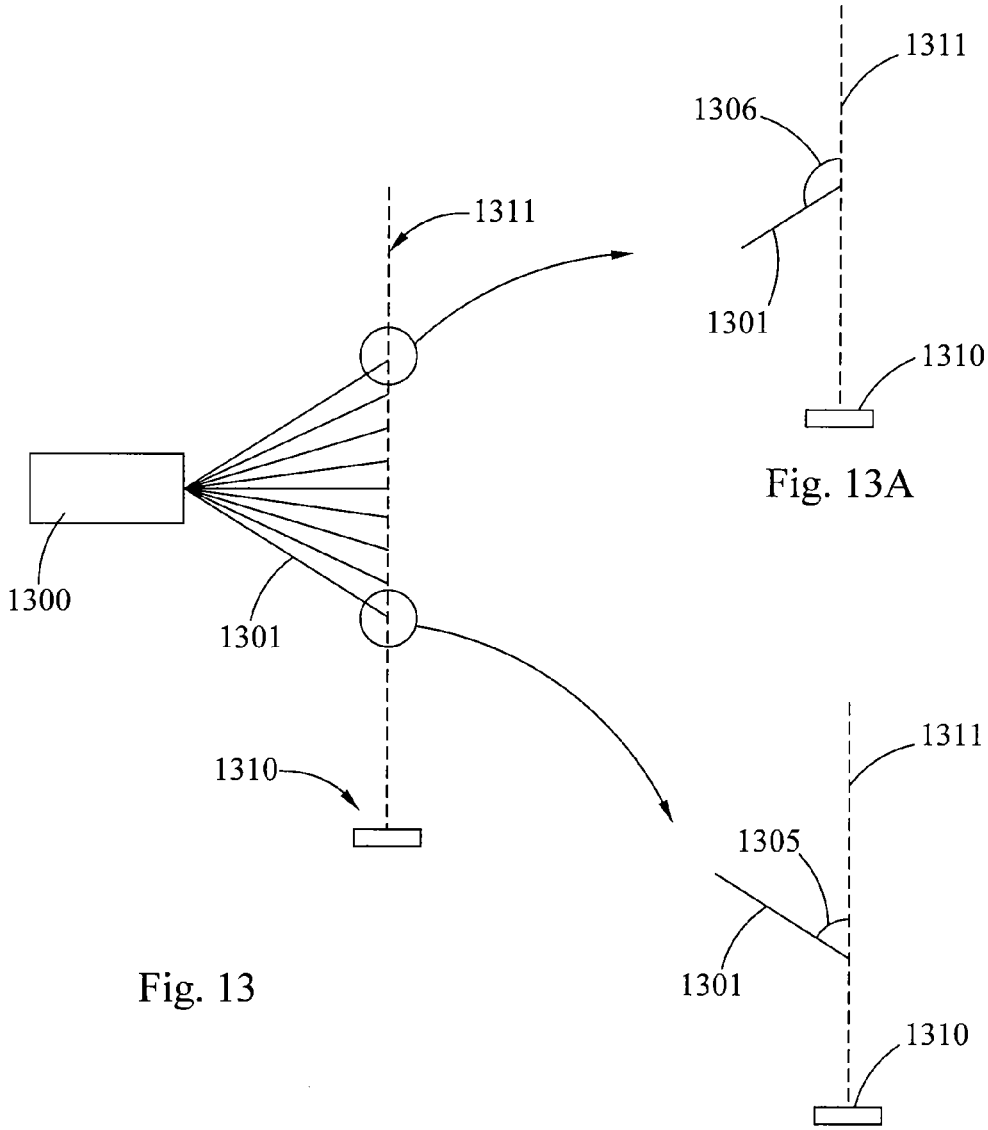
FIGS. 13, 13A & 13B are schematic illustrations of laser beam paths of the present invention.

The angle at which the laser beam contacts the tubular may be determined by the optics within the laser cutter or it may be determined by the angle or positioning of the laser cutter itself. In FIG. 13 there is shown a schematic representation of a laser cutter 1300 with a beam path 1301 leaving the cutter at various angles. When fired or shot from the laser cutter, a laser beam would travel along a beam path. The beam path is further shown in relation to the BOP cavity vertical axis (dashed line) 1311. As seen in the enlarged views of FIGS. 13A and 13B, the angle that the beam path 1301 forms with vertical axis 1311, and thus the angle that a laser beam traveling along this beam path forms with vertical axis 1311, can be an acute angle 1305 or an obtuse angle 1306 relative to the portion of the axis 2311 furthest away from the wellhead connection side 1310. A normal or 90° angle may also be utilized. The BOP wellhead connection side 1310 is shown in the Figures as a reference point for the angle determinations used herein.

The angle between the beam path (and a laser beam traveling along that beam path) and the BOP vertical axis, corresponds generally to the angle at which the beam path and the laser beam will strike a tubular that is present in the BOP cavity. However, using a reference point that is based upon the BOP to determine the angle is preferred, because tubulars may shift or in the case of joints, or a damaged tubular, present a surface that has varying planes that are not parallel to the BOP cavity center axis.

Because the angle formed between the laser beam and the BOP vertical axis can vary, and be predetermined, the laser cutter's position, or more specifically the point where the laser beam leaves the cutter does not necessarily have to be normal to the area to be cut. Thus, the laser cutter position or the beam launch angle can be such that the laser beam travels from: above the area to be cut, which would result in an acute angle being formed between the laser beam and the BOP vertical axis; the same level as the area to be cut, which would result in a 90° angle being formed between the laser beam and the BOP vertical axis; or, below the area to be cut, which would result in an obtuse angle being formed between the laser beam and the BOP cavity vertical axis. In this way, the relationship between the shape of the rams, the surfaces of the rams, the forces the rams exert, and the location of the area to be cut by the laser can be evaluated and refined to optimize the relationship of these factors for a particular application.

The ability to predetermine the angle that the laser beam forms with the BOP vertical axis provides the ability to have specific and predetermined shapes to the end of a severed tubular. Thus, if the laser beam is coming from above the cutting area an inward taper can be cut on the upper end of the lower piece of the severed tubular. If the laser beam is coming from below the area to be cut an outward taper can be cut on the upper end of the lower piece of the severed tubular. If the laser beam is coming from the same level as the cutting area no taper will be cut on the ends of the severed tubulars. These various end shapes for the severed lower tubular maybe advantageous for attaching various types of fishing tools to that tubular to remove it from the well at some later point in time.

The number of laser cutters utilized in a configuration of the present inventions can be a single cutter, two cutters, three cutters, and up to and including 12 or more cutters. As discussed above, the number of cutters depends upon several factors and the optimal number of cutters for any particular configuration and end use may be determined based upon the end use requirements and the disclosures and teachings provided in this specification.

Examples of laser power, fluence and cutting rates, based upon published data, are set forth in Table I.

TABLE I

| type | thickness (mm) | laser power (watts) | spot size (microns) | Laser fluence ($MW/cc^2$) | gas | cutting rate (m/min) |
|---|---|---|---|---|---|---|
| mild steel | 15 | 5,000 | 300 | 7.1 | $O_2$ | 1.8 |
| stainless steel | 15 | 5,000 | 300 | 7.1 | $N_2$ | 1.6 |

The flexible support cables for the laser cutters provide the laser energy and other materials that are needed to perform the cutting operation. Although shown as a single cable for each laser cutter, multiple cables could be used. Thus, for example, in the case of a laser cutter employing a compound fluid laser jet the flexible support cable would include a high power optical fiber, a first line for the core jet fluid and a second line for the annular jet fluid. These lines could be combined into a single cable or they may be kept separate. Additionally, for example, if a laser cutter employing an oxygen jet is utilized, the cutter would need a high power optical fiber and an oxygen line. These lines could be combined into a single cable or they may be kept separate as multiple cables. The lines and optical fibers should be covered in flexible protective coverings or outer sheaths to protect them from borehole fluids, the BOP environment, and the movement of the laser cutters, while at the same time remaining flexible enough to accommodate the orbital movement of the laser cutters. As the support cables near the feed-through assembly there to for flexibility decreases and more rigid means to protect them can be employed. For example, the optical fiber may be placed in a metal tube. The conduit that leaves the feed-through assembly adds additional protection to the support cables, during assembly of the SLM, the BOP stack, handling of the BOP, handling of the SLM, deployment of the BOP, and from the environmental conditions at the seafloor.

It is preferable that the feed-through assemblies, the conduits, the support cables, the laser cutters and other subsea components associated with the operation of the laser cutters, should be constructed to meet the pressure requirements for the intended use of the BOP. The laser cutter related components, if they do not meet the pressure requirements for a particular use, or if redundant protection is desired, may be contained in or enclosed by a structure that does meet the requirements. Thus, if the BOP is rated at 10,000 psi these components should be constructed to withstand that pressure. For deep and ultra-deep water uses the laser cutter related components should preferably be capable of operating under pressures of 15,000 psi, 20,000 psi or greater. The materials, fittings, assemblies, useful to meet these pressure requirements are known to those of ordinary skill in the offshore drilling arts, related sub-sea Remote Operated Vehicle ("ROV") art, and in the high power laser art.

Figure 14:
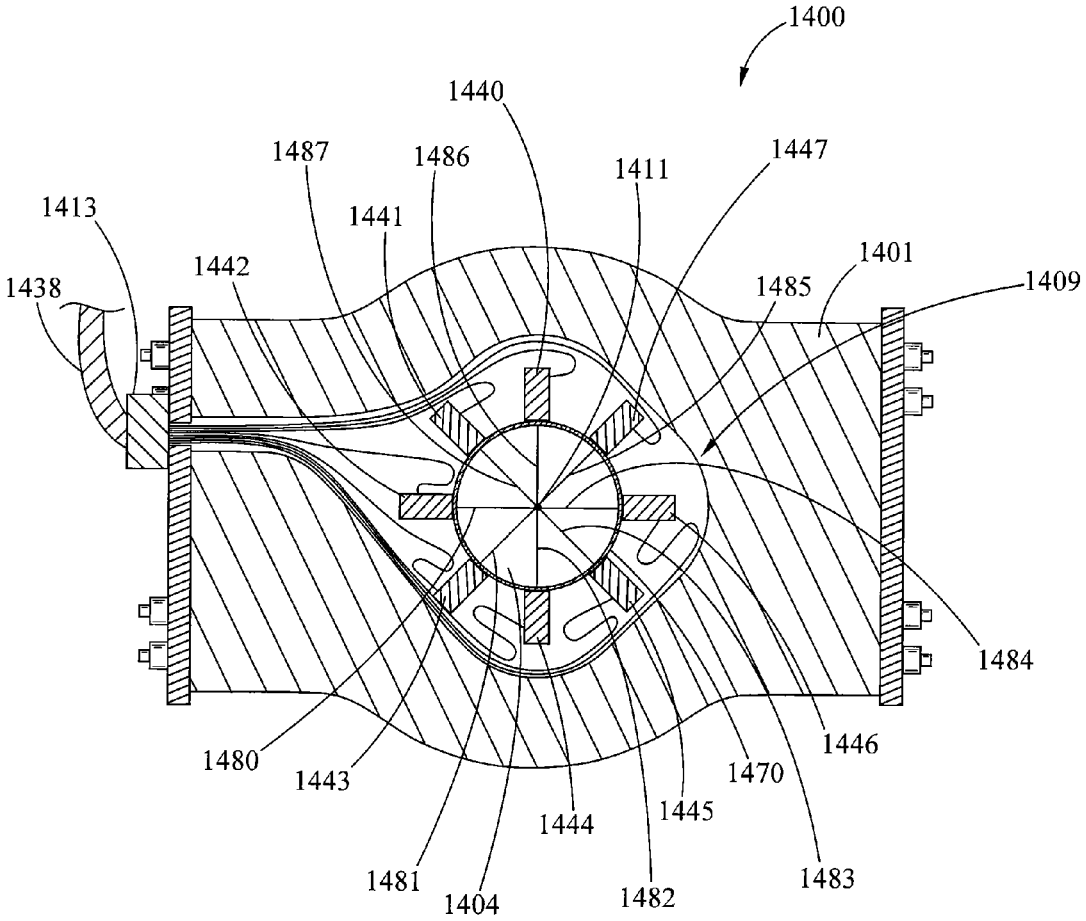
FIG. 14 is transverse cross-sectional views of a fourth embodiment of an SLM of the present invention to be used with the BOP drilling systems of FIGS. 1 and 8.

In FIG. 14 there is shown an example of an embodiment of an SLM that could be used in a laser assisted BOP stack. Thus, there is shown an SLM 1400 having a body 1401. The body has a cavity 1404, which cavity has a center axis 1411. The body 1401 also has a feed-through assembly 1413 for managing pressure and permitting optical fiber cables and other cables, tubes, wires and conveyance means, which may be needed for the operation of the laser cutter, to be inserted into the body 1401. The body houses a laser delivery assembly 1409. The laser delivery assembly 1409 has eight laser cutters 1440, 1441, 1442, 1443, 1444, 1445, 1446 and 1447. Flexible support cables are associated with each of the laser cutters. The flexible support cables have sufficient length to accommodate the orbiting of the laser cutters around the center axis 1411. In this embodiment the cutters need only go through ⅛ of a complete orbit to obtain a cut around the entire circumference of a tubular. The flexible support cables are located in a channel and enter feed-through assembly 1413. Feed-through assembly is pressure rated to the same level as the BOP, and thus should be capable of withstanding pressures of 5,000 psi, 10,000 psi, 15,000 psi, 20,000 psi and greater. In the general area of the feed-through assembly 1413 the support cables transition from flexible to semi-flexible, and may further be included in conduit 1438 for conveyance to a high power laser, or other sources.

There is also provided a shield 1470. This shield 1470 protects the laser cutters and the laser delivery assembly from drilling fluids and the movement of tubulars through the BOP cavity. Is it preferably positioned such that it does not extend into, or otherwise interfere with, the BOP cavity or the movement of tubulars through that cavity. It is preferably pressure rated at the same level as the other BOP components. Upon activation, it may be mechanically or hydraulically moved away from the laser beam's path or the laser beam may be shoot through it, cutting and removing any shield material that initially obstructs the laser beam. Upon activation the lasers cutters shoot laser beams from outside of the BOP cavity into that cavity and toward any tubular that may be in that cavity. Thus, there are laser beam paths 1480, 1481, 1482, 1483, 1484, 1485, 1486, and 1487, which paths rotate around center axis 1411 during operation.

In general, operation of a laser assisted BOP stack where at least one laser beam is directed toward the center of the BOP and at least one laser cutter is configured to orbit (partially or completely) around the center of the BOP to obtain circumferential cuts, i.e., cuts around the circumference of a tubular (including slot like cuts that extend partially around the circumference, cuts that extend completely around the circumference, cuts that go partially through the tubular wall thickness, cut that go completely through the tubular wall thickness, or combinations of the foregoing) may occur as follows. Upon activation, the laser cutter fires a laser beam toward the tubular to be cut. At a time interval after the laser beam has been first fired the cutter begins to move, orbiting around the tubular, and thus the laser beam is moved around the circumference of the tubular, cutting material away from the tubular. The laser beam will stop firing at the point when the cut in the tubular is completed. At some point before, during, or after the firing of the laser beam, ram shears are activated, severing, displacing, or both any tubular material that may still be in their path, and sealing the BOP cavity and the well.

Figure 15:
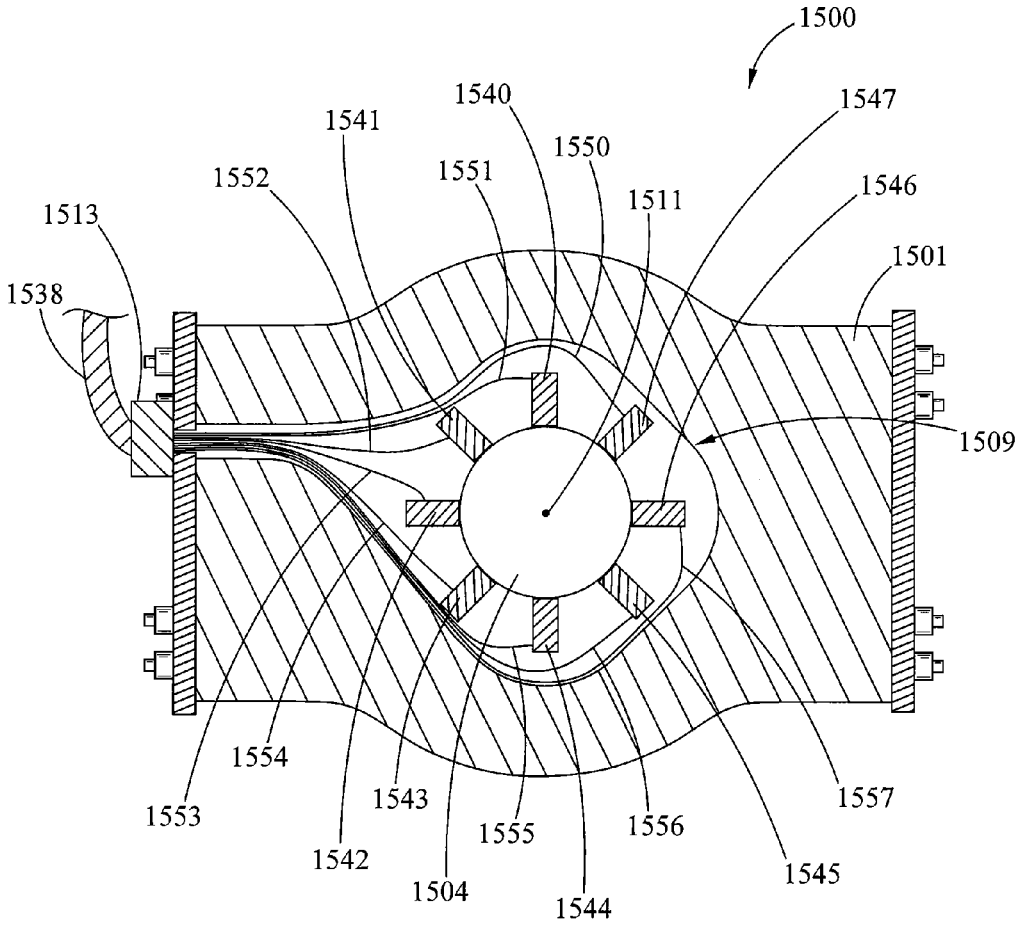
FIG. 15 is transverse cross-sectional views of a fifth embodiment of an SLM of the present invention to be used with the BOP drilling systems of FIGS. 1 and 8.

In FIG. 15 there is shown an example of an embodiment of an SLM, having fixed laser cutters, for use in a laser assisted BOP stack. Thus, there is shown an SLM 1500 having a body 1501. The body has a cavity 1504, which cavity has a center axis 1511. The body 1501 also has a feed-through assembly 1513 for managing pressure and permitting optical fiber cables and other cables, tubes, wires and conveyance means, which may be needed for the operation of the laser cutter, to be inserted into the body 1501. The body houses a laser delivery assembly 1509. The laser delivery assembly 1509 has eight laser cutters 1540, 1541, 1542, 1543, 1544, 1545, 1546 and 1547. In this embodiment the cutters do not orbit or move. The cutters are configures such that their beam paths (not shown) are radially distributed around and through the center axis 1511. Support cables 1550, 1551, 1552, 1553, 1554, 1555, 1556 and 1557 are associated with each of the laser cutters 1540, 1541, 1542, 1543, 1544, 1545, 1546 and 1547 respectively. The support cables in this embodiment do not need to accommodate the orbiting of the laser cutters around the center axis 1511, because the laser cutters are fixed and do not orbit. Further, because the laser cutters are fixed the support cables 1550, 1551, 1552, 1553, 1554, 1555, 1556 and 1557 may be semi-flexible or ridged and the entire assembly 1509 may be contained within an epoxy of other protective material. The support cables are located in a channel and enter feed-through assembly 1513. Feed-through assembly is pressure rated to the same level as the BOP, and thus should be capable of withstanding pressures of 5,000 psi, 10,000 psi, 15,000 psi, 20,000 psi and greater. In the general area of the feed-through assembly 1513 the support cables transition from flexible to semi-flexible, and may further be included in conduit 1538 for conveyance to a high power laser, or other sources. A shield, such as the shield 1470 in FIG. 14, may also be used with this and other embodiments, but is not shown in this Figure.

Although eight evenly spaced laser cutters are shown in the example of a fixed laser cutter embodiment in FIG. 15, other configurations are contemplated. Fewer or more laser cutters may be used. The cutters may be positioned such that their respective laser beam paths are parallel, or at least non-intersecting within the BOP, instead of radially intersecting each other, as would be the case for the embodiment shown in FIG. 15.

In the operation of such fixed laser cutter embodiments, the laser cutters would fire laser beams, along beam paths. The beam paths do not move with respect to the BOP. The laser beams would cut material from the tubular substantially weakening it and facilitating the severing and displacement of the tubular by the shear ram. Depending upon the placement of the laser beams on the tubular, the spot size of the laser beams on the tubular, and the power of the laser beam on the tubular, the cutters could quickly sever the tubular into two sections. If such a severing laser cut is made above the shear rams, the lower section of the tubular may drop into the borehole, provided that there is sufficient space at the bottom of the borehole, and thus out of the path of the shear rams, a blind ram, or both. A similar cut, which completely severs the tubular into two pieces, could be made by the orbiting cutter embodiments.

By having the laser delivery assemblies and in particular the laser cutters on extendable arms or pistons the distance of the laser beam path through any drilling fluids can be greatly reduced if not eliminated. Thus, the firing of the laser beam may be delayed until the laser cutters are move close to, very close to, or touching, the tubular to be cut.

In FIGS. 16A-16D there is shown an example of an embodiment of an SLM that could be used in a laser assisted BOP stack. Thus, there is shown an SLM 1600 having a body 1601. The body has a cavity 1604, which cavity has a center axis 1611 and a wall 1641. The BOP cavity also has a vertical axis and in this embodiment the vertical axis and the center axis are the same, which is generally the case for BOPs. (The naming of these axes is based upon the configuration of the BOP and are relative to the BOP structures themselves, not the position of the BOP with respect to the surface of the earth. Thus, the vertical axis of the BOP will not change if the BOP for example were laid on its side.) Typically, the center axis 1611 of cavity 1604 is on the same axis as the center axis of the wellhead cavity or opening through which tubulars are inserted into the borehole.

The body 1601 has a feed-through assemblies 1613, 1614 for managing pressure and permitting optical fiber cables and other cables, tubes, wires and conveyance means, which may be needed for the operation of the laser cutter, to be inserted into the body 1601. The body, as seen in FIGS. 16B-D, houses two laser delivery assemblies 1624, 1625. The body 1601 also contains positioning devices 1620, 1621, which are associated with piston assemblies 1622, 1623, respectively.

Figure 16A:
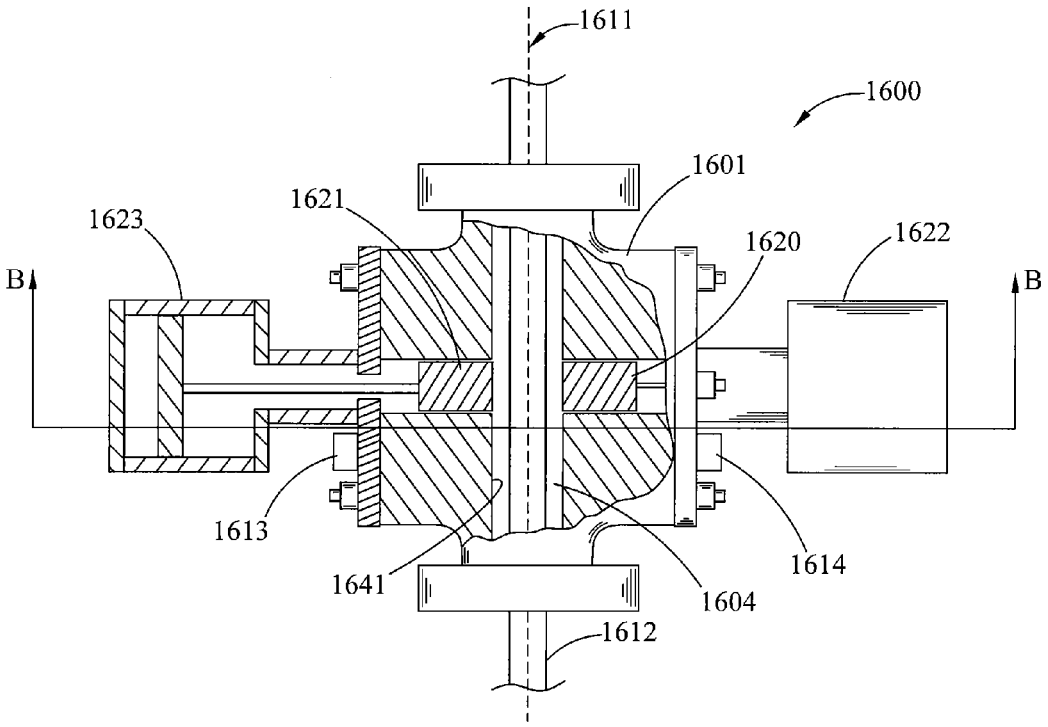
FIG. 16A is a partial cut away cross-sectional view of a section of a sixth embodiment of an SLM of the present invention to be used with the BOP drilling systems of FIGS. 1 and 8.
Figure 16B:
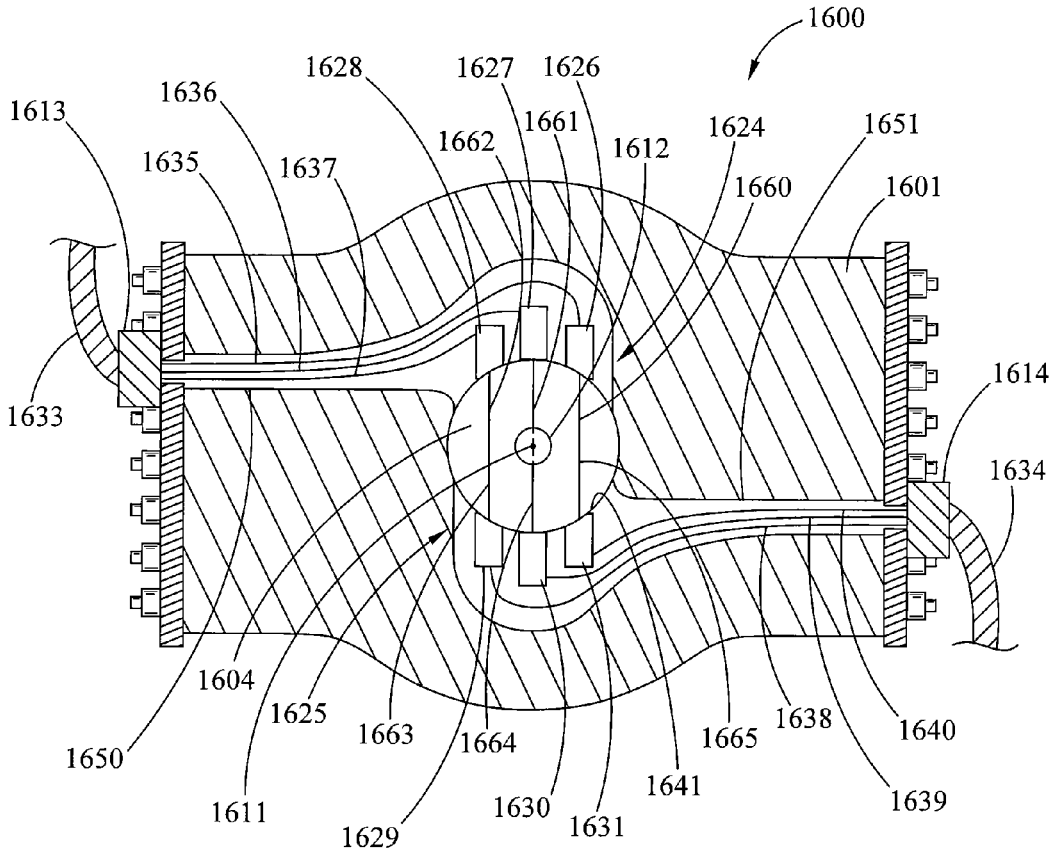
FIGS. 16B, 16C & 16D are transverse cross-sectional views of the SLM of FIG. 16 taken along line B-B of FIG. 16.
Figure 16C:
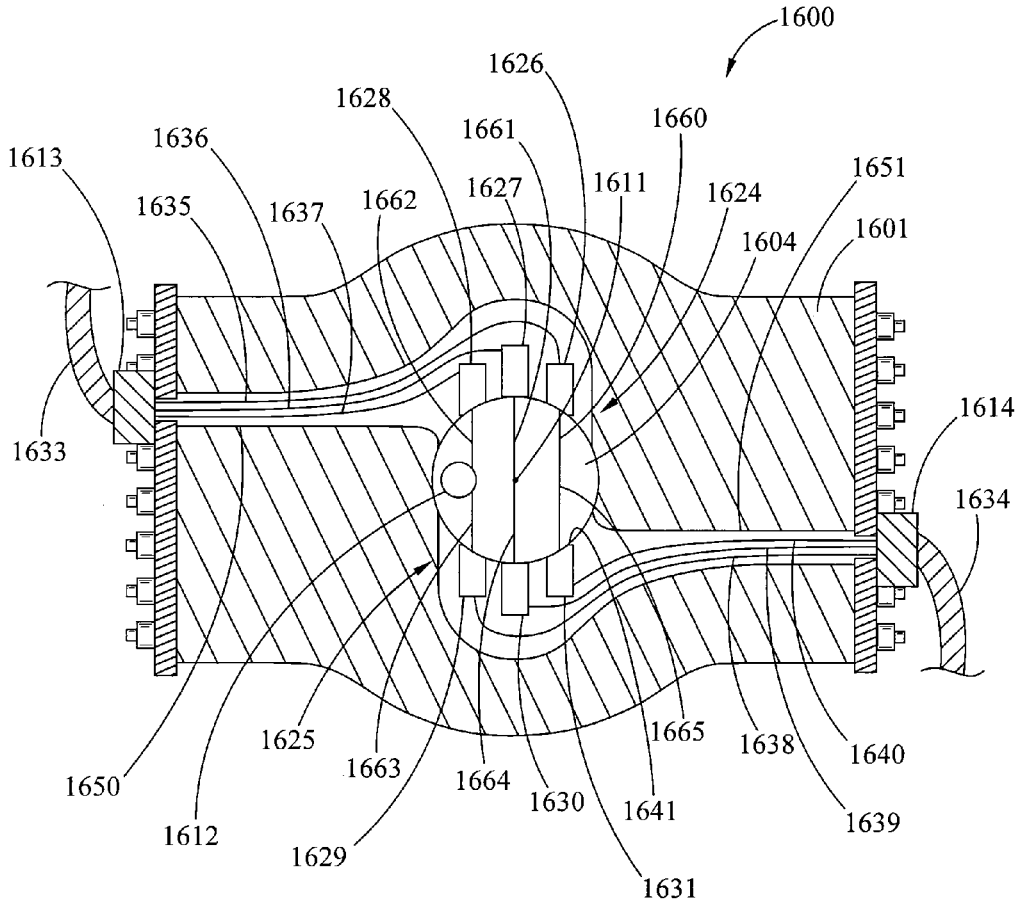
Figure 16D:
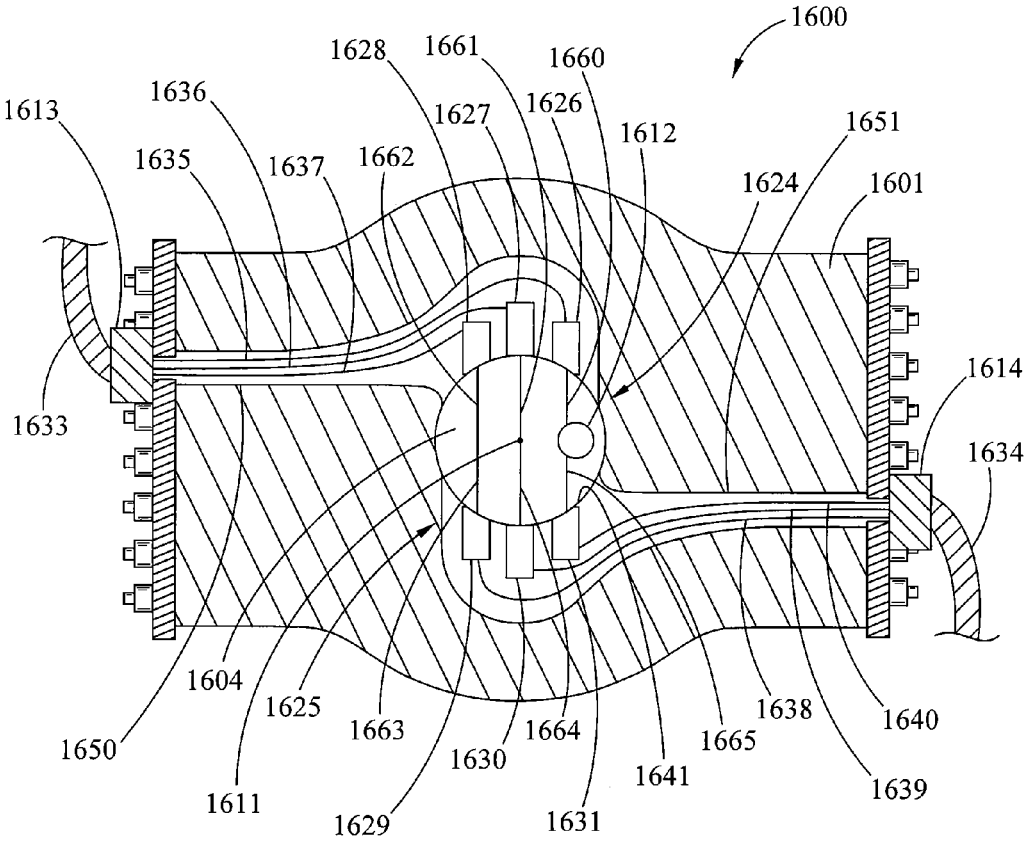

FIGS. 16B to 16D, are cross-sectional views of the embodiment shown in FIG. 16A taken along line B-B of FIG. 16A and show the sequences of operation of the SLM 1600, in cutting the tubular 1612. In FIGS. 16B to 16D there is also shown further detail of the laser delivery assemblies 1624, 1625 of SLM 1600. In this embodiment both laser assemblies 1624, 1625 could have similar components and configurations. However, the laser assemblies 1624, 1625 could have different configurations and more or fewer laser cutters.

The laser delivery assembly 1624 has three laser cutters 1626, 1627 and 1628. Flexible support cables are associated with each of the laser cutters. Flexible support cable 1635 is associated with laser cutter 1626, flexible support cable 1636 is associated with laser cutter 1627 and flexible support cable 1637 is associated with laser cutter 1628. The flexible support cables are located in channel 1650 and enter feed-through assembly 1613. In the general area of the feed-through assembly 1613 the support cables may transition from flexible to semi-flexible. However, in this and similar embodiments were the cutters do not move, there is not the need for the cutters to be flexible. The cables and may further be included in conduit 1633 for conveyance to a high power laser, or other sources of materials for the cutting operation.

The laser delivery assembly 1625 has three cutters 1631, 1630, and 1629. Flexible support cables are associated with each of the laser cutters. The flexible support cable 1640 is associated with laser cutter 1631, flexible support cable 1639 is associated with laser cutter 1630 and flexible support cable 1638 is associated with laser cutter 1629. The flexible support cables are located in channel 1651 and enter feed-through assembly 1614. In the general area of the feed-through assembly 1614 the support cables may transition from flexible to semi-flexible. However, in this and similar embodiments were the cutters do not move there is not the need for the cutters to be flexible. The cables may further be included in conduit 1634 for conveyance to a high power laser, or other sources of materials for the cutting operation.

FIGS. 16B to 16D show the sequence of activation of the positioning rams 1620, 1621 to sever a tubular 1612. In this example, the first view (e.g., a snap shot, since the sequence preferably is continuous rather than staggered or stepped) of the sequence is shown in FIG. 16B. As activated the six lasers cutters 1626, 1627, 1628, 1629, 1630, and 1631 shoot or fire laser beams toward the tubular to be cut. In this example the laser cutters are configured so that the beam paths 1660-1665, 1661-1664, 1662-1663 are parallel with the beam paths of the laser cutters on the other side of cavity 1604. The beam paths and thus the laser beams, although not configured like the spokes of a wheel, are still directed into the cavity 1604, generally toward the center axis 1611, with beam paths 1661, 1664 intersecting the center axis 1611. Further in this example the beam paths are configured to be co-linear, however, they could also be staggered. As such, the beams are shot from within the BOP, from outside of the cavity wall 1641, and travel toward the tubular 1612. The laser beams strike tubular 1612 and begin cutting, i.e., removing material from, the tubular 1612. Upon activation, the laser cutters begin firing their respective laser beams, at about the same time the positioning rams 1620, 1621 engage the tubular 1612 and move the tubular 1612 across the fixed laser beams toward the left side of the cavity 1604 (as shown in the Figure) the positioning rams 1620, 1621 then move the tubular 1612 across the fixed laser beams toward the right side of the cavity 1604 (as shown in the Figure). In this way the tubular to be cut is moved back and forth through the laser beams. It should be understood that as the number of laser cutters utilized increases, the amount of movement of the tubular can be reduced or eliminated.

In addition to finding applications in, and in association with, a BOP stack and risers, high power laser assemblies and cutters have applications in, and in association with, subsea well intervention equipment and procedures, including subsea well completion tools and assemblies, for example subsea completion test trees. Subsea test trees (as used herein subsea tree is to be given its broadest meaning possible and includes, subsea completion trees, and other assemblies that perform similar activities) have many applications, and are typically used to in conjunction with a surface vessel to conduct operations such as completion, flow testing, intervention, and other subsea well operations. Subsea trees are typically connected to a surface vessel by a string of tubulars.

In general, during and after completion of a well there may arise occurrences or situations when it is necessary to enter, reenter, into the well bore again with testing, cleaning or other types of equipment or instruments. Typically, this may be accomplished by placing a BOP, or a lower marine riser package (LRP) and an emergency disconnect package (EDP), on the well. Thus, typically, when dealing with a well having a vertical "christmas tree", which is assembly of valves, spools, pressure gauges and/or chokes fitted to the wellhead of the completed well to control production, the vertical christmas tree will be removed and the BOP secured to the well head. When dealing with horizontal and enhanced vertical christmas trees, typically, the christmas tree can be left in place, remaining secured to the well head, and the BOP (or LRP/EDP) secured to the christmas tree.

In general, when a subsea test tree is performing subsea operations the subsea test tree is extended into, and positioned within, the BOP's inner cavity. The outer diameter of the subsea test tree is slightly smaller than the inner cavity of a BOP. Thus for an 18¾ inch BOP, a typical subsea test tree will have an outer diameter of about 18½ inches. Such a subsea tree could have an inner diameter, or inner cavity, of about 7⅓ inches. The subsea test tree has, in addition to other ports and valves, two valves that are intended to control borehole pressures, flows or both and, in particular, to control or manage emergency flow or pressure situations. In general these valves may be a lower ball valve and an upper ball valve or in some assemblies this upper valve can be a flapper valve. Typically, and preferably these control valves are independent of each other, and configured to fail in a closed position. When the test tree is positioned within a BOP these valves are generally positioned below the ram shears.

During operations with a subsea test tree, many different types of tubulars and lines may be extend through the inner cavity of the test tree and into the well head and well bore. Thus, for example, VIT, wireline, slickline, coil tubing (having outer diameters of up to about 2 inches, or potentially greater) and jointed pipe (having an outer diameter of from 1 to 2 inches, or potentially greater) could be extended into and through the test tree inner cavity.

Figure 17:
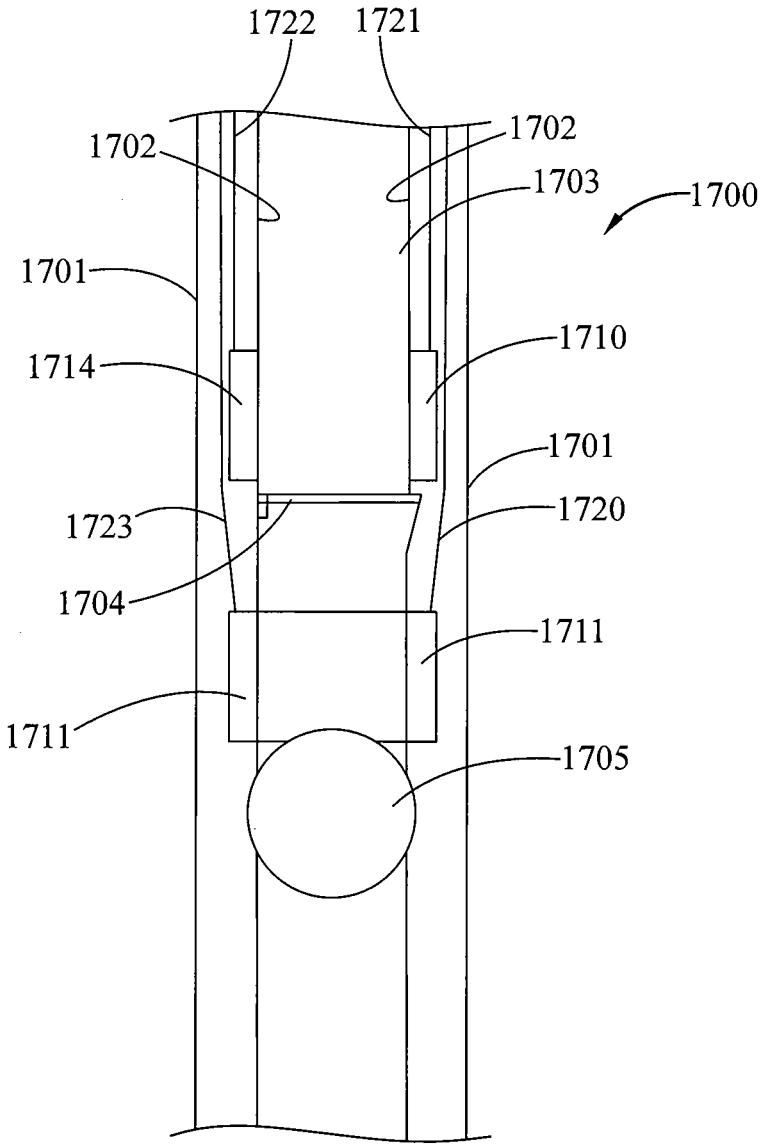
FIG. 17 is a cross-sectional view of an embodiment of a laser subsea test tree of the present invention to be used with the BOP drilling systems of FIGS. 1 and 8.

Turning to FIG. 17 there is shown a section of a subsea test tree having laser cutter assemblies. This laser subsea tree section 1700 can be used with an existing subsea test tree or it may be a component of a new subsea test tree. The subsea test tree section 1700 has an outer wall 1701, an inner wall 1702 that forms an inner cavity 1703. The subsea tree section 1700 has a flapper valve 1704, which could also be a ball valve, and a ball valve 1705, of the type generally found in conventional subsea test trees. The subsea tree section 1700 has a laser assembly 1710 associated with the flapper valve 1704 and a laser assembly 1711 associated with the ball valve 1705. In view of the potential space limitation, i.e., about 5 inches or less between the outer wall and inner wall of the test tree section, reflective optics may be useful in these laser assemblies to provide a longer, instead of radially wider profile. The laser assemblies are optically associated, by way of high power laser cables 1720, 1721, 1722, 1723, with a high power laser, also are potentially associated with other sources of materials and control information by other conduits.

The laser-subsea test tree may be used in conjunction with a non-laser BOP, or in conjunction with or as a part of a laser BOP system.

The configurations of and arrangement of the various components in a laser assisted BOP stack, an SLM and a laser subsea test tree, provide the capability of many varied sequences of laser cutter firing and activation of ram preventers and annular preventers. Thus, the sequence of laser firings and activations can be varied depending upon the situation present in the well or the BOP, to meet the requirements of that situation. Thus, for example, pipe rams could engage a tubular, laser cutters could sever the tubular without crushing it. In another example, where a casing and a tubular in that cases are in the BOP, an SLM could be fired to sever the casing, which is then pulled and dropped away, laser ram shears are then used to sever the tubular and seal the BOP cavity. In yet another example, in a situation where the BOP has for unknown reasons failed to seal off the well, all laser cutters can be repeatedly fired, removing what ever tubular may be obstructing the various rams, permitting the to seal the well The present inventions provide the ability to quickly provide laser, laser-mechanical, and mechanical cutting and sealing actions in a BOP to address situations that may arise in offshore drilling. As such, the scope of the present inventions is not limited to a particular offshore situation or sequence of activities.

The invention may be embodied in other forms than those specifically disclosed herein without departing from its spirit or essential characteristics. The described embodiments are to be considered in all respects only as illustrative and not restrictive.

What is claimed:

1. A blowout preventer stack comprising: a ram preventer comprising a pressure containment cavity; an annular preventer comprising a pressure containment cavity, and a shear laser module capable of delivering a cutting laser beam having a power of at least about 1 kW and comprising a pressure containment cavity; and, the ram preventer pressure containment cavity, the annular preventer pressure containment cavity and the shear laser module pressure containment cavity in pressure and fluid communication.

2. The blowout prevent stack of claim 1, wherein the blowout preventer is a subsea blowout preventer and wherein the annular preventer, ram preventer, and the shear laser module have a common cavity, the common cavity having a cavity axis.

3. The blowout preventer stack of claim 2, wherein the shear laser module comprises a laser cutter having a beam path that extends from the laser cutter into the common cavity.

4. The blowout preventer stack of claim 3, wherein the beam path intersects the axis of the common cavity.

5. The blowout preventer of claim 3, wherein the shear laser module comprises a laser cutter shield located adjacent to the common cavity, wherein the laser cutter shield protects the laser cutter from conditions present in the common cavity, while not appreciably interfering with the movement of tubulars through the common cavity.

6. The blowout preventer of claim 1, wherein the ram preventer is a shear ram and wherein the blowout preventer stack comprises: a second annular preventer, a second shear ram, a first pipe ram, a second pipe ram, and a third pipe ram.

7. The blowout preventer of claim 1, wherein the shear laser module comprises a plurality of laser cutters.

8. The blowout preventer of claim 2, wherein the shear laser module comprises a first laser cutter and a second laser cutter, wherein the first laser cutter has a first beam path that extends from the first laser cutter into the common cavity, wherein the second laser cutter has a second beam path that extends from the second laser cutter into the common cavity.

9. The blowout preventer of claim 8, wherein the first and second beam paths intersect within the common cavity.

10. The blowout preventer of claim 8, wherein the first and second beam paths are directed toward the cavity axis.

11. The blowout prevent of claim 8, wherein the first and second beam paths intersect the cavity axis.

12. The blowout preventer of claim 8, wherein the first and second beam paths do not intersect within the common cavity.

13. The blowout preventer of claim 8, wherein the first and second beam paths are substantially parallel.

14. The blowout preventer of claim 3, wherein the beam path forms a normal angle with the axis.

15. The blowout preventer of claim 3, wherein the beam path forms an obtuse angle with the axis.

16. The blowout preventer of claim 3, wherein the beam path forms an acute angle with the axis.

17. The blowout preventer of claim 2, wherein the ram preventer is a shear ram and wherein the blowout preventer comprises: a second annular preventer, a second shear ram, a first pipe ram, a second pipe ram, and a third pipe ram.

18. The blowout preventer of claim 8, wherein the ram preventer is a shear ram and wherein the blowout preventer comprises: a second annular preventer, a second shear ram, a first pipe ram, a second pipe ram, and a third pipe ram.

19. The blowout preventer of claim 8, wherein the first and second laser cutters are configured to rotate around the common cavity upon activation.

20. The blowout preventer of claim 3, wherein the laser cutter is positioned outside of the common cavity.

21. The blowout preventer of claim 8, wherein the first and the second laser cutters are positioned outside of the common cavity.

22. The blowout preventer of claim 17, wherein the first and the second laser cutters are adjacent to the common cavity.

23. The blowout preventer of claim 3, wherein the laser cutter is adjacent to the common cavity.

24. The blowout preventer of claim 8, wherein the first and the second laser cutters are adjacent to the common cavity.

25. The blowout preventer of claim 17, wherein the first and the second laser cutters are positioned outside of the common cavity.

26. The blowout preventer of claim 3 or 6, wherein the shear laser module comprises a laser cutter shield located adjacent to the common cavity, wherein the laser cutter shield protects the laser cutter from damage, while not appreciably interfering with the movement of tubulars through the common cavity.

27. The blowout preventer of claim 14, wherein the ram preventer is a shear ram and wherein the blowout preventer comprises: a second annular preventer, a second shear ram, a first pipe ram, a second pipe ram, and a third pipe ram.

28. A shear laser module for delivery of a cutting laser beam for use in a blowout preventer stack, the module comprising:

a. a body having a first blowout preventer stack connector and a second blowout preventer stack connector;

b. the body having a pressure containment cavity for passing tubulars therethrough and conveying and controlling a flow of a drilling fluid therethrough; and, c. a laser cutter in the body and having a beam path and capable of delivering a high power cutting laser beam having a power of at least about 1 kW and;

d. wherein the beam path travels from the laser cutter into the cavity and to any tubular that may be in the cavity.

29. The shear laser module of claim 28, comprising a laser cutter shield.

30. The shear laser module of claim 28, comprising a second laser cutter.

31. The shear laser module of claim 28, wherein the laser cutter is configured within the body to orbit around the cavity.

32. The shear laser module of claim 28 comprising a laser cutter shield located adjacent to the cavity, wherein the laser cutter shield protects the laser cutter from drilling fluids, while not appreciably interfering with the movement of tubulars through the cavity.

33. The shear laser module of claim 28, comprising: a support cable comprising a high power laser optical fiber optically associated with the laser cutter and a feed-through assembly mechanically associated with the support cable.

34. The shear laser module of claim 33, wherein the module is rated at greater than 5,000 psi operating pressure.

35. The shear laser module of claim 33, wherein the module is rated at greater than 10,000 psi operating pressure.

36. The shear laser module of claim 33, wherein the module is rated at greater than 15,000 psi operating pressure.

37. The shear laser module of claim 28 comprising a second laser cutter, wherein the laser cutter beam path constitutes a first beam path, wherein the second laser cutter has a second beam path that extends from the second laser cutter into the cavity.

38. The shear laser module of claim 37, wherein the first and second beam paths intersect within the cavity.

39. The shear laser module of claim 37, wherein the first and second beam paths are directed toward the cavity axis.

40. The shear laser module of claim 37, wherein the cavity has a cavity axis and the first and second beam paths intersect the cavity axis.

41. The shear laser module of claim 37, wherein the first and second beam paths do not intersect within the cavity.

42. The shear laser module of claim 37, wherein the first and second beam paths are substantially parallel.

43. The shear laser module of claim 28, wherein the cavity has a cavity axis and the beam path forms a normal angle with the axis.

44. The shear laser module of claim 28, wherein the cavity has a cavity axis and the beam path forms an obtuse angle with the axis.

45. The shear laser module of claim 28, wherein the cavity has a cavity axis and the beam path forms an acute angle with the axis.

46. The shear laser module of claim 32 wherein the laser cutter is configured to orbit at least partially around the cavity during activation.

47. The shear laser module of claim 28, 32, or 34 wherein the laser cutter is positioned outside of the cavity.

48. The shear laser module of claim 37, wherein the first and the second laser cutters are positioned outside of the cavity.

49. The shear laser module of claim 37, wherein the first and the second laser cutters are adjacent to the cavity.

50. The shear laser module of claim 28 or 34 wherein the laser cutter is adjacent to the cavity.

51. A method of retrofitting a pre-existing blowout preventer ("BOP") stack with a shear laser module to make a laser assisted BOP stack, the method comprising:

a. evaluating a pre-existing BOP stack, comprising determining an operational specification for the pre-existing BOP stack;

b. comparing the operational specification for the pre-existing BOP stack to a requirement for an intended use of the pre-existing BOP stack, and determining that the pre-existing BOP stack operational specification does not meet the requirement for the intended use; and c. retrofitting the pre-existing BOP stack by adding a shear laser module capable of delivering a cutting laser beam having a power of at least about 1 kW and comprising a pressure containment cavity to the pre-existing BOP stack; whereby the retrofitted BOP stack meets the requirement for the intended use.

52. A method of making a laser assisted blowout preventer ("BOP") stack, the method comprising:

a. obtaining an annular preventer comprising a pressure containment cavity;

b. obtaining a ram preventer comprising a pressure containment cavity;

c. obtaining a shear laser module capable of delivering a cutting laser beam having a power of at least about 1 kW and comprising a pressure containment cavity;

d. assembling a BOP stack comprising the annular preventer, the ram preventer and the shear laser module; whereby the containment cavities are in pressure and fluid communication.

53. A blowout preventer stack comprising: a body defining a pressure containment cavity for passing tubulars through; a means for mechanically sealing the cavity; a means for providing a high power cutting laser beam having a power of at least about 1 kW along a laser beam path within the cavity; and a means for sealing the laser beam providing means; whereby the laser beam can be delivered in the mechanically sealed cavity.

54. The blowout preventer stack of claim 53, wherein the blowout preventer stack is a subsea blowout preventer stack and wherein the means for mechanically sealing the cavity is a ram preventer.

55. The blowout preventer stack of claim 54, comprising an annular preventer.

56. The blowout preventer stack of claim 53, wherein the means for providing a laser beam along a laser beam path comprises a laser cutter.

57. The blowout preventer stack of claim 53, wherein the means for providing a laser beam along a laser beam path comprises a plurality of laser cutters.

58. The blowout preventer stack of claim 53, wherein the means for providing a laser beam along a laser beam path comprises a plurality of orbital laser cutters.

59. The blowout preventer stack of claim 53, wherein the means for providing a laser beam along a laser beam path comprises a plurality of laser cutters each having a beam path and wherein at least two beam paths intersect within the cavity.

60. A subsea blowout preventer stack comprising: a means for connecting to a well; a means for connecting to a riser; a body defining a pressure containment cavity; the cavity in fluid communication with the means for connecting to the well and the means for connecting to the riser; a means for sealing the cavity; and, a means for providing a high power cutting laser beam having a power of at least about 1 kW within the cavity.

61. The subsea blowout preventer stack of claim 60, wherein the means for providing a laser beam comprises a laser cutter.

62. The subsea blowout preventer stack of claim 60, wherein the means for providing a laser beam comprises a plurality of laser cutters, each providing a laser beam path, wherein at least two laser beam paths intersect within the cavity.

63. A subsea blowout preventer stack comprising: a means for defining a pressure containment cavity for passing tubulars therethrough and conveying and controlling a flow of a drilling fluid therethrough; a means for sealing the cavity; and, a means for providing first and second high power cutting laser beam paths for laser beams having a power of at least about 1 kW within the cavity.

64. The subsea blowout prevent stack of claim 63, wherein the first and second laser beam paths intersect within the cavity.

* * * * *